US008204728B2

(12) United States Patent
Schottle et al.

(10) Patent No.: US 8,204,728 B2
(45) Date of Patent: Jun. 19, 2012

(54) SYSTEMS AND METHODS FOR IMPROVED POSITIONING OF PADS

(75) Inventors: Gary Schottle, Sugar Land, TX (US); Dan Colvin, Dripping Springs, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 13/281,936

(22) Filed: Oct. 26, 2011

(65) Prior Publication Data

US 2012/0037359 A1 Feb. 16, 2012

Related U.S. Application Data

(63) Continuation of application No. 12/369,606, filed on Feb. 11, 2009, now Pat. No. 8,073,664.

(60) Provisional application No. 61/027,694, filed on Feb. 11, 2008.

(51) Int. Cl.

| | |
|---|---|
| ***G06G 7/48*** | (2006.01) |
| ***E21B 43/00*** | (2006.01) |
| ***E21B 49/00*** | (2006.01) |
| ***E21B 23/00*** | (2006.01) |

(52) U.S. Cl. ..... 703/10; 166/245; 166/250.1; 166/381

(58) Field of Classification Search ..... 703/10; 166/244.1, 245, 250.1, 381

See application file for complete search history.

(56) References Cited

U.S. PATENT DOCUMENTS 4,967,844 A * 11/1990 Brooks et al. ..... 166/381
5,730,219 A * 3/1998 Tubel et al. ..... 166/250.1
6,266,619 B1 7/2001 Thomas et al.
6,315,054 B1 * 11/2001 Brunet ..... 166/387
6,356,844 B2 3/2002 Thomas et al.
6,853,921 B2 2/2005 Thomas et al.
7,079,952 B2 7/2006 Thomas et al.
7,096,172 B2 8/2006 Colvin et al.
7,200,540 B2 4/2007 Colvin et al.
7,896,088 B2 * 3/2011 Guerrero et al. ..... 166/382

OTHER PUBLICATIONS

"Design and Installation of a 20-Slot Template in the Gulf of Mexico in 760 ft of Water". Brinkmann, et al. SPE Drilling Engineering. Jun. 1987.*

K.C. Oren, Gary Schottle; Software Aids Tight Sands Development; The American Oil and Gas Reporter, Jul. 2007; pp. 1-4.

International Search Report and Written Opinion—PCT/US2009/033821; Sep. 13, 2010; 14 pages; European Patent Office.

TracPlanner Software; Jul. 1, 2008; 4 pages; XP-002598500; Landmark Graphics Corporation; USA.

Norrena, Karl P. & Deutsch, Clayton V.; Automatic Determination of Well Placement Subject to Geostatistical and Economic Constraints; SPE/Petroleum Society of CIM/CHOA 78996; Nov. 4, 2002; pp. 1-12; XP-002499489; 2002 SPE International Thermal Operations and Heavy Oil Symposium and International Horizontal Well Technology Conference,;Calgary, Canada LNKD.

Article 34 Response—PCT/US2009/033821; Nov. 5, 2010; 3 pages.

(Continued)

*Primary Examiner* — Kandasamy Thangavelu
*Assistant Examiner* — Nithya Janakiraman
(74) *Attorney, Agent, or Firm* — Crain Caton & James

(57) ABSTRACT

Systems and methods for the automated positioning of pads and orienting of slot templates for the pads. The systems and methods also include automated adjustment of well path plans from a pad to selected well targets.

20 Claims, 36 Drawing Sheets

OTHER PUBLICATIONS

Sugiura, et al.; Integrated Approach to Rotary Steerable Drilling Optimization Using Concurrent Real-Time Measurement of Near-Bit Borehole Caliper and Near-Bit Vibration; Abstract; 2008.

Van Berlo, Andre; Communication Pursuant to Article 94(3) EPC-EP Examination Report; Mar. 29, 2011; 4 pgs.; European Patent Office; Netherlands.

* cited by examiner

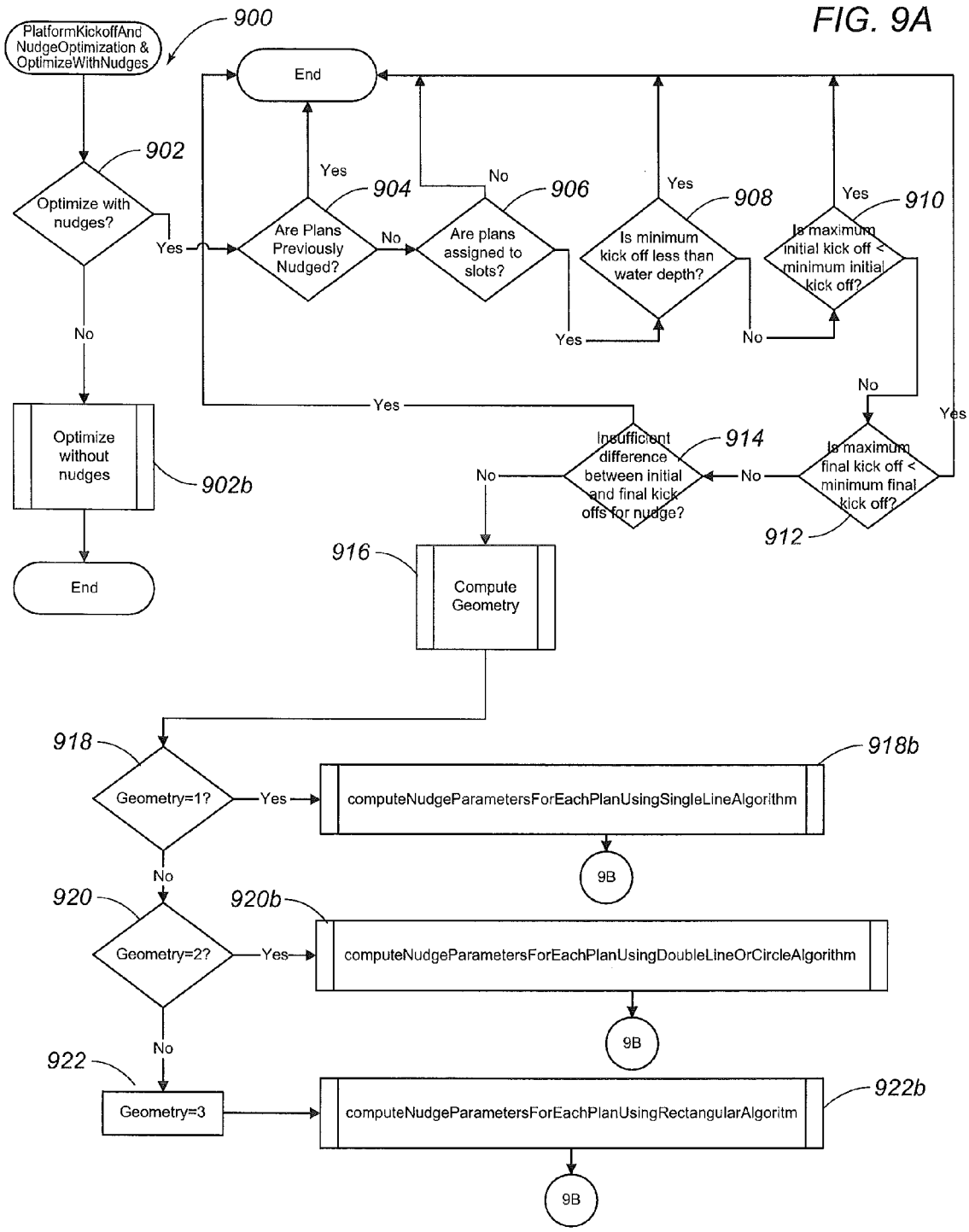
FIG. 9A
900
PlatformKickoffAnd NudgeOptimization & OptimizeWithNudges
End
902
Optimize with nudges?
Yes
No
904
Are Plans Previously Nudged?
906
Are plans assigned to slots?
908
Is minimum kick off less than water depth?
910
Is maximum initial kick off < minimum initial kick off?
912
Is maximum final kick off < minimum final kick off?
914
Insufficient difference between initial and final kick offs for nudge?
902b
Optimize without nudges
End
916
Compute Geometry
918
Geometry=1?
918b
computeNudgeParametersForEachPlanUsingSingleLineAlgorithm
9B
920
Geometry=2?
920b
computeNudgeParametersForEachPlanUsingDoubleLineOrCircleAlgorithm
9B
922
Geometry=3
922b
computeNudgeParametersForEachPlanUsingRectangularAlgoritm
9B

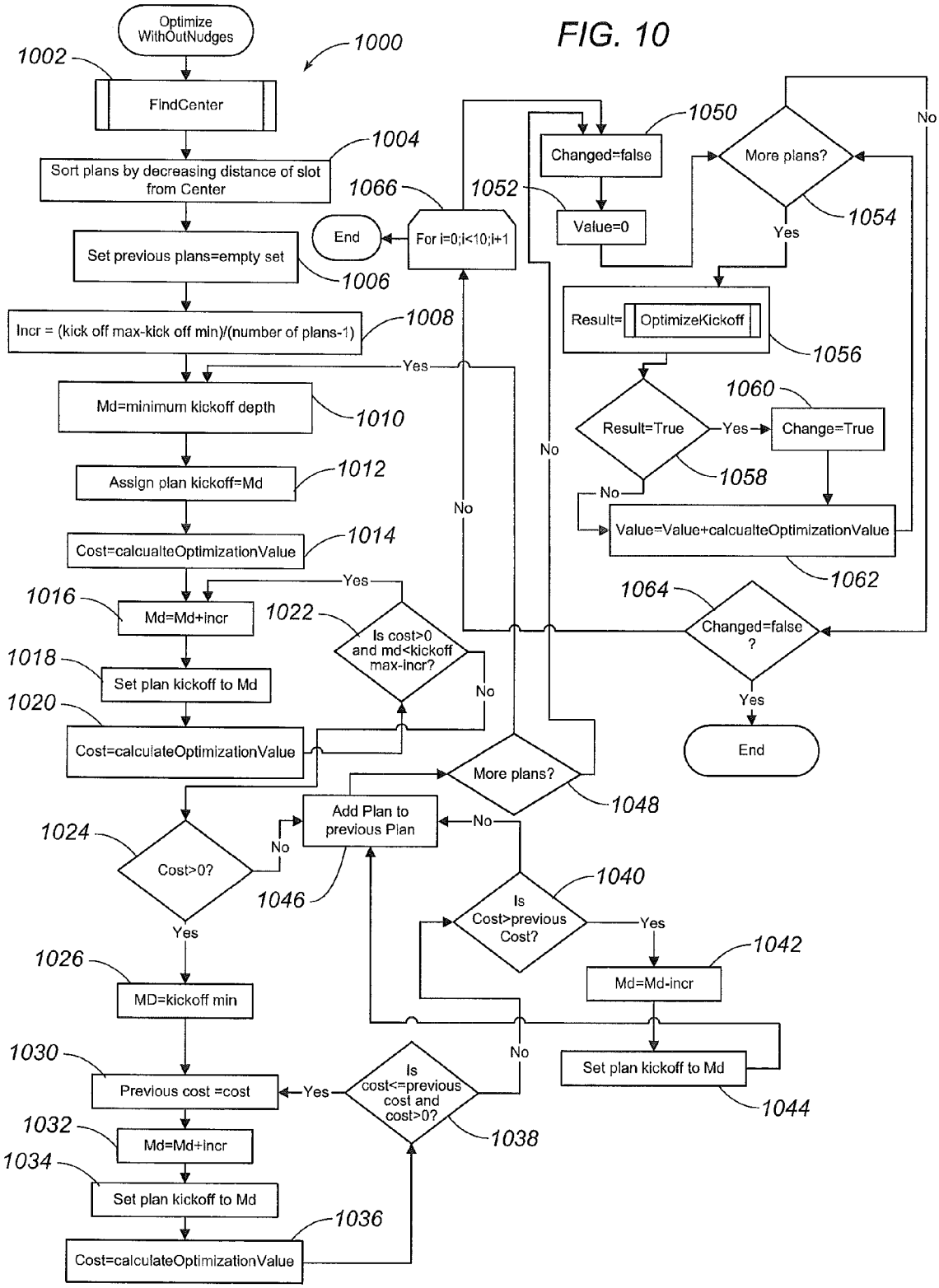
FIG. 10
1000
Optimize WithOutNudges
1002
FindCenter
1004
Sort plans by decreasing distance of slot from Center
1006
Set previous plans=empty set
1008
Incr = (kick off max-kick off min)/(number of plans-1)
1010
Md=minimum kickoff depth
1012
Assign plan kickoff=Md
1014
Cost=calcualteOptimizationValue
1016
Md=Md+incr
1018
Set plan kickoff to Md
1020
Cost=calculateOptimizationValue
1022
Is cost>0 and md<kickoff max-incr?
1024
Cost>0?
1026
MD=kickoff min
1030
Previous cost =cost
1032
Md=Md+incr
1034
Set plan kickoff to Md
1036
Cost=calculateOptimizationValue
1038
Is cost<=previous cost and cost>0?
1040
Is Cost>previous Cost?
1042
Md=Md-incr
1044
Set plan kickoff to Md
1046
Add Plan to previous Plan
1048
More plans?
1050
Changed=false
1052
Value=0
1054
More plans?
1056
Result= OptimizeKickoff
1058
Result=True
1060
Change=True
1062
Value=Value+calcualteOptimizationValue
1064
Changed=false ?
1066
For i=0;i<10;i+1
End
Yes
No

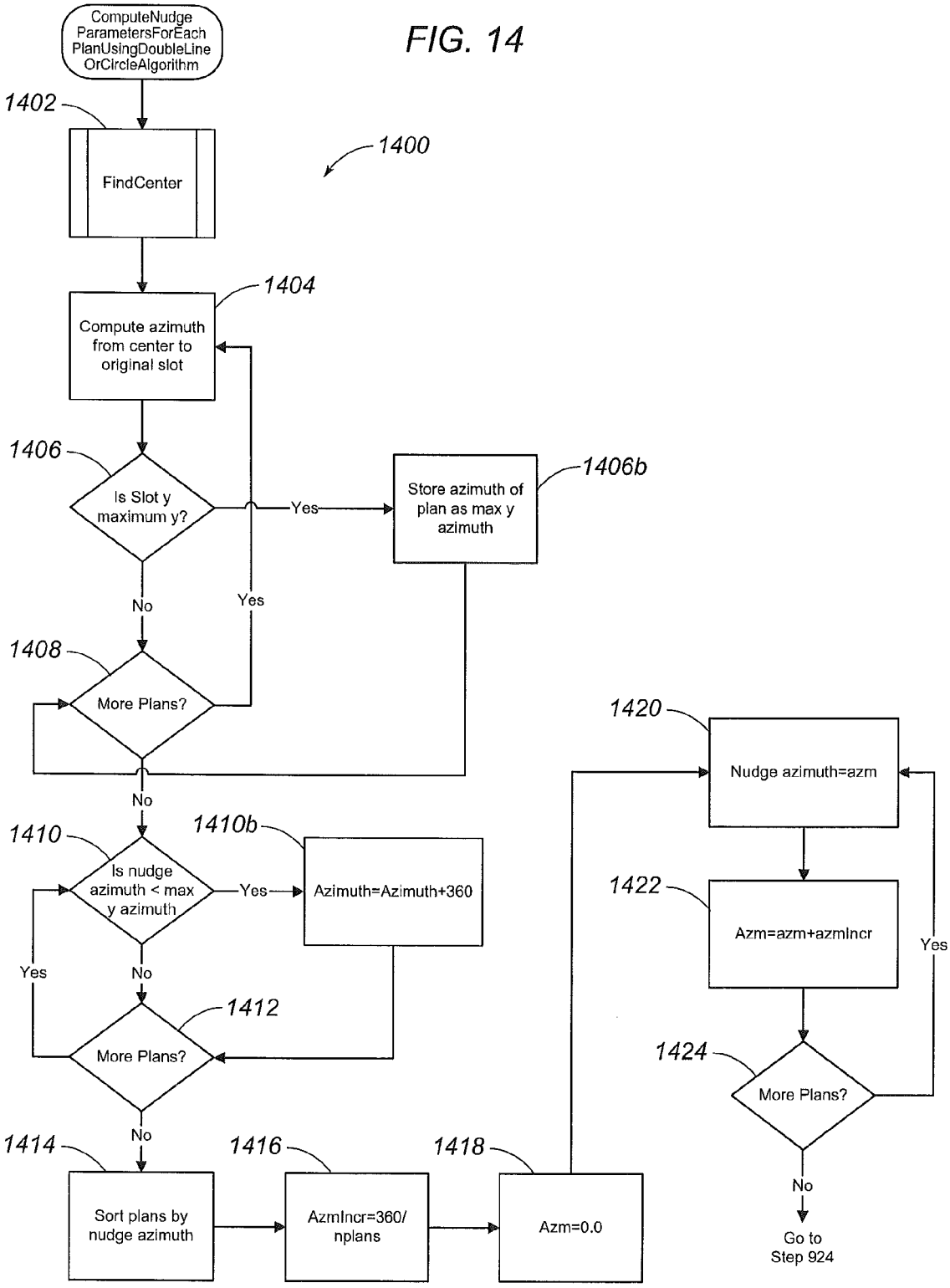
FIG. 14
ComputeNudge ParametersForEach PlanUsingDoubleLine OrCircleAlgorithm
1400
1402
FindCenter
1404
Compute azimuth from center to original slot
1406
Is Slot y maximum y?
Yes
1406b
Store azimuth of plan as max y azimuth
No
Yes
1408
More Plans?
No
1410
Is nudge azimuth < max y azimuth
Yes
1410b
Azimuth=Azimuth+360
Yes
No
1412
More Plans?
No
1414
Sort plans by nudge azimuth
1416
AzmIncr=360/ nplans
1418
Azm=0.0
1420
Nudge azimuth=azm
1422
Azm=azm+azmIncr
Yes
1424
More Plans?
No
Go to Step 924

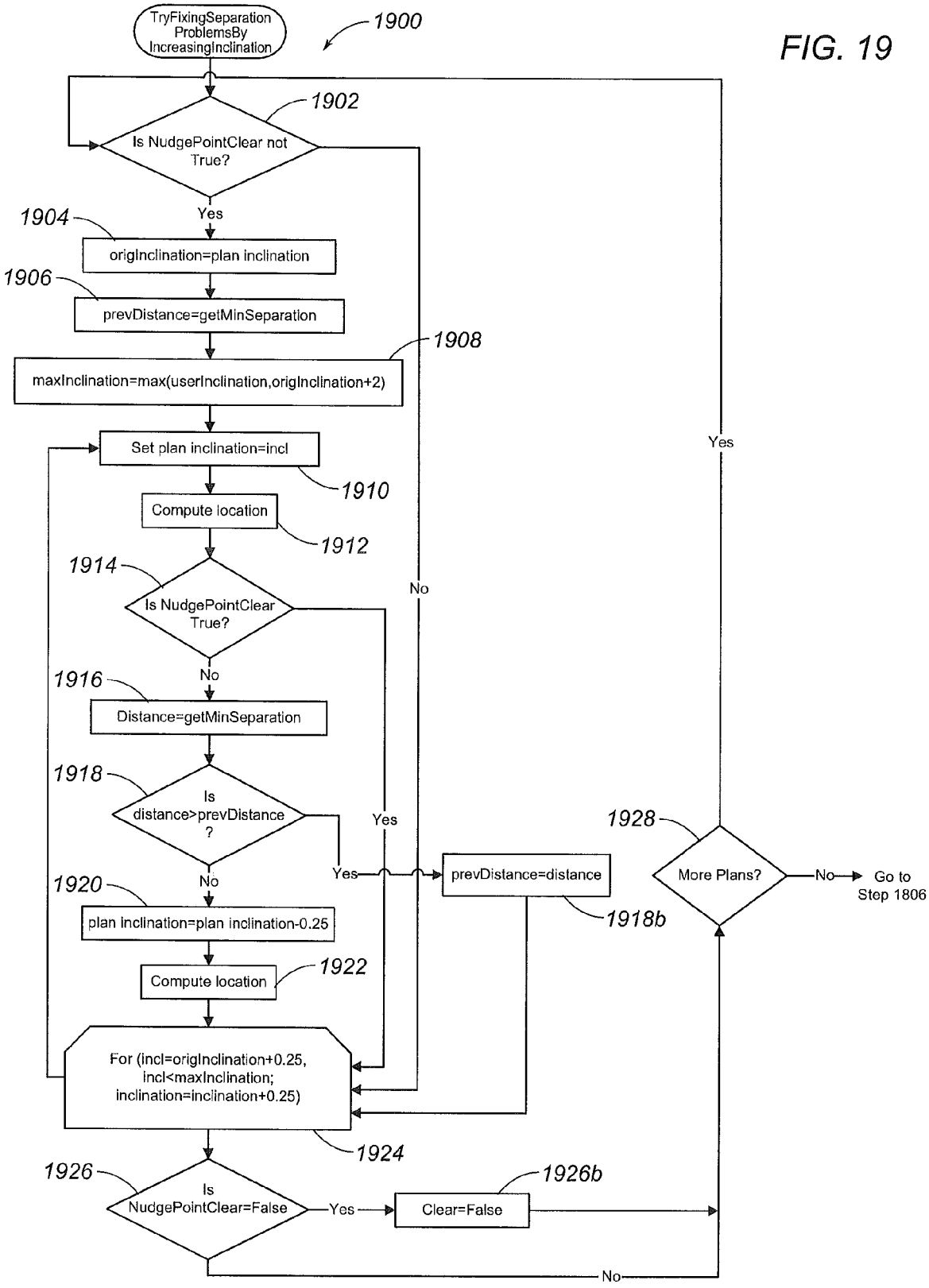
TryFixingSeparation ProblemsBy IncreasingInclination
1900
FIG. 19
1902
Is NudgePointClear not True?
Yes
No
1904
origInclination=plan inclination
1906
prevDistance=getMinSeparation
1908
maxInclination=max(userInclination,origInclination+2)
Set plan inclination=incl
1910
Compute location
1912
1914
Is NudgePointClear True?
No
1916
Distance=getMinSeparation
1918
Is distance>prevDistance ?
Yes
No
1920
plan inclination=plan inclination-0.25
Compute location
1922
For (incl=origInclination+0.25, incl<maxInclination; inclination=inclination+0.25)
1924
prevDistance=distance
1918b
1928
More Plans?
Yes
No
Go to Step 1806
1926
Is NudgePointClear=False
Yes
No
1926b
Clear=False

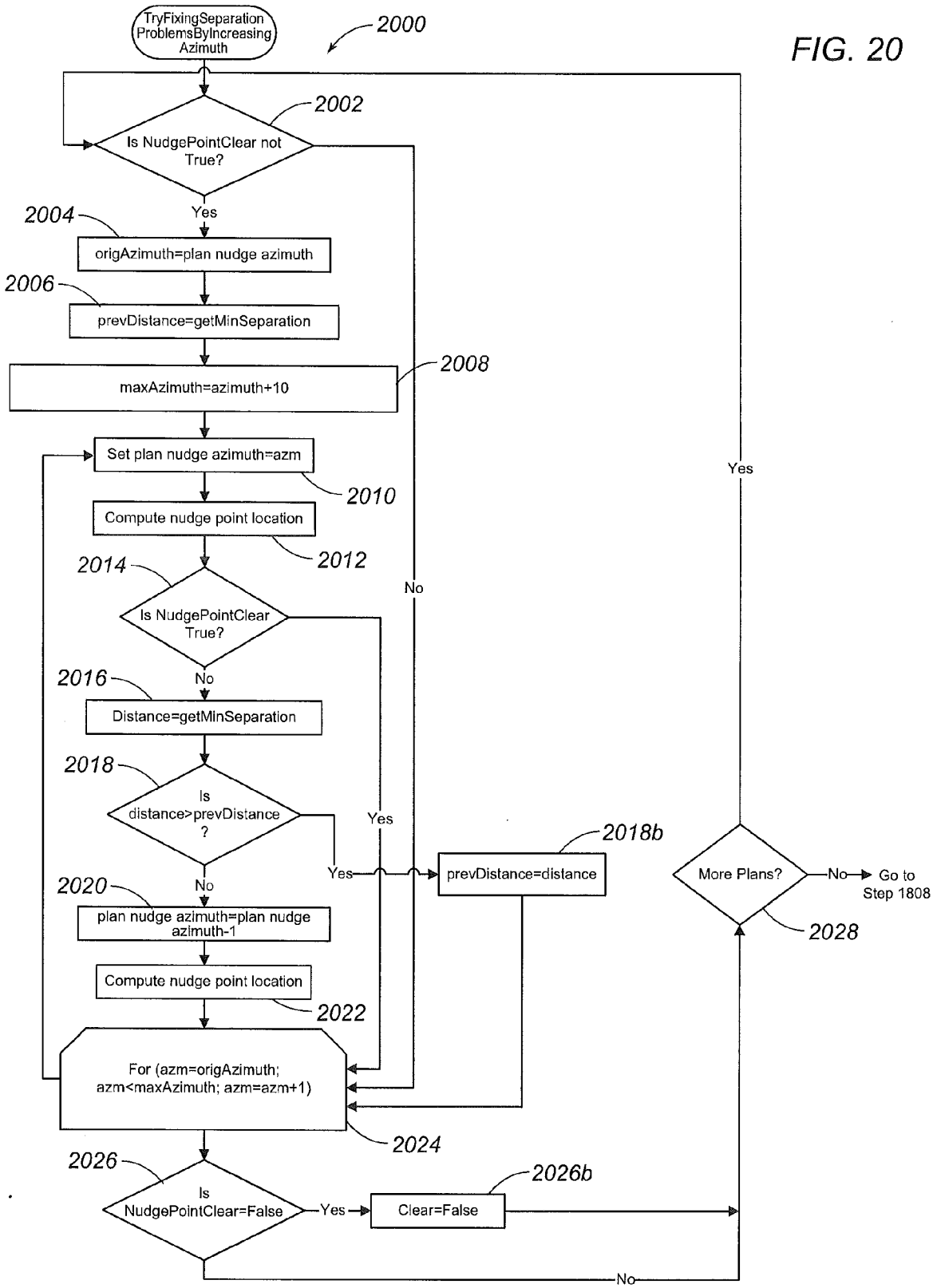
TryFixingSeparation ProblemsByIncreasing Azimuth
2000
FIG. 20
2002
Is NudgePointClear not True?
Yes
2004
origAzimuth=plan nudge azimuth
2006
prevDistance=getMinSeparation
2008
maxAzimuth=azimuth+10
Set plan nudge azimuth=azm
2010
Compute nudge point location
2012
2014
Is NudgePointClear True?
No
2016
Distance=getMinSeparation
2018
Is distance>prevDistance ?
Yes
No
2018b
prevDistance=distance
2020
plan nudge azimuth=plan nudge azimuth-1
Compute nudge point location
2022
For (azm=origAzimuth; azm<maxAzimuth; azm=azm+1)
2024
2026
Is NudgePointClear=False
2026b
Clear=False
More Plans?
2028
Go to Step 1808

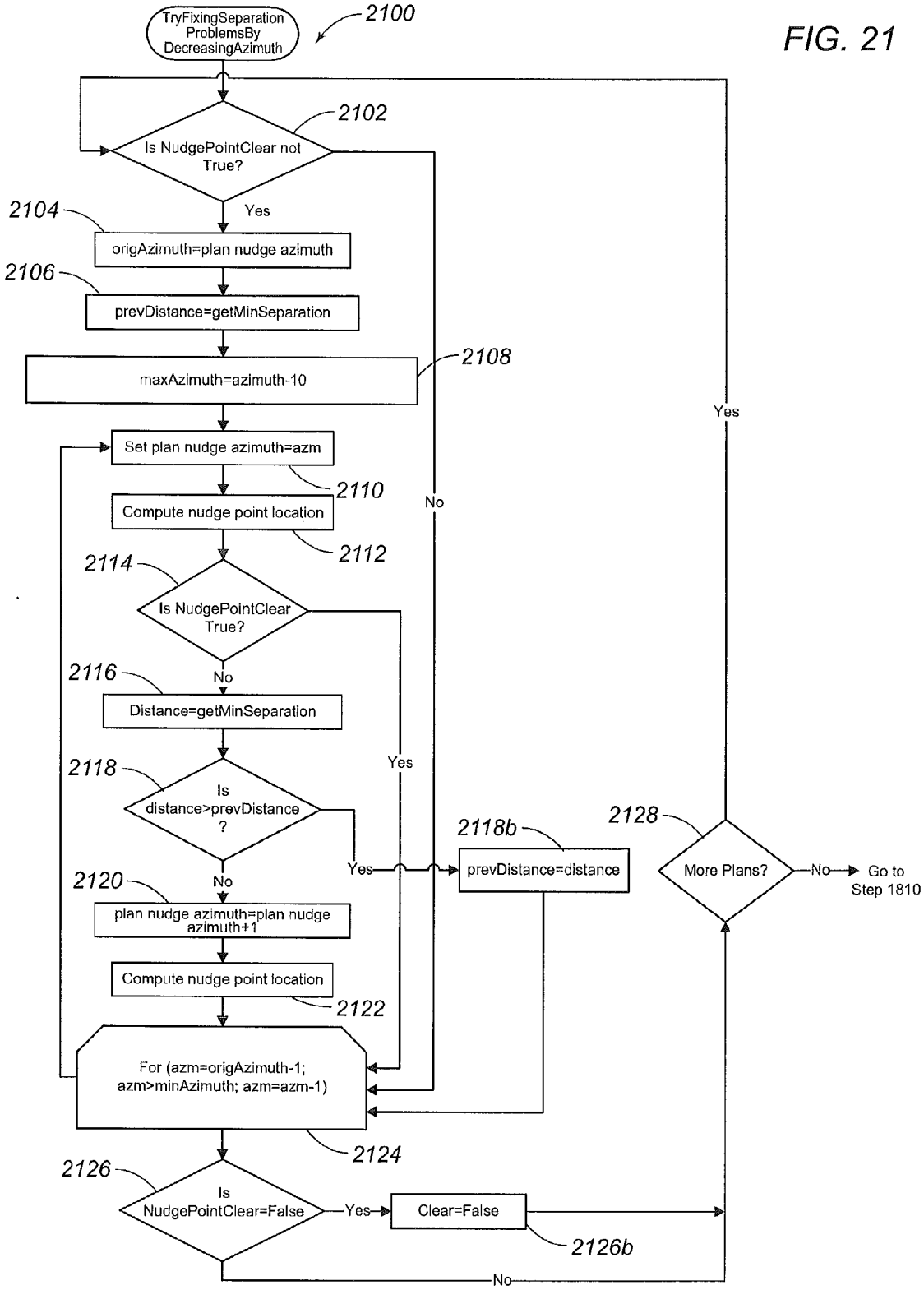
TryFixingSeparation ProblemsBy DecreasingAzimuth
2100
FIG. 21
2102
Is NudgePointClear not True?
Yes
No
2104
origAzimuth=plan nudge azimuth
2106
prevDistance=getMinSeparation
2108
maxAzimuth=azimuth-10
Set plan nudge azimuth=azm
2110
Compute nudge point location
2112
2114
Is NudgePointClear True?
No
Yes
2116
Distance=getMinSeparation
2118
Is distance>prevDistance ?
Yes
No
2118b
prevDistance=distance
2128
More Plans?
No
Go to Step 1810
Yes
2120
plan nudge azimuth=plan nudge azimuth+1
Compute nudge point location
2122
For (azm=origAzimuth-1; azm>minAzimuth; azm=azm-1)
2124
2126
Is NudgePointClear=False
Yes
Clear=False
2126b
No

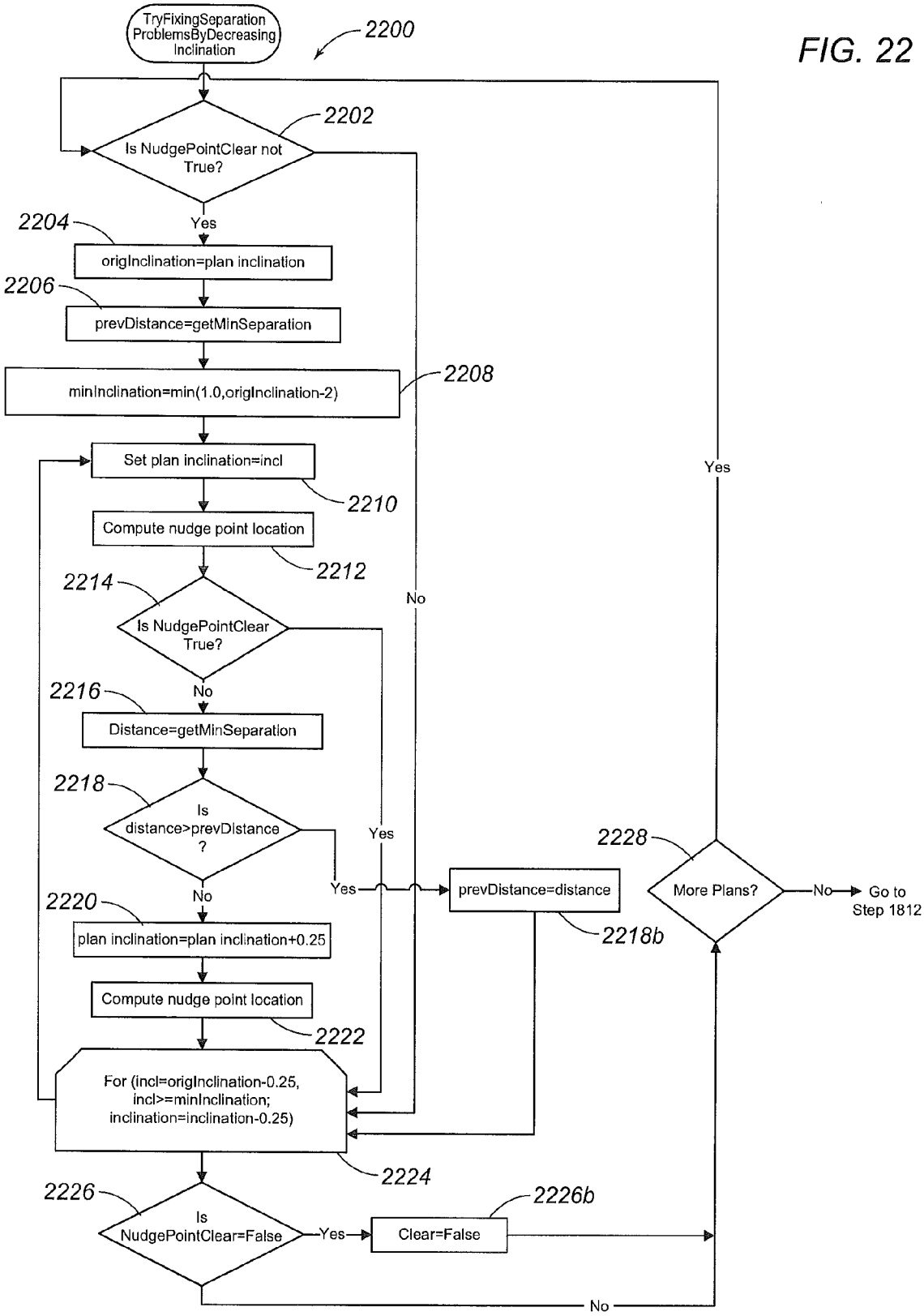
TryFixingSeparation ProblemsByDecreasing Inclination
2200
FIG. 22
2202
Is NudgePointClear not True?
Yes
2204
origInclination=plan inclination
2206
prevDistance=getMinSeparation
minInclination=min(1.0,origInclination-2)
2208
Set plan inclination=incl
2210
Compute nudge point location
2212
2214
Is NudgePointClear True?
No
2216
Distance=getMinSeparation
2218
Is distance>prevDistance ?
Yes
No
2220
plan inclination=plan inclination+0.25
Compute nudge point location
2222
For (incl=origInclination-0.25, incl>=minInclination; inclination=inclination-0.25)
2224
2226
Is NudgePointClear=False
Yes
No
2226b
Clear=False
prevDistance=distance
2218b
2228
More Plans?
No
Go to Step 1812
Yes

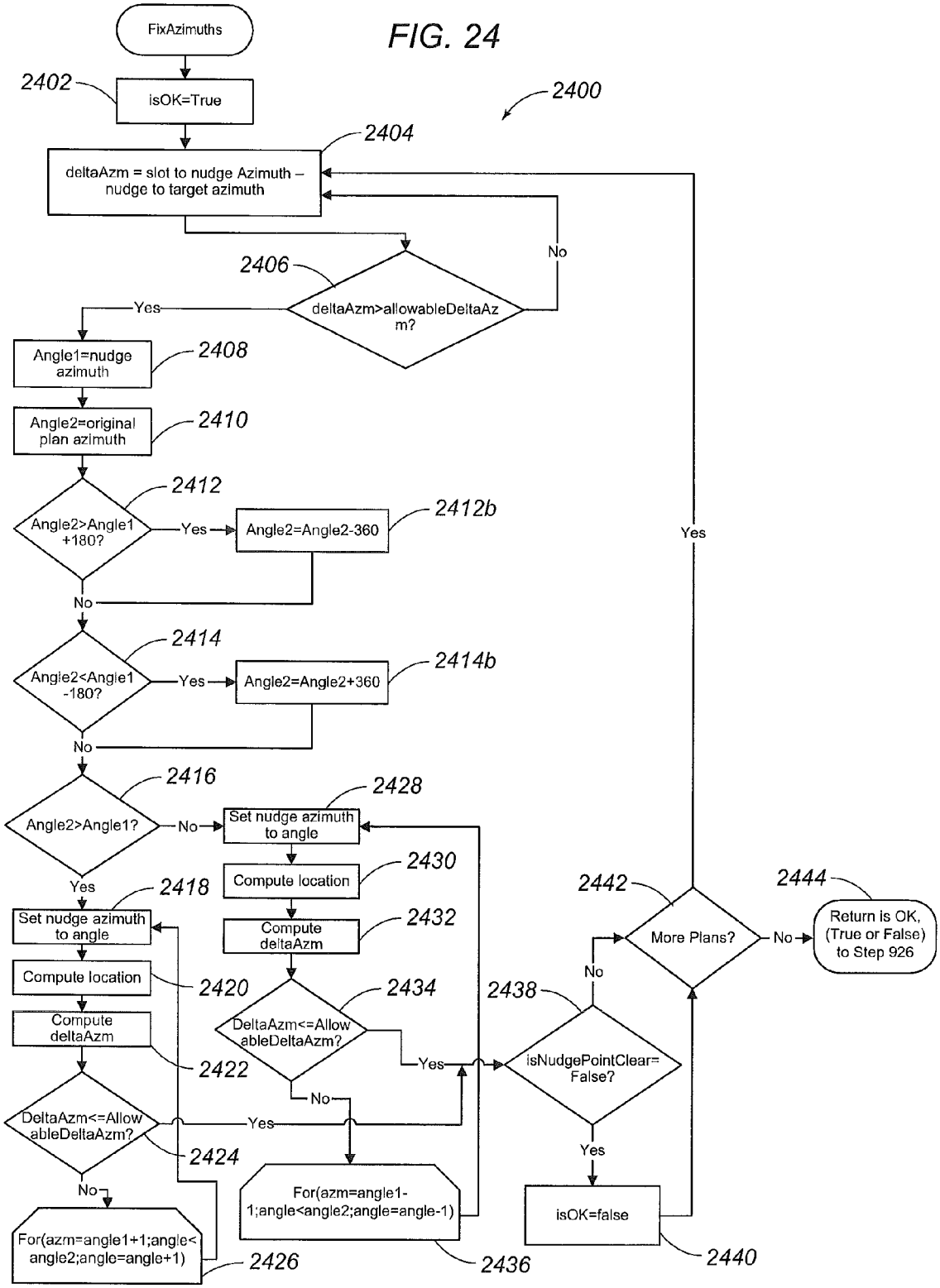
FIG. 24
2400
FixAzimuths
2402
isOK=True
2404
deltaAzm = slot to nudge Azimuth – nudge to target azimuth
2406
deltaAzm>allowableDeltaAzm?
Yes
No
Angle1=nudge azimuth
2408
Angle2=original plan azimuth
2410
2412
Angle2>Angle1+180?
Yes
Angle2=Angle2-360
2412b
No
2414
Angle2<Angle1-180?
Yes
Angle2=Angle2+360
2414b
No
2416
Angle2>Angle1?
No
2428
Set nudge azimuth to angle
Yes
2418
Set nudge azimuth to angle
Compute location
2430
Compute deltaAzm
2432
Compute location
2420
Compute deltaAzm
2422
2434
DeltaAzm<=AllowableDeltaAzm?
Yes
No
DeltaAzm<=AllowableDeltaAzm?
Yes
2424
No
For(azm=angle1+1;angle<angle2;angle=angle+1)
2426
For(azm=angle1-1;angle<angle2;angle=angle-1)
2436
2438
isNudgePointClear=False?
Yes
No
isOK=false
2440
2442
More Plans?
No
Yes
2444
Return is OK, (True or False) to Step 926

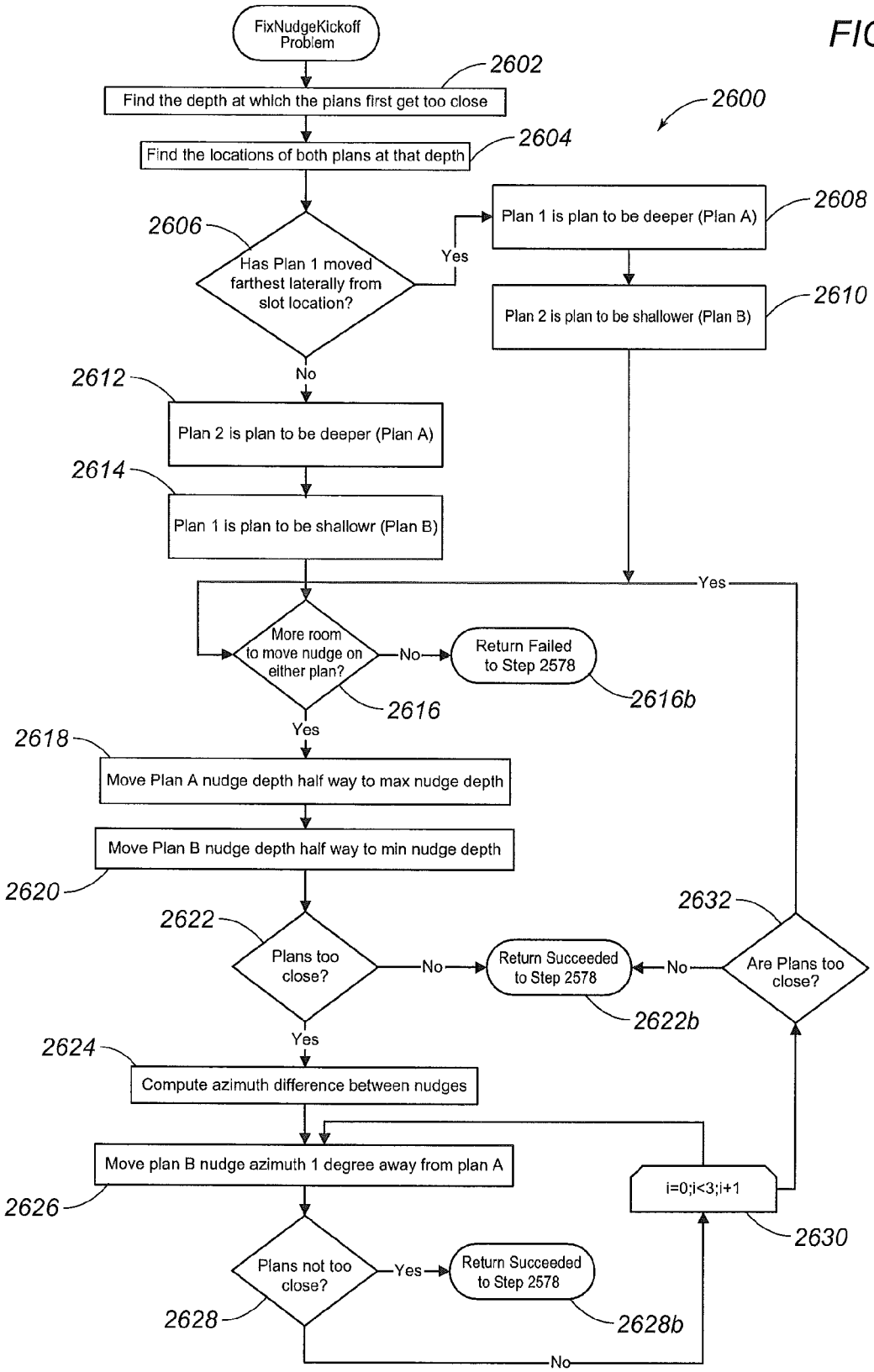
FIG. 26
2600
FixNudgeKickoff Problem
2602
Find the depth at which the plans first get too close
2604
Find the locations of both plans at that depth
2606
Has Plan 1 moved farthest laterally from slot location?
Yes
No
2608
Plan 1 is plan to be deeper (Plan A)
2610
Plan 2 is plan to be shallower (Plan B)
2612
Plan 2 is plan to be deeper (Plan A)
2614
Plan 1 is plan to be shallowr (Plan B)
Yes
More room to move nudge on either plan?
No
Return Failed to Step 2578
2616b
2616
Yes
2618
Move Plan A nudge depth half way to max nudge depth
Move Plan B nudge depth half way to min nudge depth
2620
2632
2622
Plans too close?
No
Return Succeeded to Step 2578
No
Are Plans too close?
2622b
Yes
2624
Compute azimuth difference between nudges
Move plan B nudge azimuth 1 degree away from plan A
i=0;i<3;i+1
2626
2630
Plans not too close?
Yes
Return Succeeded to Step 2578
2628
2628b
No

SYSTEMS AND METHODS FOR IMPROVED POSITIONING OF PADS

CROSS-REFERENCE TO RELATED APPLICATIONS

This application is a continuation of U.S. patent application Ser. No. 12/369,606 filed on Feb. 11, 2009, currently issued as U.S. Pat. No. 8,073,664 on Dec. 6, 2011, and claims the priority of U.S. Patent Application Ser. No. 61/027,694, filed on Feb. 11, 2008, which is incorporated herein by reference.

STATEMENT REGARDING FEDERALLY SPONSORED RESEARCH

Not applicable.

FIELD OF THE INVENTION

The present invention generally relates to systems and methods for positioning pads. More particularly, the present invention relates to the automated positioning of pads, sometimes referred to as platforms, and orienting slot templates for the pads. The present invention also relates to the automated adjustment of well path plans from a pad to selected well targets.

BACKGROUND OF THE INVENTION

Historically, the positioning of onshore pads has involved a number of issues related to proper pad positioning. In the oil and gas industry, for example, proper positioning of onshore pads for oil and gas rigs requires consideration of surface topography and slope constraints. In addition, the orientation of slot templates, which are located on each pad and are used to organize the location of each well on the pad, must also be considered. Finally, each well path—sometimes referred to as a plan from the pad to a selected well target—must be considered.

For example, large scale onshore field development planning creates unique problems for oil and gas companies. Unconventional and tight gas pays generally contain large numbers of subsurface targets to exploit. A direct result is a large number of wells that must be planned and drilled from surface pads or sites, which are analogous to offshore platforms. In order to adequately plan for this, several objectives must be accomplished. The number and location of surface pads or sites required to complete the development is required, for example, which depends on the number of wells that will be drilled from each pad, the engineering constraints placed on the individual well paths (i.e. maximum reach, dogleg severity, inclination angle, etc.), the location of the subsurface targets and the topographic constraints—such as elevation and grade. Slot template geometry and the orientation for each pad also need to be defined. Slot templates generally involve very tight spacing between slots, which requires an understanding of the well paths that will originate from each slot so that collision risk between wells is minimized. And, well paths need to be assigned to the correct slot. Individual well paths may also need to be altered in order to minimize interference with other wells planned or drilled from the same, or different, slot template(s).

The main issue with each objective is the planning cycle time. Planning for 50 pads with 20 wells per pad (i.e. 1000 total wells) can be a tedious, iterative-process subject to trial and error. For instance, a pad is visually positioned over a grouping of targets by visualizing a topographic map. Elevation is eyeballed, estimated and used as the starting reference point elevation. Well locations for the proposed slot template geometry must then be calculated and each individual well path must be assigned to a slot and designed. During the well path design process, it may be determined that the site positioning just did not work due to well path constraints and the process is repeated over and over again until it is successful. At this time, each individual well path must be altered to minimize collision risks with other wells that will be drilled from the same or other sites. The aforementioned process would realistically take anywhere from 3-5 days for just one pad. Multiply this process by 50 and the length of time required becomes significant.

One method for determining platform placement that is most often used may be thought of as a "move and calculate footage" based method. In this method, a series of wellpath plans are created manually, one at a time, using dogleg, inclination, reach, and anti-collision as the planning criteria for the platform location. The cumulative measured depth traversed by the many wellpaths is summed and used as a measurement of the base case location.

Once the wellpaths are created, the well planner then moves the surface location of the base case platform a fixed distance, usually in one of the four compass directions, and recalculates the cumulative measured depth. If the cumulative measured depth decreases from the base case measurement, the well planner knows that there is a potential location which is "better" than the base case location. The planner then goes through many iterations moving the platform location by different distances and to different compass directions from the base case location looking for the best location based on the total calculated footage of the wellpaths that will be required to drill from the wells to the platform location.

The above-mentioned methodology has a number of drawbacks. For example, it is tedious, time consuming, and requires fixing the number of plans and targets to be reached. Using this methodology, it is not unusual for well planners to spend three to four weeks on just one project.

Other automated methods for platform placement use Monte-Carlo or random number based statistical calculations for platform placement and take into account producers vs. injectors, cost of processing facilities, and existing pipelines. They, however, do not take into account target weighting, which is addressed in U.S. Pat. No. 7,200,540. The '540 patent, which is assigned to Landmark Graphics Corporation and is incorporated herein by reference, further addresses the need for a method that varies the number and locations of platforms and optimizes the targets used if the resultant platform set provides a plan that: a) reaches more targets; b) reaches the same number of targets with less distance; or c) reaches the same number of targets, but includes targets with higher weighting values based on the reservoir parameters. In short, the '540 patent describes systems that implement methods for selecting a set of platform locations, determining additional platform locations, and determining an optimum location for each platform location in the set of platform locations.

The '540 patent, however, does not address the need to utilize surface topography for automatically extracting pad elevations after positioning when working on large scale onshore field development planning, especially in mountainous regions. Additionally, the '540 patent does not address the ability to update existing pad elevations using a surface grid or the ability to restrict the placement of pads based on slope constraints.

There is also a need, which is not met by the prior art and which will reduce the risk of collision, to optimize slot template orientations by aligning them on strike with the surface elevation model or rotating them based on the planned trajectories. Due to the tight spacing of slot templates, there is also a need to optimally assign plans to the proper slots and to stagger kick-offs and nudge individual plans.

SUMMARY OF THE INVENTION

The present invention therefore, meets the above needs and overcomes one or more deficiencies in the prior art by providing systems and methods for orienting a slot template using incremental rotations and positioning a pad using incremental nudges.

In one embodiment, the present invention includes a computer implemented method for orientating a slot template, which comprises: i) computing an optimum slot assignment value for the slot template based on a predetermined number of slots, a predetermined number of plans, a trajectory for each plan and an initial angle using a computer processor; ii) rotating the slot template by a predetermined angle to a new angle; iii) computing another optimum slot assignment value for the slot template based on the predetermined number of slots, the predetermined number of plans, the trajectory for each plan and the new angle using the computer processor; iv) repeating the steps of i) rotating the slot template by a predetermined angle to a new angle; and ii) computing another optimum slot assignment value until the slot template is rotated to another predetermined angle; v) identifying each new angle when the another optimum slot assignment value is less than the optimum slot assignment value; and vi) orienting the slot template at the last identified new angle.

In another embodiment, the present invention includes a non-transitory program carrier device tangibly carrying computer executable instructions for orientating a slot template. The instructions are executable to implement: i). computing an optimum slot assignment value for the slot template based on a predetermined number of slots, a predetermined number of plans, a trajectory for each plan and an initial angle; ii) rotating the slot template by a predetermined angle to a new angle; iii) computing another optimum slot assignment value for the slot template based on the predetermined number of slots, the predetermined number of plans, the trajectory for each plan and the new angle; iv) repeating the steps of i) rotating the slot template by a predetermined angle to a new angle; and ii) computing another optimum slot assignment value until the slot template is rotated to another predetermined angle; v) identifying each new angle when the another optimum slot assignment value is less than the optimum slot assignment value; and vi) orienting the slot template at the last identified new angle.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings in which like elements are referenced with like reference numerals, and in which:

FIG. 9A is a flowchart illustrating one embodiment of an algorithm for performing step 122 in FIG. 1.

FIG. 10 is a flowchart illustrating one embodiment of the algorithm for step 920*b* in FIG. 9A.

FIG. 14 is a flowchart illustrating one embodiment of the algorithm for step 920*b* in FIG. 9A.

FIG. 19 is a flowchart illustrating one embodiment of the algorithm for step 1804 in FIG. 18.

FIG. 20 is a flowchart illustrating one embodiment of the algorithm for step 1806 in FIG. 18.

FIG. 21 is a flowchart illustrating one embodiment of the algorithm for step 1808 in FIG. 18.

FIG. 22 is a flowchart illustrating one embodiment of the algorithm for step 1810 in FIG. 18.

FIG. 24 is a flowchart illustrating one embodiment of the algorithm for step 926 in FIG. 9B.

FIG. 26 is a flowchart illustrating one embodiment of the algorithm for step 2578 in FIG. 25B.

DETAILED DESCRIPTION OF THE PREFERRED EMBODIMENTS

The subject matter of the preferred embodiments is described with specificity however, is not intended to limit the scope of the invention. The subject matter thus, might also be embodied in other ways to include different steps, or combinations of steps, similar to the ones described herein, in conjunction with other present or future technologies. Although the term "step" may be used herein to describe different elements of methods employed, the term should not be interpreted as implying any particular order among or between various steps herein disclosed unless otherwise expressly limited by the description to a particular order.

Workflow Description

Figure 1:
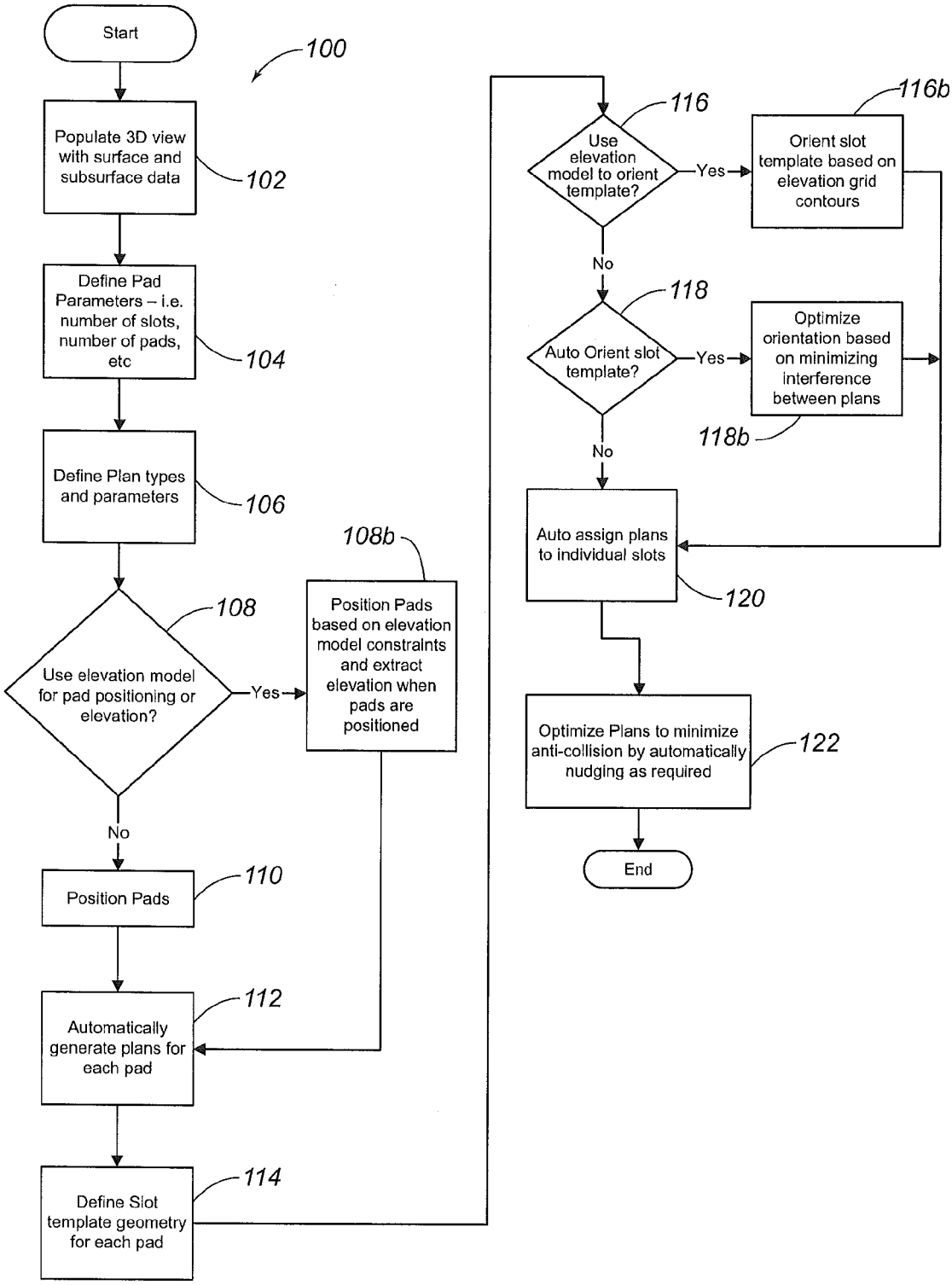
FIG. 1 is a flowchart illustrating one embodiment of a method for implementing the present invention.

Referring now to FIG. 1, a flowchart of one embodiment of a method for implementing the present invention is illustrated. The method 100 generally illustrates a workflow for optimizing pad placement and slot configuration, which may be used to reduce the planning time from 8-9 months to just a few days. While the description of the following embodiments refers to onshore pads for oil and gas operations, certain aspects of the present invention may also be applied to offshore pads for oil and gas operations—and other pads for use in other industries.

In step 102, a surface elevation model and subsurface data are loaded, which may be used to populate a 3D viewer. Of primary importance are the subsurface targets that will dictate surface pad positioning as well as well path trajectory design. The targets may be imported from an ASCII delimited text file or automatically generated according to U.S. Pat. No. 7,096,172, which is assigned to Landmark Graphics Corporation and is incorporated herein by reference.

In step 104, the pad parameters are defined, such as the number of slots and the number of wells.

In step 106, the well path types to be used (i.e. S-shaped, Slant, Horizontal, etc.) are defined along with their priority. Trajectory constraints are also defined for each well path type selected, which specify if each trajectory will penetrate single targets, multiple targets or a combination of both. The number of slots (wells) per pad should also be defined at this step.

In step 108, the method 100 determines if the surface elevation model is to be used for pad positioning. If the surface elevation model is to be used for pad positioning, go to step 108*b*. If the surface elevation model is not to be used for pad positioning, then go to step 110.

In step 108*b*, pads (preexisting or new) are positioned based on the surface elevation model in several ways. The surface elevation model may be used in both the original positioning of the pad and in the final setting of the orientation of the pad. Limits on the elevation and slope (or grade) can impact whether particular locations can or cannot be used. As an example, the user may restrict pad positioning to locations where the slope is less than 15 degrees or to elevations greater than 7000 feet because gathering stations are below this elevation (i.e. due to liquid handling considerations). By extracting the elevations when the pads are positioned, and assigning them to each respective pad (plus a user specified air gap), the user can create Rotary Kelly Bushing elevations for the proposed wells, which are generally used as the starting reference points for well paths. This is a modification to the algorithms utilized in the '540 patent. There is also a more subtle way in which the extracted elevations can influence the pad positioning. When a particular site is being evaluated, its geometric positioning, relative to the targets that are being considered for use are compared to the engineering constraints placed upon the types of wells being considered. So, for a particular target, a location at one elevation might be capable of hitting that target with a particular well design at another location that is the same distance laterally, but at a lower elevation, would not. It also provides the orientation of the elevation. This information is utilized to orient the pads on strike (i.e. parallel to) with the contours.

In step 110, pads are positioned. Existing pads may be used with available slots. In this case the user would have to allocate slots as "taken" by existing wells and the number of trajectories designed from these pads will be limited to the number of available slots. If any additional pads are required to hit remaining targets they will be automatically generated and positioned according to the '540 patent. If no pads exist, the new pads will be positioned automatically according to the '540 patent with the number of plans per pad dictated by the planning constraints along with the number of slots per pad. A case may exist where the only pads to be used currently exist. In this case, no new pads will be generated and the number of well paths generated will be limited to a maximum being the number of available slots on each pad.

In step 112, plans for each pad are automatically generated. Once all "new" pads are positioned by step 108*b*, or in the alternative step 110, the surface elevation is extracted from the surface elevation grid and the air gap is applied (if applicable) to generate the starting reference point elevation—which is applied to all plans that are automatically generated in step 112. For "existing" pads, the elevations can be updated based on the elevation model.

In step 114, the slot template geometry for each pad is defined. This would include the number of rows and columns, the spacing and the orientation.

In step 116, the method 100 determines whether to use the elevation model to orient the templates. If the template geometry is elongated and the terrain is fairly steep, the user might wish to optimize the orientation of the template such that the pad was as flat as possible—i.e. oriented along strike. When this occurs, the elevation model will be used to orient the slot template based on elevation grid contours. If the elevation model should be used, then the method 100 proceeds to step 116*b*. If the elevation model should not be used, then the method 100 proceeds to step 118.

Figure 2:
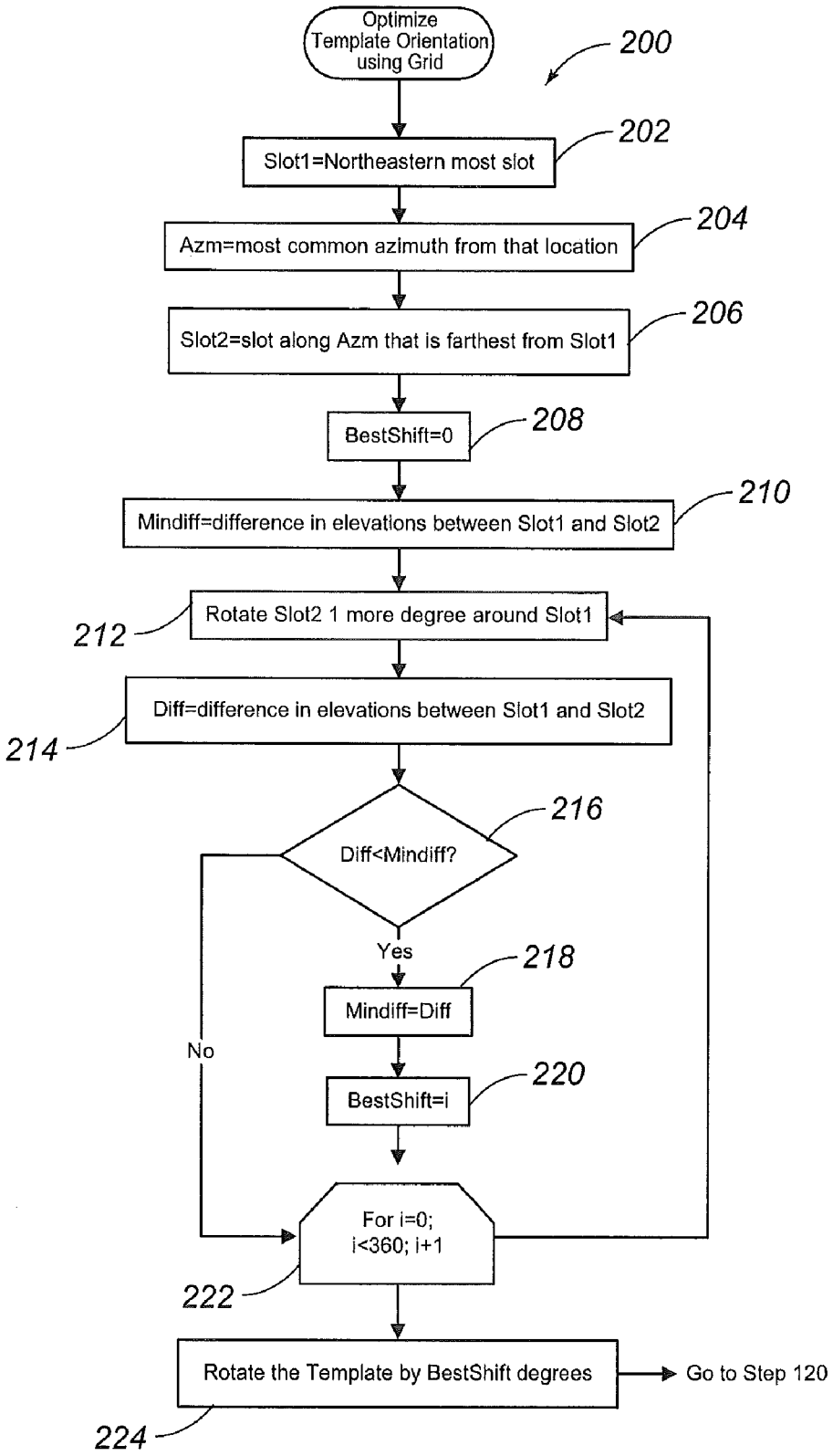
FIG. 2 is a flowchart illustrating one embodiment of an algorithm for performing step 116*b* in FIG. 1.

In step 116*b*, the slot template is oriented based on elevation grid contours according to the method 200 illustrated in FIG. 2.

In step 118, the method 100 determines whether to auto-orient each slot template. The user might prefer to orient the slot template such that there are the fewest problems caused by plans that cross each other or interfere with other slots. In this case, the slot template is automatically oriented based on minimizing interference between plans. If each slot template should be auto-oriented, then the method 100 proceeds to step 118*b*. If each slot template should not be auto-oriented, then the method 100 proceeds to step 120.

Figure 3:
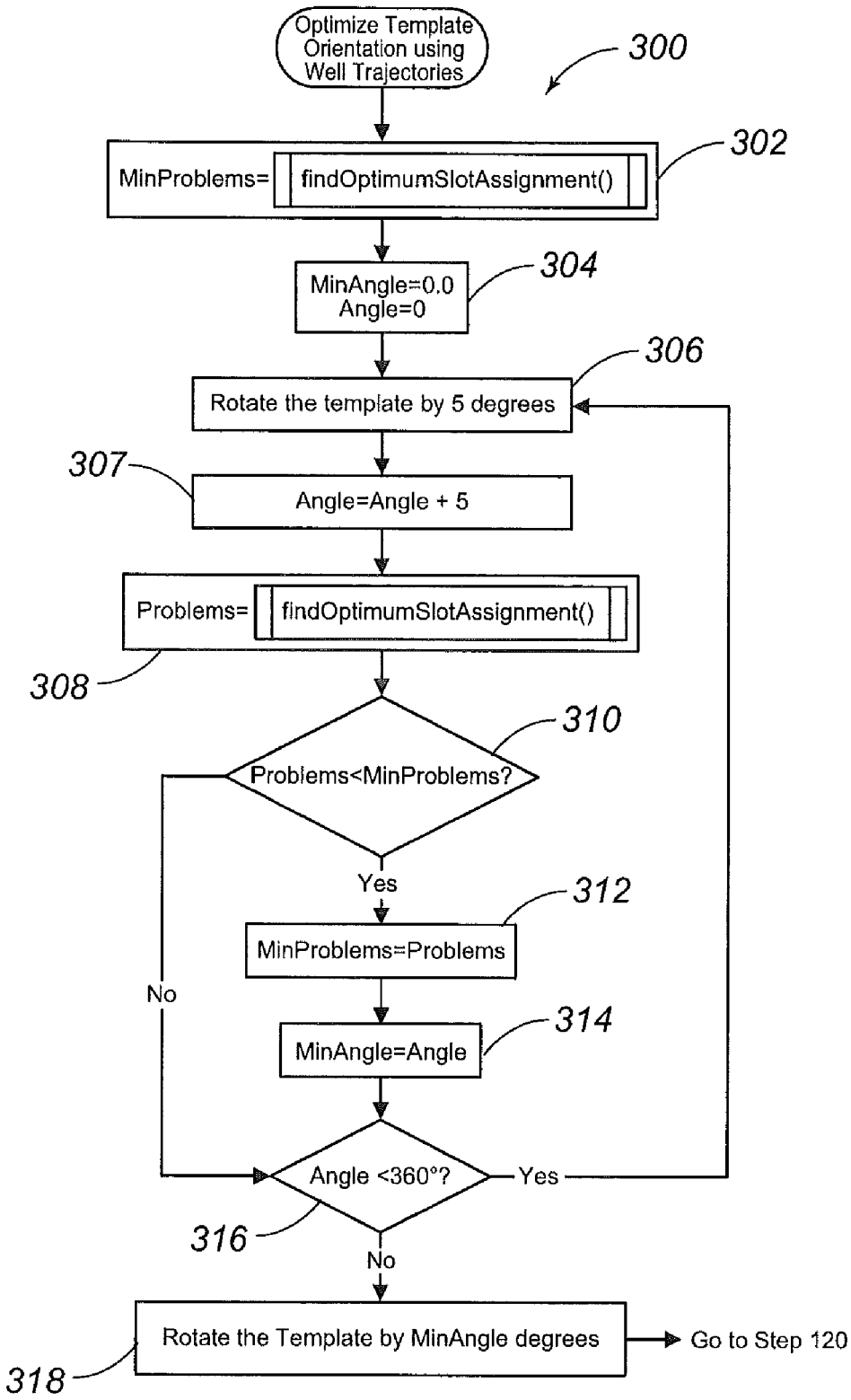
FIG. 3 is a flowchart illustrating one embodiment of an algorithm for performing step 118*b* in FIG. 1.

In step 118*b*, each slot template orientation is optimized based on minimizing interference between plans according to the method 300 illustrated in FIG. 3.

In step 120, plans are automatically assigned to the appropriate slots based on their trajectory to minimize the risk of collision.

Figure 9B:
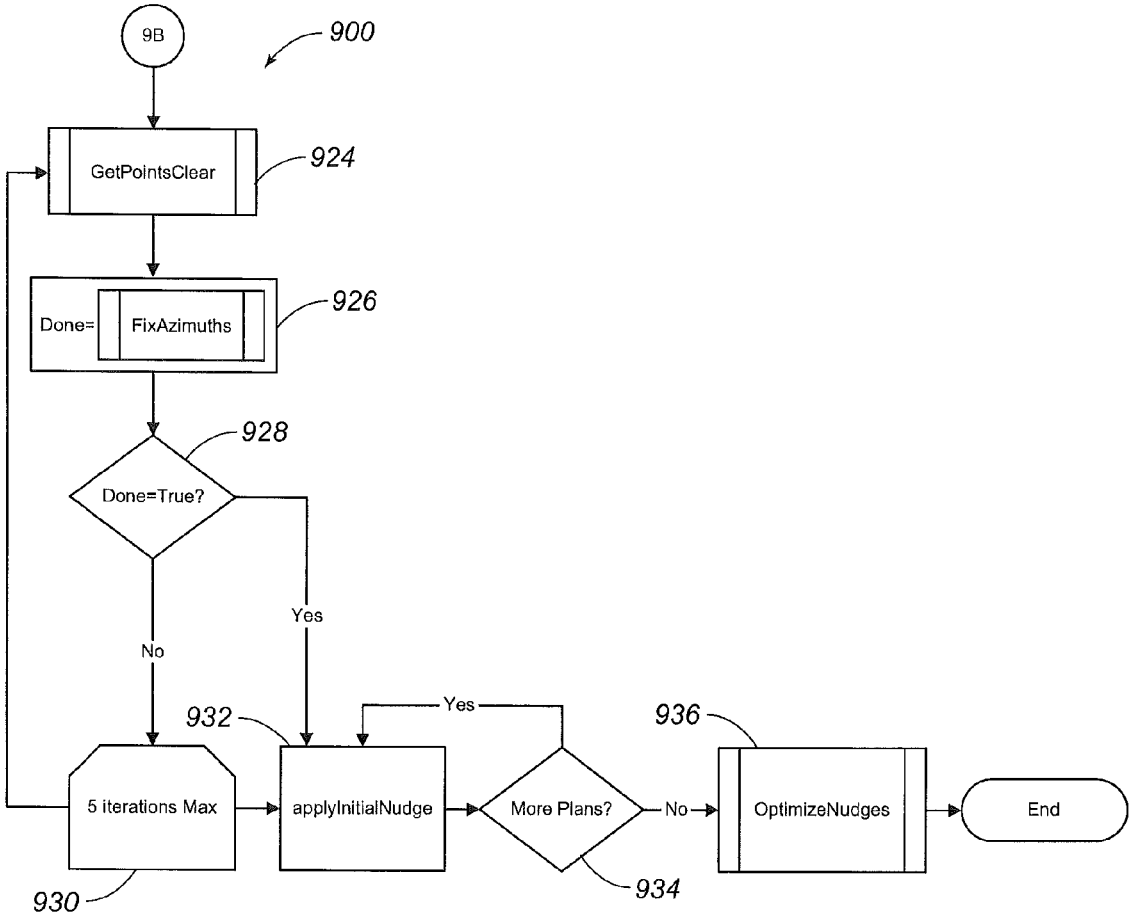
FIG. 9B is a continuation of the flowchart illustrated in FIG. 9A.

In step 122, the current status of the pad with respect to slot allocation is evaluated as it pertains to anti-collision issues. If all planned kick-offs work, then there is no need to optimize or nudge the plans. If there are plans that do not meet the required separation criteria (i.e. ft separation/1000 feet of measured depth), it may be necessary to optimize the kick-offs to achieve the required separation as illustrated, for example, in FIG. 10. If the minimum separation cannot be achieved by optimizing kick-offs, then nudges may be required as illustrated in FIG. 9A and FIG. 9B. A nudging algorithm may thus, be applied to alter individual well paths either by staggering kick-off points, adjusting azimuth and inclination or combinations of both based on user defined criteria/constraints as illustrated, for example, in FIG. 25A and FIG. 25B.

Slot Template Orientation and Optimization

Referring now to FIGS. 2-8, there are two primary embodiments of the algorithms described in reference to FIG. 1 for optimizing the orientation of a slot template in steps 116*b* and 118*b*.

In FIG. 2, for example, the method 200 generally illustrates one embodiment of an algorithm for performing step 116*b* in FIG. 1—that is, for optimizing the orientation of the slot template based on elevation grid contours. A gridded model of either the topography of the surface or the seafloor may be used as illustrated in FIG. 2.

In step 202, the Northeastern most slot is found (Slot 1). Two slots that are representative of the two ends of the long axis of the template must be determined. The most Northern slot and the most Eastern slot among them is determined to be the most Northeastern slot.

In step 204, the most common azimuth from the location of Slot 1 is found (Azm). A histogram of the azimuths of the other slots is then built from this slot.

In step 206, the slot along Azm which is the farthest away from Slot 1 is found (Slot 2).

In step 208, BestShift is set equal to zero. BestShift is used to hold the amount of rotating needed to arrive at the optimum angle used to optimize the slot template.

In step 210, the distance in elevations between Slot 1 and Slot 2 is found (MinDiff).

In step 212, the value of Slot 2 is changed by rotating Slot 2 around Slot 1 by one degree in one degree increments from 0 to 359 degrees.

In step 214, the difference between Slot 1 and the new Slot 2 is computed using techniques well known in the art and the result (Diff) is stored. At each angle formed by the new Slot 2, the grid is checked by measuring the differences in elevation between the two slots in step 214. The azimuth where the absolute difference in elevation is the least is the optimum angle.

In step 216, Diff and Mindiff are compared. If Mindiff is less than Diff in step 216, go to step 222. If Mindiff is greater than Diff, go to step 218.

In step 218, Mindiff is set equal to Diff.

In step 220, BestShift is set equal to i.

In step 222, variable i is initialized to 0. If i is less than 360, increase i by 5 and go to step 212. If i is not less than 360, then go to step 224. During this process, BestShift is constantly updated to find the optimum angle needed to rotate the slot template.

In step 224, the template is rotated to the optimum angle BestShift. The method 200 then returns to step 120.

In FIG. 3, the method 300 generally illustrates one embodiment of an algorithm for performing step 118*b* in FIG. 1—that is, for optimizing the orientation of the slot template based on minimizing the interference between plans (well trajectories). Orienting based upon minimizing the problems associated with each possible azimuth is considerably more complex because in order to do it, you must have an optimal way to determine which plan to assign to what slot because the efficacy of a particular orientation is directly related to how the plans are assigned to slots in that orientation. So if that assignment is not made in an optimal way, then it is unlikely that the angle, which is determined to be the best, will indeed be optimal. A second requirement of slot assignment is having a means to measure the number and magnitude of the problems associated with a particular orientation and slot assignment combination. Since the method for assigning slots is also dependent upon a measuring technique, the slot assignment simply returns the quantification of the problems associated with that slot assignment and addresses both at the same time. The approach to finding an optimum angle is therefore, similar to the grid-based algorithm illustrated in FIG. 2. However, since it requires actually performing the template rotation and slot assignment at each measurement point, a check is performed at every 5 degrees instead of every degree.

Figure 4:
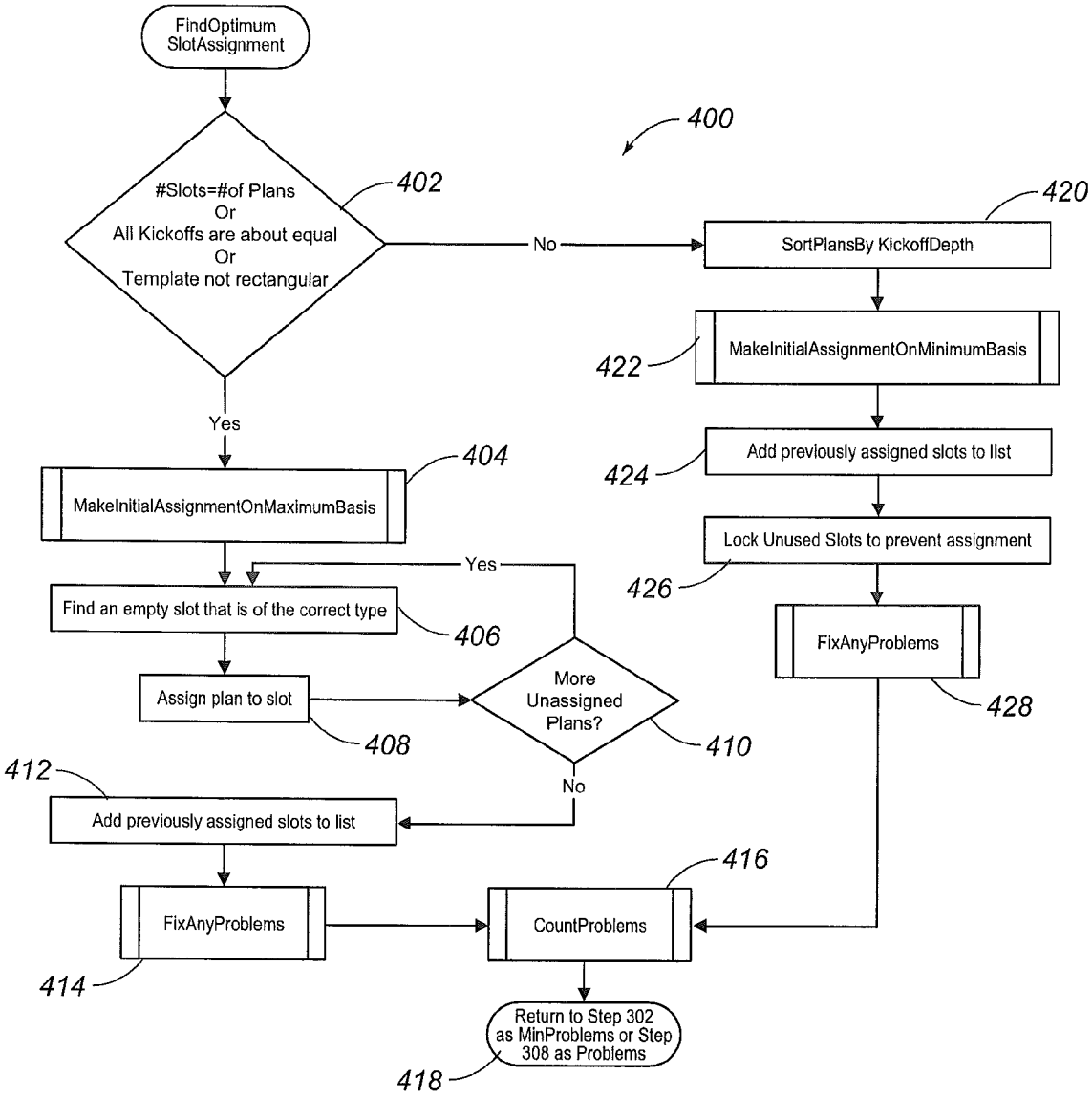
FIG. 4 is a flowchart illustrating one embodiment of the algorithm for steps 302 and 308 in FIG. 3.

In step 302, MinProblems is set equal to "findOptimumSlotAssignment( )". The algorithm "findOptimumSlotAssignment( )" is illustrated in FIG. 4.

In step 304, MinAngle is set equal to 0.0 and Angle is set equal to 0.

In step 306, the template is rotated in 5 degree increments.

In step 307, Angle is set equal to Angle plus 5 degrees.

In step 308, Problems is set equal to "findOptimumSlotAssignment( )".

In step 310, the method 300 determines if Problems is less than MinProblems. If Problems is less than MinProblems, then go to step 312. If Problems is not less than MinProblems, then go to step 316.

In step 312, MinProblems is set equal to Problems.

In step 314, MinAngle is set equal to Angle.

In step 316, the method 300 determines if the Angle is less than 360 degrees. If the Angle is less than 360 degrees, then go to step 306. If the Angle is greater than or equal to 360 degrees, then go to step 318. During this process, MinAngle is constantly updated to find the optimum angle needed to rotate the slot template.

In step 318, the template is rotated by MinAngle degrees. The method 300 then returns to step 120.

In FIG. 4, the method 400 generally illustrates one embodiment of the "FindOptimumSlotAssignment" algorithm for steps 302 and 308 in FIG. 3.

In step 402, the method 400 determines if the number of slots equals the number of plans, or if all kick-offs are about equal, or if the template is not rectangular. If the number of slots equals the number of plans, or if all kick-offs are about equal, or if the template is not rectangular, then go to step 404. If the number of slots does not equal the number of plans, or if all kick-offs are not about equal, or if the template is rectangular, then go to step 420.

In step 404, the "MakeInitialAssignmentOnMaximumBasis" algorithm is executed. The algorithm is intended to put each plan into the best possible slot for that plan. To do that, it goes through the list of plans and, for each one, it finds the best slot based upon being the nearest to the initial target in that plan and being the closest in orientation from the center of the pad to the initial target. Step 404 is further discussed in reference to FIGS. 6A-6B.

In step 406, the plan is added to a list of possibilities for that slot instead of assigning the plan directly to the slot. Once this has been done for each plan, it finds the slot with the most plans on its list. It orders the plans by kick-off depth, then, from the bottom of the list (deepest) up, it tries to find the best possible empty slot (one with an empty list) that will work for that plan.

In step 408, the plan is moved to the correct slot found in step 406.

In step 410, the method 400 determines if there are more unassigned plans. If there are more unassigned plans, then the method 400 proceeds to steps 406 and 408, which are repeated until all slots with plans in their lists are addressed. If there are no more assigned plans, then the method 400 proceeds to step 412.

In step 412, any previously assigned slots are added to the list for existing wells. Since the presence of existing wells would mean it was too late to re-orient the template, this would never be the case in the optimization workflow, but is useful when planning new wells from existing sites.

In step 414, the "FixAnyProblems" algorithm is executed. This algorithm is a sequence of repeated attempts to see if problems can be eliminated by swapping slot assignments. It looks at each combination of slots, decides whether they can be swapped or not, then if they can, swaps the plans in them and evaluates the results. If the results are fewer problems, the swap is considered successful. Otherwise, the plans are swapped back. This continues for 10 iterations or until a full pass is made with no successful swaps. The criteria for whether two slots can be swapped or not is if at least one of them has a plan, neither is locked, neither has an existing well and each is a valid slot type for the other's plan (some slots are reserved for specific well types). Step 414 is further discussed in reference to FIG. 7.

In step 416, the "CountProblems" algorithm is executed. This algorithm is discussed in reference to FIG. 8.

In step 418, the method 400 returns to step 302 as MinProblems or step 308 as Problems.

In step 420, the algorithm begins by sorting the plans by decreasing kick-off depth. This algorithm is designed to put the plans with the deepest kick-offs to the center of the template and leave any empty slots on the outside. It is primarily used when there are enough rows and columns for there to be an inside and an outside (>2×2) and there is some variation in the kick-off depths and there are some empty slots.

In step 422, the initial assignments are made by assigning each plan to the slot which has the lowest cost. Step 422 is further discussed in reference to FIG. 5.

In step 424, any previously assigned slots are added to the list for existing wells. Since the presence of existing wells would mean it was too late to re-orient the template, this would never be the case in the optimization workflow, but is useful when planning new wells from existing sites.

In step 426, unused slots are locked so that they will not have plans assigned to them in step 428.

In step 428, the "FixAnyProblems" algorithm is executed. This algorithm is a sequence of repeated attempts to see if problems can be eliminated by swapping slot assignments. It looks at each combination of slots, decides whether they can be swapped or not, then if they can, swaps the plans in them and evaluates the results. If the results are fewer problems, the swap is considered successful. Otherwise, the plans are swapped back. This continues for 10 iterations or until a full pass is made with no successful swaps. The criteria for whether two slots can be swapped or not is if at least one of them has a plan, neither is locked, neither has an existing well and each is a valid slot type for the other's plan (some slots are reserved for specific well types). Step 428 is further discussed in reference to FIG. 7. In FIGS. 5-8, the flowcharts illustrate various embodiments of the algorithms for steps 404, 414, 416, 422, 428 in FIG. 4 and steps 702, 710 in FIG. 7.

Figure 5:
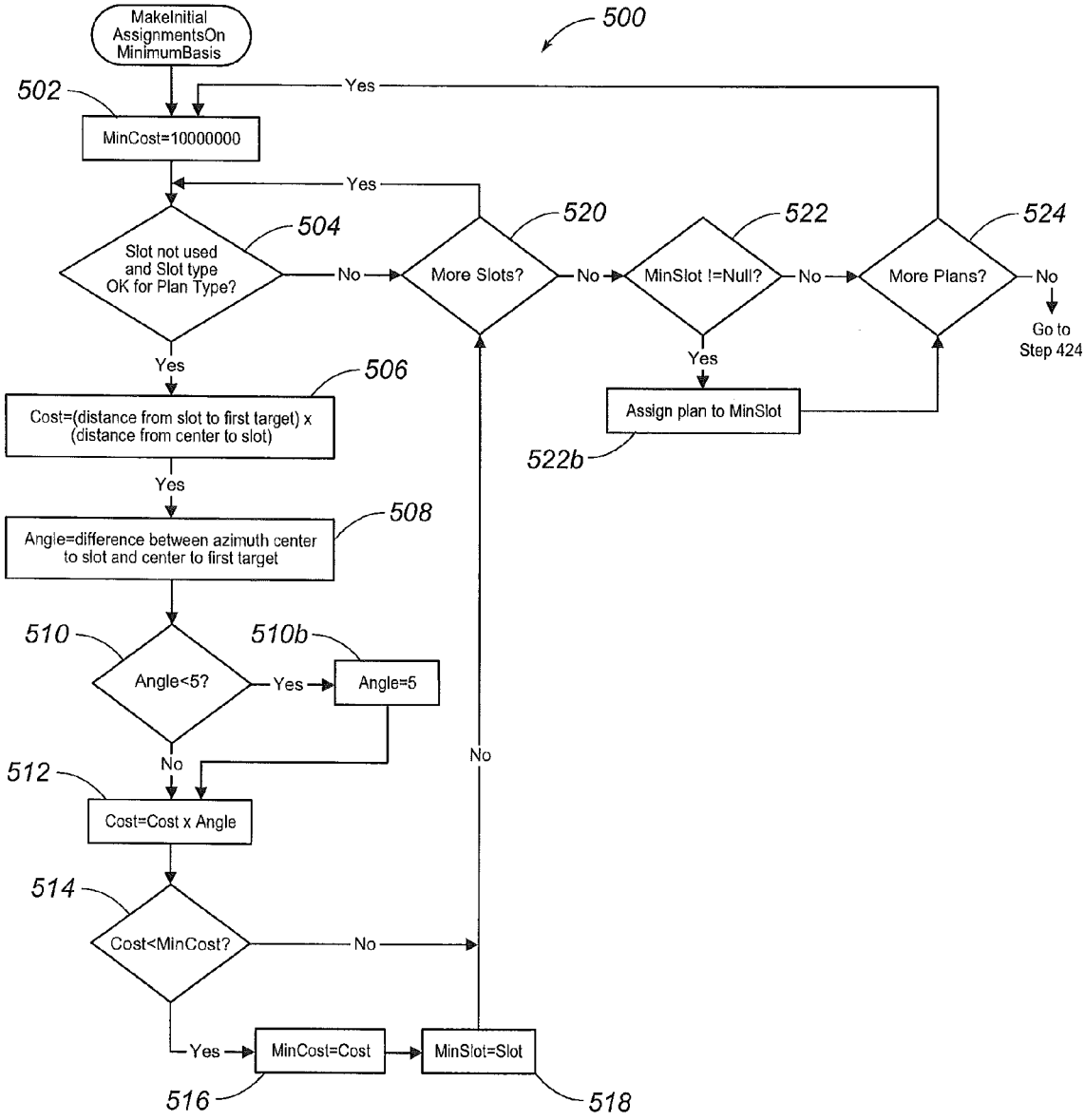
FIG. 5 is a flowchart illustrating one embodiment of the algorithm for step 422 in FIG. 4.

In FIG. 5, the method 500 generally illustrates one embodiment of the "MakeInitialAssignmentOnMinimumBasis" algorithm for step 422 in FIG. 4.

In step 502, MinCost is set equal to 10000000.

In step 504, the method 500 determines if the slot is not used and if the slot type is compatible with the plan type. If the slot is not used and is compatible with the plan type, then the method 500 continues to step 506. If the slot is used and is not compatible with the plan type, then the method 500 continues to step 520.

In step 506, Cost is defined as the distance from the slot to the target times the distance from the template center to the slot. Cost is multiplied times a minimum of 5 degrees or the difference between the angles from the center to the slot and the center to the first target.

In step 508, Angle is defined as the difference between the azimuth center to the slot and the center to the first target.

In step 510, the method 500 determines if Angle is less than 5. If Angle is less than 5, then the method 500 continues to step 510*b*. If Angle is not less than 5, then the method 500 continues to step 512. A minimum of 5 degrees is used to avoid zero divide issues and to keep differences smaller than 5 degrees from having an inappropriately large significance when used as a divisor. This should put the deepest kick-off plans closest to the center and the empty slots farthest from the center.

In step 510*b*, Angle is set equal to 5.

In step 512, Cost is set equal to Cost multiplied by Angle.

In step 514, the method 500 determines if Cost is less than MinCost. If Cost is less than MinCost, then the method 500 continues to step 516. If Cost is not less than MinCost, then the method 500 continues to step 504.

In step 516, MinCost is set equal to Cost.

In step 518, MinSlot is set equal to Slot.

In step 520, the method 500 determines if there are more slots. If there are more slots, then the method 500 continues to step 504. If there are no more slots, then the method 500 continues to step 522.

In step 522, the method 500 determines if MinSlot is not equal to Null. If MinSlot is not equal to Null, then the method 500 continues to step 522*b*. If MinSlot is equal Null, then the method 500 continues to step 524.

In step 522*b*, the plan is assigned to MinSlot.

In step 524, the method 500 determines if there are more plans to assign. If there are more plans to assign, then the method 500 continues to step 502. If there are no more plans to assign, then the method 500 returns to step 424.

Figure 6A:
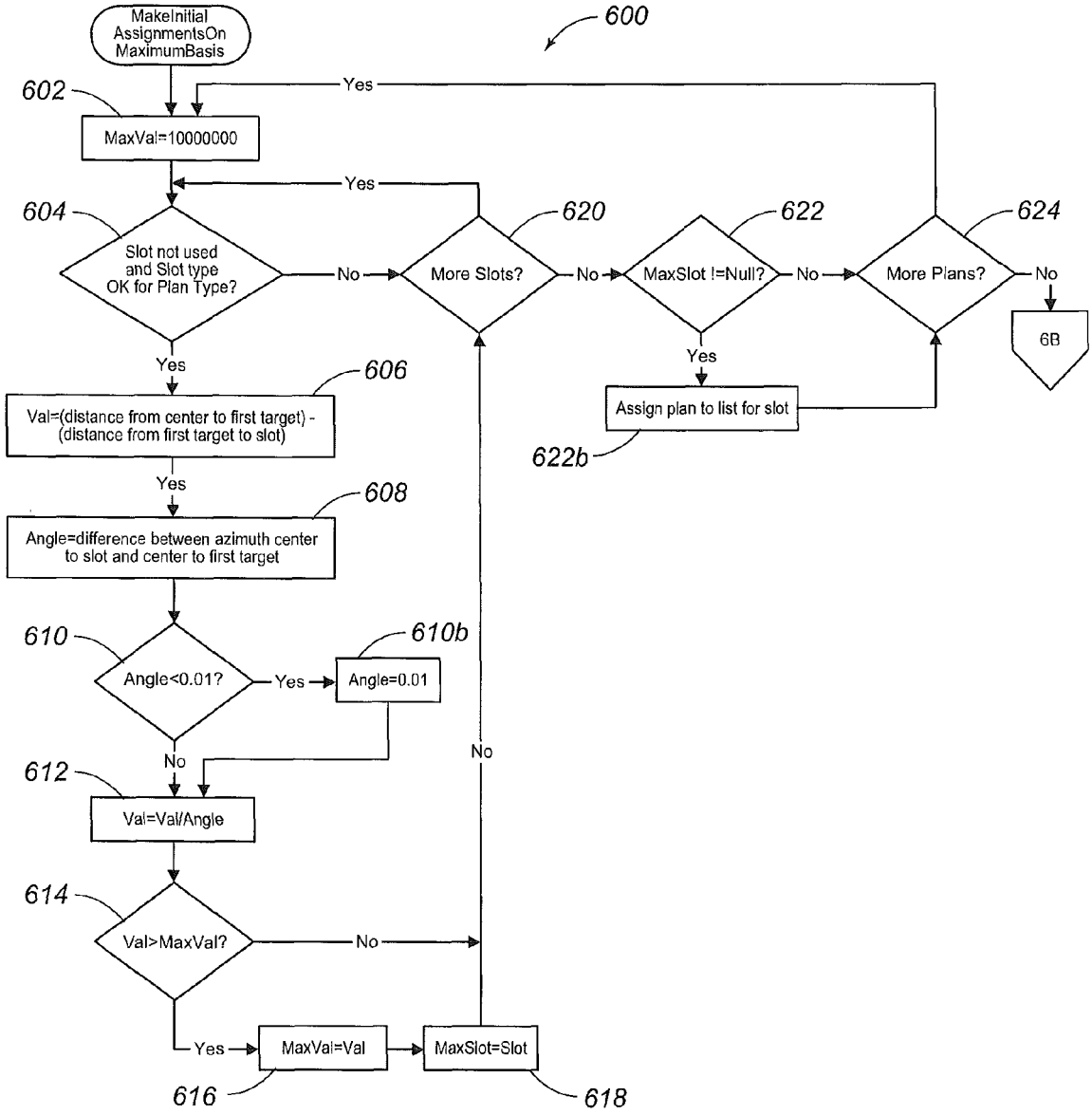
FIG. 6A is a flowchart illustrating one embodiment of the algorithm for step 404 in FIG. 4.

In FIG. 6A, the method 600 generally illustrates one embodiment of the "MakeInitialAssignmentsOnMaximumBasis" algorithm for step 404 in FIG. 4.

In step 602, MaxVal is set equal to −10000000.

In step 604, the method 600 determines if the slot is not used, and if the slot type is compatible with the plan type. If the slot is not used and is compatible with the plan type, then the method 600 continues to step 606. If the slot is used and is not compatible with the plan type, then the method 600 continues to step 620.

In step 606, the difference between the distance from the center to the first target and the distance from the target to the slot is found (Val).

In step 608, the difference between the azimuth center to the slot and the center to the first target is found (Angle).

In step 610, the method 600 determines if Angle is less than 0.01. If Angle is less than 0.01, then the method 600 continues to step 610*b*. If Angle is not less than 0.01, then the method 600 continues to step 612.

In step 610*b*, Angle is set equal to 5.

In step 612, Val is set equal to Val divided by Angle.

In step 614, the method 600 determines if Val is greater than MaxVal. If Val is greater than MaxVal, then the method 600 continues to step 616. If Val is not greater than MaxVal, then the method 600 continues to step 620.

In step 616, MaxVal is set equal to Val.

In step 618, MaxSlot is set equal to Slot.

In step 620, the method 600 determines if there are more slots. If there are more slots, then the method 600 continues to step 604. If there are no more slots, then the method 600 continues to step 622.

In step 622, the method 600 determines if MaxSlot is not equal to Null. If MaxSlot is not equal to Null, then the method 600 continues to step 622*b*. If MaxSlot is equal to Null, then the method 600 continues to step 624.

In step 622*b*, a plan is assigned to the list for slots.

In step 624, the method 600 determines if there are more plans to assign. If there are more plans to assign, then the method 600 continues to step 602. If there are no more plans, then the method 600 continues to FIG. 6B.

Figure 6B:
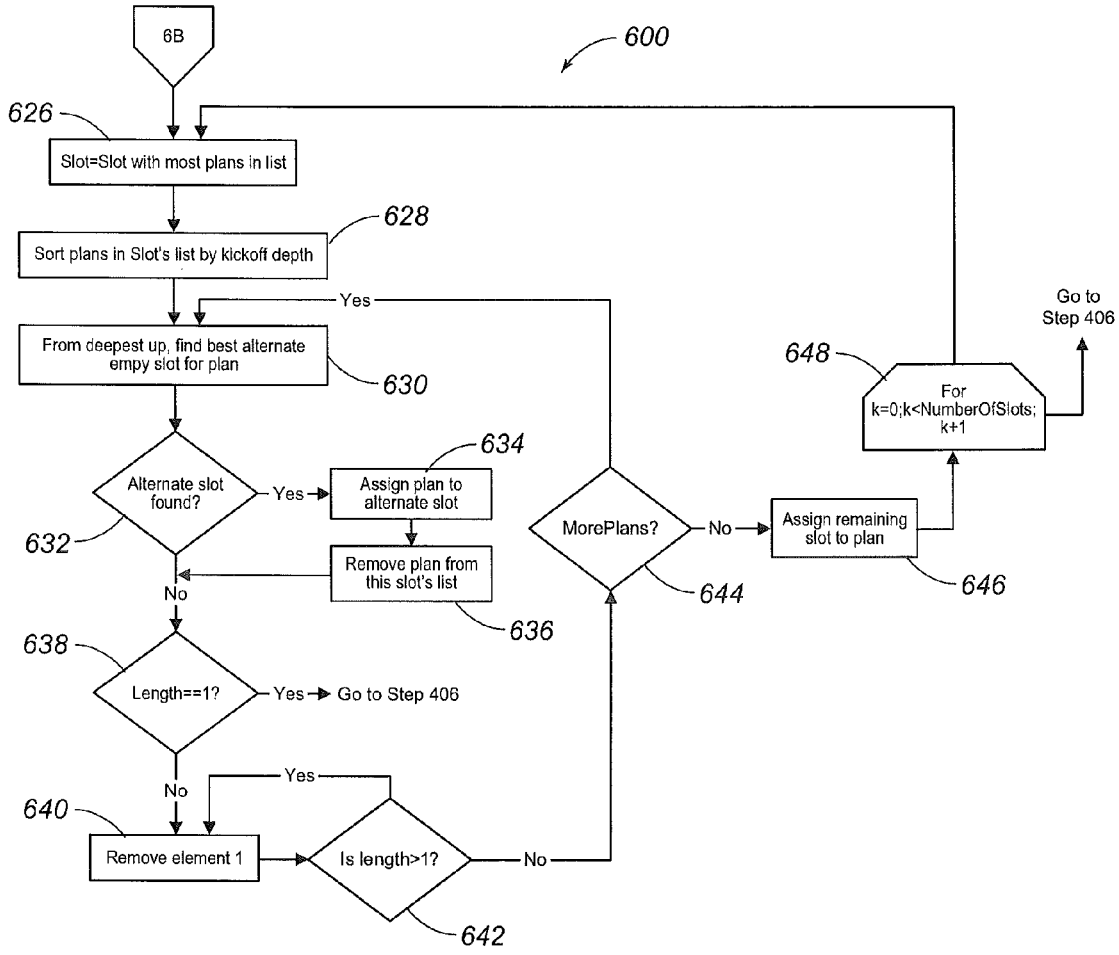
FIG. 6B is a continuation of the flowchart illustrated in FIG. 6A.

FIG. 6B continues method 600, which generally illustrates one embodiment of the "MakeInitialAssignmentsOnMaximumBasis" algorithm for step 404 in FIG. 4.

In step 626, Slot is set equal to the slot with the most plans in its list.

In step 628, the plans in Slot's list are sorted by kick-off depth.

In step 630, the best alternate empty slot for the plan is found by starting with the deepest plan and going through each plan.

In step 632, the method 600 determines if there was an alternate slot found. If there was an alternate slot found, then the method 600 continues to step 634. If there was no alternate slot found, then the method 600 continues to step 638.

In step 634, the plan is assigned to the alternate slot.

In step 636, the plan is removed from the selected slot's list.

In step 638, the method 600 determines if Length is equal to 1. Length is the number of plans in Slot's list. If Length is equal to 1, then the method 600 continues to step 406. If Length is not equal to 1, then the method 600 continues to step 640.

In step 640, element 1 is removed from the list of plans.

In step 642, the method 600 determines if Length is greater than 1. If length is greater than 1, then the method 600 continues to step 640. If Length is not greater than 1, then the method 600 continues to step 644.

In step 644, the method 600 determines if there are more plans. If there are more plans, then the method 600 continues to step 630. If there are no more plans, then the method 600 continues to step 646.

In step 646, the remaining slot is assigned to the plan.

In step 648, variable k is initialized to 0. If k is less than the number of slots, increase k by 1 and return to step 626. If k is greater than the number of slots, then the method 600 returns to step 406.

Figure 7:
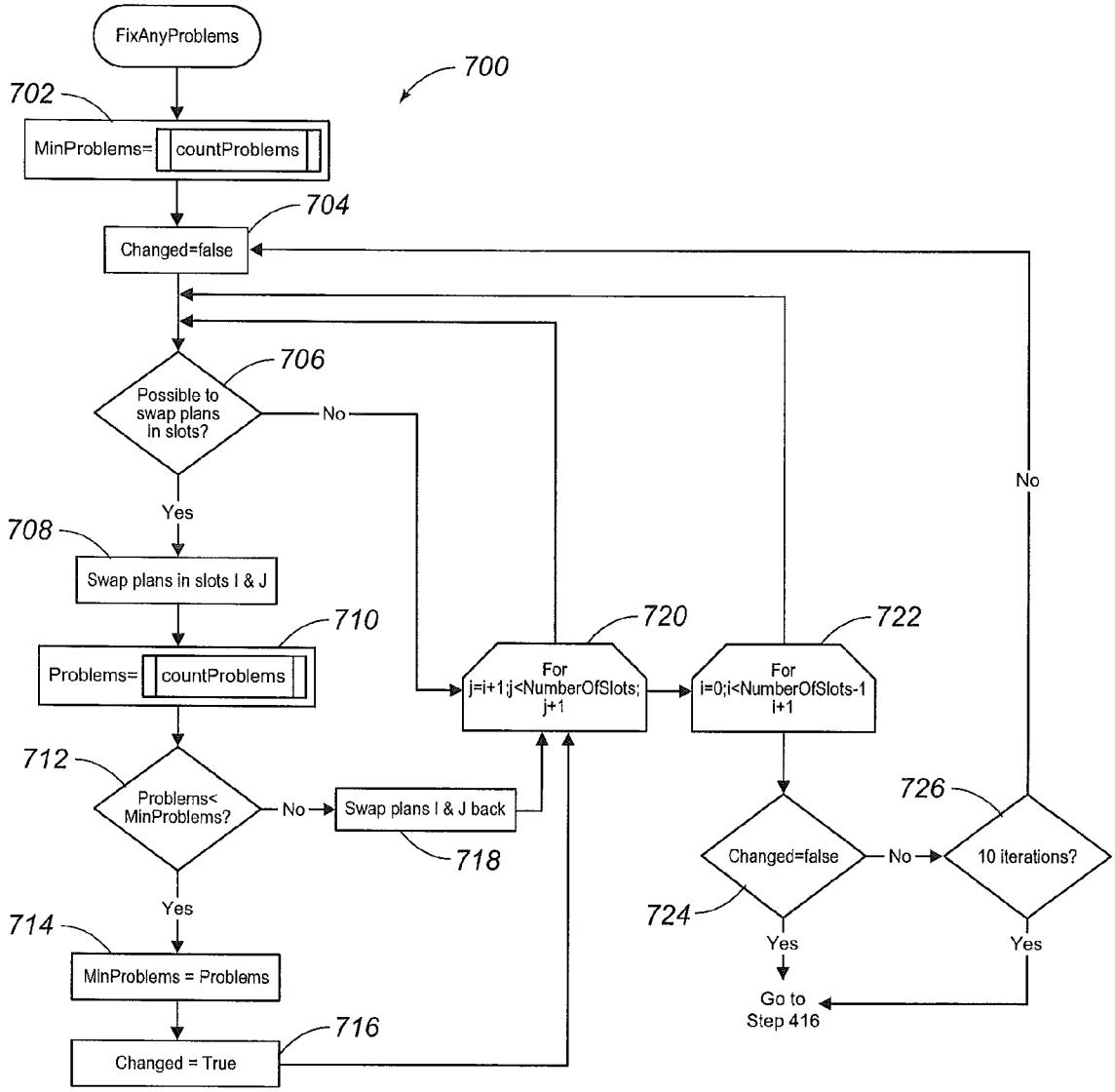
FIG. 7 is a flowchart illustrating one embodiment of the algorithm for steps 414 and 428 in FIG. 4.

In FIG. 7, the method 700 generally illustrates one embodiment of the "FixAnyProblems" algorithm for steps 414 and 418 in FIG. 4. "FixAnyProblems" is a sequence of repeated attempts to see if problems can be eliminated by swapping slot assignments. It looks at each combination of slots, decides if they can be swapped, and if they can, swaps the plans in them and evaluates the results. If the results are fewer problems, the swap is considered successful. Otherwise, the plans are swapped back. This continues for 10 iterations or until a full pass is made with no successful swaps. The criteria for whether two slots can be swapped is if at least one of them has a plan, neither is locked, neither has an existing well, and each is a valid slot type for the other's plan (some slots are reserved for specific well types). The valuation function used for determining if method 700 is helping or if a particular azimuth is better than another looks at each pair of slots and determines if either crosses the other. If they do and the user is planning to optimize kick-offs, only a penalty of 1 is assigned, since this will probably be fixed. If the user is not planning to optimize kick-offs, a penalty of 3 is assigned. Likewise, if either plan interferes with the other slot a penalty of either 5 or 3 is assigned—depending upon whether there is a plan assigned to that other slot or not. A penalty of 2 is also assigned for any plan which crosses the diagonal of the template or 10 if there is an empty slot that is reserved for a specific type.

Figure 8:
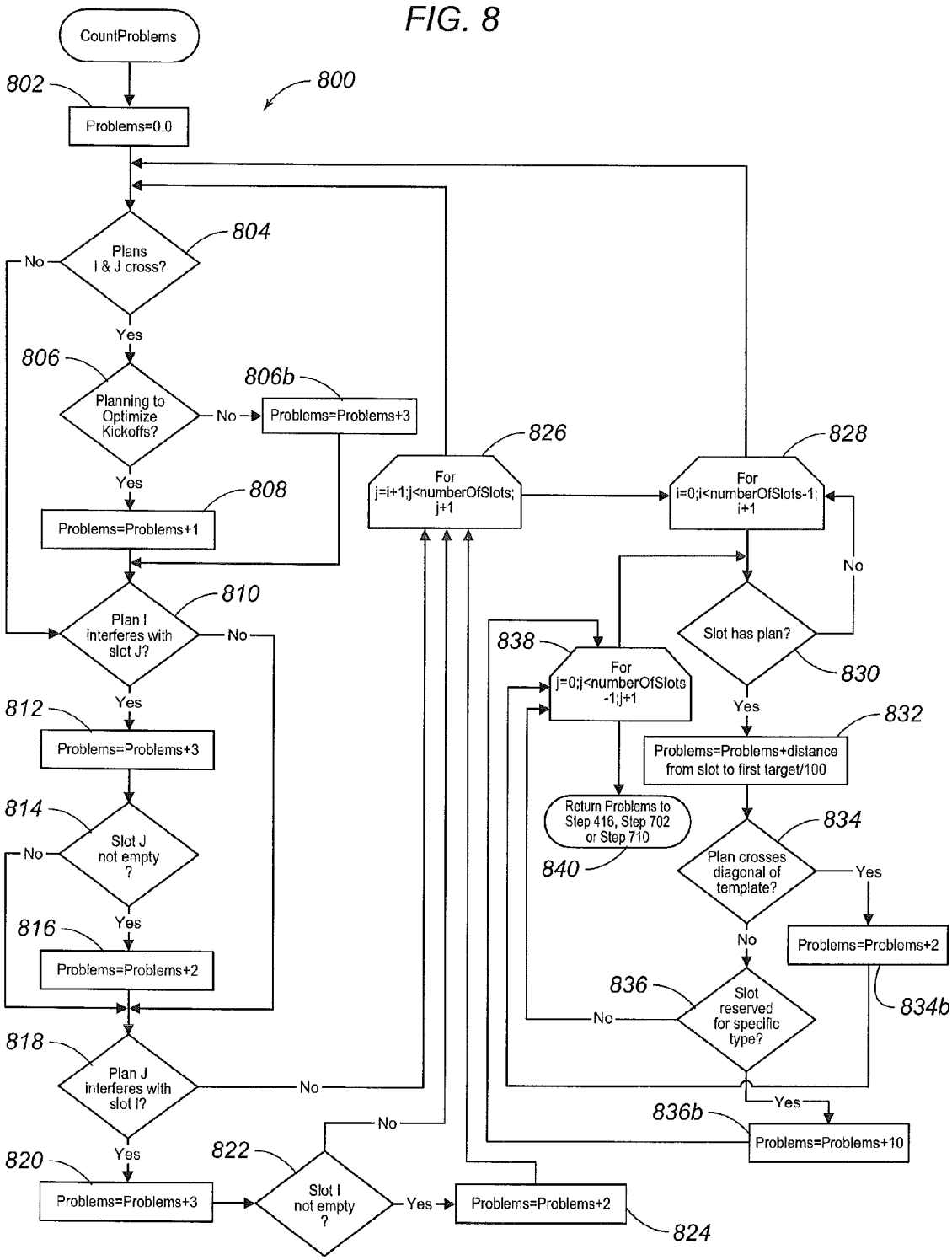
FIG. 8 is a flowchart illustrating one embodiment of the algorithm for step 416 in FIG. 4 and steps 702, 710 in FIG. 7.

In step 702, MinProblems is assigned a value determined by the "CountProblems" algorithm as discussed in reference to FIG. 8.

In step 704, Changed is set equal to false.

In step 706, the method 700 determines if it is possible to swap plans in slots. If it is not possible to swap plans in slots, then the method 700 continues to step 720. If it is possible to swap plans in slots, then the method 700 continues to step 708.

In step 708, plans in slots I and J are swapped.

In step 710, Problems is assigned a value determined by the "CountProblems" algorithm as discussed in reference to FIG. 8.

In step 712, the method 700 determines if Problems is less than MinProblems. If problems is less than MinProblems, then the method 700 continues to step 714. If Problems is not less than MinProblems, then the method 700 continues to step 718.

In step 714, MinProblems is set equal to Problems.

In step 716, Changed is set equal to True.

In step 718, plans I and J are swapped back to their original position.

In step 720, variable j is initialized to equal i+1. If j is less than the number of slots, then increase j by 1 and go to step 706. If j is greater than the number of slots, then go to step 722.

In step 722, variable i is initialized to equal 0. If i is less than the number of slots minus 1, then increase i by 1 and go to step 706. If i is greater than the number of slots minus 1, then go to step 724.

In step 724, Changed is set equal to false.

In step 726, the method 700 determines if method 700 has completed 10 iterations. If there have not been 10 iterations of method 700, then the method 700 returns to step 704. If there have been 10 iterations of method 700, then the method 700 returns to step 416.

In FIG. 8, the method 800 generally illustrates one embodiment of the "CountProblems" algorithm for steps 416, 702 and 710 in FIGS. 4 and 7. This algorithm computes a numerical value for various problems encountered in plan assignment.

In step 802, Problems is set equal to 0.0.

In step 804, the method 800 determines if plans I and J cross. If plans I and J do cross, then the method 800 continues to step 806. If plans I and J do not cross, then the method 800 continues to step 810.

In step 806, the method 800 determines if there is any kick-off optimization. If there is kick-off optimization, then the method 800 continues to step 808. If there is no kick-off optimization, then the method 800 continues to step 806*b*.

In step 806*b*, Problems is set equal to Problems plus 3.

In step 808, Problems is set equal to Problems plus 1.

In step 810, the method 800 determines if plan I interferes with slot J. If plan I interferes with slot J, then the method 800 continues to step 812. If plan I does not interfere with slot J, then the method 800 continues to step 818.

In step 812, Problems is set equal to Problems plus 3.

In step 814, the method 800 determines if slot J is not empty. If slot J is not empty, then the method 800 continues to step 816. If slot J is empty, then the method 800 continues to step 818.

In step 816, Problems is set equal to Problems plus 2.

In step 818, the method 800 determines if plan J interferes with slot I. If plan J interferes with slot I, then the method 800 continues to step 820. If plan J does not interfere with slot I, then the method 800 continues to step 826.

In step 820, Problems is set equal to Problems plus 3.

In step 822, the method 800 determines if slot I is not empty. If slot I is empty, then the method 800 continues to step 826. If slot I is not empty, then the method 800 continues to step 824.

In step 824, Problems is set equal to Problems plus 2.

In step 826, variable j is initialized to equal i+1. If j is less than the number of slots, then increase j by 1 and return to step 804. If j is greater than the number of slots, then go to step 828.

In step 828, variable i is initialized to equal 0. If i is less than the number of slots minus 1, then increase i by 1 and return to step 804. If i is greater than the number of slots minus 1, then go to step 830.

In step 830, the method 800 determines if the slot has a plan. If the slot does not have a plan, then the method 800 continues to step 828. If the slot has a plan, then the method 800 continues to step 832.

In step 832, Problems is set equal to Problems plus distance from the slot to the first target divided by 100.

In step 834, the method 800 determines if the plan crosses the diagonal of the template. If the plan crosses the diagonal of the template, then the method 800 continues to step 834*b*. If the plan does not cross the diagonal of the template, then the method 800 continues to step 836.

In step 834*b*, Problems is set equal to Problems plus 2.

In step 836, the method 800 determines if the slot is reserved for a specific type. If the slot has been reserved for a specific type, then the method 800 continues to step 836*b*. If the slot has not been reserved for s specific type, then the method 800 continues to step 838.

In step 836*b*, Problems is set equal to Problems plus 10.

In step 838, variable j is initialized to equal 0. If j is less than the number of slots minus 1, then increase j by 1 and return to step 830. If j is greater than the number of slots minus 1, then go to step 840.

In step 840, Problems is returned to step 416, 702, or 710.

Nudge and Kick-Off Optimization

Referring now to FIGS. 9-27, there are two primary embodiments of the algorithms described in reference to FIG. 1 for optimizing the plans to minimize the risk of collision in step 122.

In FIG. 9A, the method 900 generally illustrates one embodiment of optimizing plans to minimize anti-collision by automatically nudging as required for step 122 in FIG. 1. One algorithm (step 936) is used if nudges have been selected and the other algorithm (step 902*b*) is used when nudges are not selected.

In step 902, the method 900 determines whether to optimize with nudges. If optimizing without nudges is selected, then go to step 902*b*. If optimizing with nudges is selected, then go to step 904. For the purpose of designing nudging patterns, there are 4 significant geometries; a single line, a double line, a circle and a rectangular pattern containing 3 or more rows and 3 or more columns. For purposes of this algorithm, a double line and a circle will be considered the same geometry as they will be handled the same. Once the geometry has been established, the appropriate algorithm for determining the initial inclinations and azimuths will be executed. Then any issues with overlapping nudge locations, or plans that have been nudged too far from their intended azimuth, will be addressed. Once this has been straightened out, the nudges are applied to the plans, then the set of nudges are optimized.

In step 902*b*, the "OptimizeWithoutNudges" algorithm is executed. Step 902 is further discussed in reference to FIG. 10.

In step 904, the method 900 determines if the plans were previously nudged. If the plans were previously nudged, then the method 900 ends. If the plans were not previously nudged, then go to step 906.

In step 906, the method 900 determines if the plans have been assigned to slots. If the plans have been assigned to slots, then go to step 908. If the plans have not been assigned to slots, then the method 900 ends.

In step 908, the method 900 determines if the minimum kick-off is less than the water depth. If the minimum kick-off is less than the water depth, then the method 900 ends. If the minimum kick-off is not less than the water depth, then go to step 910.

In step 910, the method 900 determines if the maximum initial kick-off is less than the minimum initial kick-off. If the maximum initial kick-off is less than the minimum initial kick-off, then the method 900 ends. If the maximum initial kick-off is not less than the minimum initial kick-off, then go to step 912.

In step 912, the method 900 determines if the maximum final kick-off is less than the minimum final kick-off. If the maximum final kick-off is less than the minimum final kick-off, then the method 900 ends. If the maximum final kick-off is not less than the minimum final kick-off, then go to step 914.

In step 914, the method 900 determines if there is insufficient difference between initial and final kick-offs for nudge. If there is insufficient difference between initial and final kick-offs for nudge, then the method 900 ends. If there is not insufficient difference between initial and final kick-offs for nudge, then go to step 916.

In step 916, the "ComputeGeometry" algorithm is executed. This algorithm is further discussed in reference to FIG. 12.

In step 918, the method 900 determines if Geometry has been set equal to 1. If Geometry equals 1, then go to step 918*b*. If Geometry does not equal 1, then go to step 920.

In step 918*b*, the "computeNudgeParameters-ForEachPlanUsingSingleLineAlgorithm" algorithm is executed. This algorithm is further discussed in reference to FIG. 13. The method 900 continues to FIG. 9B.

In step 920, the method 900 determines if Geometry has been set equal to 2. If Geometry equals 2, then go to step 920*b*. If Geometry does not equal 2, then go to step 922.

In step 920*b*, the "computeNudgeParameters-ForEachPlanUsingDoubleLineOrCircleAlgorithm" algorithm is executed. This algorithm is further discussed in reference to FIG. 14. The method 900 continues to FIG. 9B.

In step 922, Geometry is set equal to 3.

In step 922*b*, the "computeNudgeParameters-ForEachPlanUsingRectangularAlgorithm" algorithm is executed. This algorithm is further discussed in reference to FIG. 15. The method 900 continues to FIG. 9B.

In FIG. 9B, the method 900 continues to generally illustrate one embodiment of optimizing plans to minimize anti-collision by automatically nudging as required for step 122 in FIG. 1.

In step 924, the "GetPointsClear" algorithm is executed. This algorithm is further discussed in reference to FIG. 18.

In step 926, Done is set equal to a value returned by the "FixAzimuths" algorithm. The algorithm is fairly simple. For each plan, check the difference between the slot to nudge azimuth and the nudge to target azimuth and, if the absolute value exceeds the allowable value, walk the nudge 1 degree at a time toward the target azimuth until it is within the allowable value. Since the nudge azimuth was selected based upon maintaining separation and this algorithm sacrifices separation to bring azimuths into user-specified limits, the two algorithms are combined thus—executing "GetPointsClear" (step 924), then "FixAzimuths" (step 926) until both of the azimuths are fixed and the proper amount of separation is achieved. The "FixAzimuths" algorithm is further discussed in reference to FIG. 24.

In step 928, the method 900 determines if Done is equal to True. If Done is equal to True, then go to step 932. If Done is not equal to True, then go to step 930.

In step 930, the method 900 returns to step 924, repeating this loop for a maximum of five iterations. A limit of 5 iterations is placed on this process to keep it from running indefinitely in the case where the goal of steps 924-26 cannot be met.

In step 932, the initial nudges are applied to their respective plans.

In step 934, the method 900 determines if there are more plans. If there are more plans, then go to step 932. If there are no more plans, then go to step 936.

In step 936, the "OptimizeNudges" algorithm is executed. The nudges applied in step 932 are optimized to reduce the risk of collision. During execution of "OptimizeNudges", there are a number of ways that the plans may be evaluated in order to insure that they do not get too close to one another and stay within engineering constraints. It is almost impossible to achieve both of these goals simultaneously, so the separation issues are usually resolved first and then the other goals are addressed without introducing separation issues. There are 3 types of separation issues. The first is where a plan is actively getting closer to another plan and gets within the minimum separation distance. The second is where the plans are already too close to one another before they have deviated from their original vertical trajectory. An example of the second type would be where two wells are being planned from slots that are 5 feet apart and the user has specified a minimum separation of 6 feet per 1000 feet and a minimum nudge depth of 500 feet. Once both plans are at 500 feet, there has been a total of 1000 feet drilled. So the plans need to be at least 6 feet apart but the slots are only 5 feet apart. Because the "OptimizeNudges" algorithm does not resolve this, it simply acknowledges it and does not let the optimization become adversely impacted by it. The third type of separation issue is where the plans are moving away from each other, but at a slower rate than the desired separation is increasing. This would probably happen in the example above if the user had set the minimum nudge depth to 400 feet. At 400 feet, the plans would need to be 4.8 feet apart since the slots are 5 feet apart. Unless they were building at more than 1 degree per 100 feet or at azimuths more than 90 degrees apart, they would probably not be more than 6 feet apart by the time they were at 500 feet measured depth (md) along the wellbore. The "OptimizeNudges" algorithm has more control over this type of separation than it does over the second type of separation, but less so than it does over the first type of separation. For this reason, the algorithm measures these types of separation problems at different times, first concentrating on keeping the plans from actively moving toward one another, then making sure that they diverge fast enough. Likewise, the algorithm looks at different lengths of the plans at different steps in the algorithm. The algorithm, by its use of nudges and altering kick-offs, cannot eliminate or reduce separation problems between well plans that occur beyond the first target, so it does not attempt to measure or account for them. Likewise, during the point where nudges are being optimized, it does not measure or account for any separation problems that occur beyond the final kick-off since altering the nudges will have no impact upon them. This algorithm is further discussed in reference to FIGS. 25A and 25B.

In FIG. 10, the method 1000 generally illustrates one embodiment of optimizing plans without nudging as required for step 902*b* in FIG. 9A. Method 1000 works much the same as parts of the "OptimizeNudges" algorithm illustrated in FIG. 25A and FIG. 25B. However, it is much simpler because, in addition to not having to figure out where to nudge to, it only has one depth to adjust—the kick-off depth. It uses the same general logic of sorting the plans in decreasing slot distance from the center and working with an initially empty set of previous plans. It too tries, for each plan, to find the point where there is no cost (separation or engineering), then if that fails it tries to find the minimum while the cost is still decreasing. Using those calculated md's as a starting point, it runs the "OptimizeKickoff" algorithm in step 1056 on each plan, passing through the entire set up to 10 times until it has a pass where no kick-offs are modified.

In step 1002, the "FindCenter" algorithm is executed. This algorithm is further discussed in reference to FIG. 27.

In step 1004, the plans are sorted by decreasing slot distance, measured from the Center.

In step 1006, the list of previous plans is cleared by creating an empty set.

In step 1008, Incr is set equal to the maximum kick-off minus the minimum kick-off, divided by the number of plans minus 1.

In step 1010, md is set equal to the minimum kick-off depth.

In step 1012, the amount assigned to kick-off a plan is set equal to md.

Figure 11:
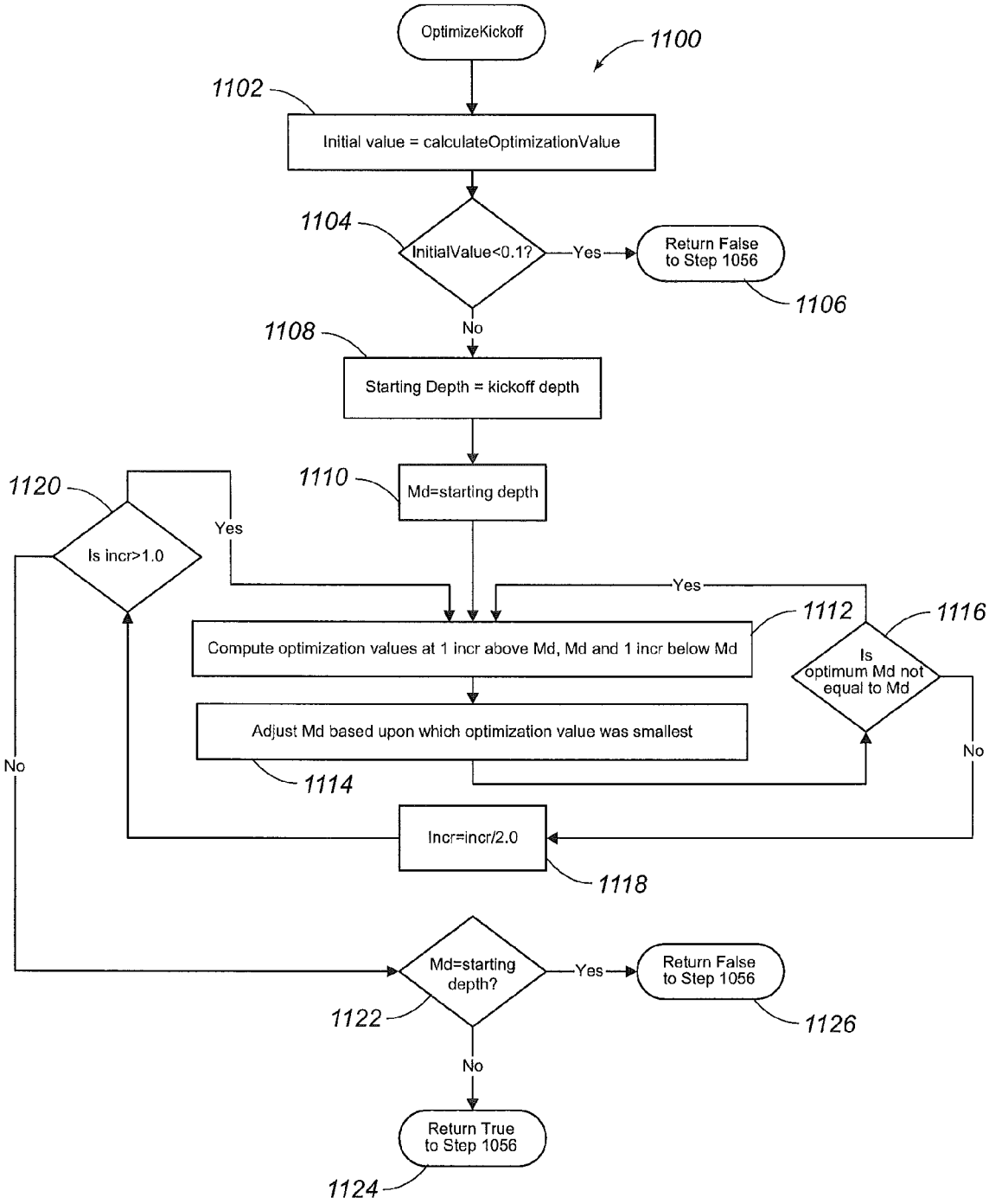
FIG. 11 is a flowchart illustrating one embodiment of the algorithm for step 1056 in FIG. 10.

In step 1014, Cost is set equal to "calculateOptimization-Value," which is described more fully in reference to step 1102 in FIG. 11.

In step 1016, md is set equal to md plus Incr.

In step 1018, the amount of plan kick-off is set equal to md.

In step 1020, Cost is set equal to "calculateOptimization-Value," which is described more fully in reference to step 1102 in FIG. 11.

In step 1022, the method 1000 determines if cost is greater than 0 and md less than the maximum kick-off minus Incr. If cost is greater than 0 and md is less than the maximum kick-off minus Incr, then return to step 1016. If cost is not greater than 0 and md less than the maximum kick-off minus Incr, then go to step 1024.

In step 1024, the method 1000 determines if Cost is greater than 0. If Cost is greater than 0, then go to step 1026. If Cost is not greater than 0, then go to step 1046.

In step 1026, md is set equal to the minimum kick-off.

In step 1030, PreviousCost is set equal to cost.

In step 1032, md is set equal to md plus Incr.

In step 1034, the amount of plan kick-off is set equal to md.

In step 1036, Cost is set equal to "calculateOptimizationValue," which is described more fully in reference to step 1102 in FIG. 11.

In step 1038, the method 1000 determines if Cost is less than or equal to PreviousCost and Cost is greater than 0. If Cost is less than or equal to PreviousCost and Cost is greater than 0, then return to step 1030. If Cost is not less than or equal to PreviousCost and Cost is greater than 0, then go to step 1040.

In step 1040, the method 1000 determines if Cost is greater than PreviousCost. If Cost is greater than PreviousCost, then go to step 1042. If Cost is less than PreviousCost, then go to step 1046.

In step 1042, md is set equal to md minus Incr.

In step 1044, the amount of plan kick-off is set equal to md.

In step 1046, the current plan is added to the previous plan.

In step 1048, the method 1000 determines if there are more plans. If there are more plans, then go to step 1010. If there are no more plans, then go to step 1050.

In step 1050, Changed is set equal to False.

In step 1052, Value is set equal to 0.

In step 1054, the method 1000 determines if there are more plans. If there are more plans, then go to step 1056. If there are no more plans, then go to step 1064.

In step 1056, Result is set equal to a boolean value returned from the algorithm "OptimizeKickoff." This algorithm is further discussed in reference to FIG. 11.

In step 1058, the method 1000 determines if Result is equal to True. If Result is equal to True, then go to step 1060. If Result is not equal to True, then go to step 1062.

In step 1060, Change is set equal to True.

In step 1062, Value is set equal to Value plus calculateOptimizationValue.

In step 1064, the method 1000 determines if Changed is equal to false. If Changed is equal to false, then the method 1000 ends. If Changed is not equal to false, then go to step 1066.

In step 1066, variable i is initialized to equal 0. If i is less than 10, then increase i by 1 and return to step 1050. If i is greater than 10, then the method 1000 ends.

In FIG. 11, the method 1100 generally illustrates one embodiment of optimizing kick-off as required for step 1056 in FIG. 10.

In step 1102, an optimization value (or cost as the case may be) is calculated by the following costs, which represent the initial value:

1) Count and from the mudline;
2) Do not start doing any separation cheeks until the minimum kick-off (min nudge if using them) because control cannot be maintained above that;
3) Use the normal Minimum Allowable Separation=Y*MD (actually Y*(MD1+MD2) because there are two plans involved;
4) If the distance is not decreasing, then do not count it as a problem;
5) If computing a numeric value, at each point where there is a separation problem, count the cost as 10000*((min separation−separation)/min separation), which reflects both the magnitude and the duration;
6) Do a separation check every 5 feet or 2 meters;
7) Exceeding maximum hold angle=200*the amount the hold angle is over the maximum;
8) Not achieving minimum hold angle=150*deficit;
9) Hazard issue=2500*number of hazards penetrated; and
10) Other engineering constraint violation=length of violating section plus a proportional penalty on the magnitude of the violation and type of violation.

In step 1104, the method 1100 determines if the InitialValue is less than 0.1. If the InitialValue is less than 0.1, then go to step 1106. If the InitialValue is greater than 0.1, then go to step 1108.

In step 1106, a value of False is returned to step 1056.

In step 1108, the starting depth is set equal to the kick-off depth.

In step 1110, the md is set equal to the starting depth.

In step 1112, the optimization values are computed using techniques well known in the art at 1 increment above md, as well as one increment below md.

In step 1114, md is set equal to the optimization value that was smallest in step 1112.

In step 1116, the method 1100 determines if the optimum md is equal to the current md. If the optimum md is equal to the current md, then go to step 1112. If the optimum md is not equal to the current md, then go to step 1118.

In step 1118, Incr is divided in half.

In step 1120, the method 1100 determines if Incr is greater than 1.0. If Incr is greater than 1.0, then go to step 1112. If Incr is less than 1.0, then go to step 1122.

In step 1122, the method 1100 determines if md is equal to the original, starting kick-off depth. Up to 5 passes are processed through the plans unless, on a given pass, no kick-off depths were moved. If md is equal to the starting depth, then go to step 1126. If md is not equal to the starting depth, then go to step 1124.

In step 1124, a value of True is returned to step 1056.

In step 1126, a value of False is returned to step 1056.

Figure 12:
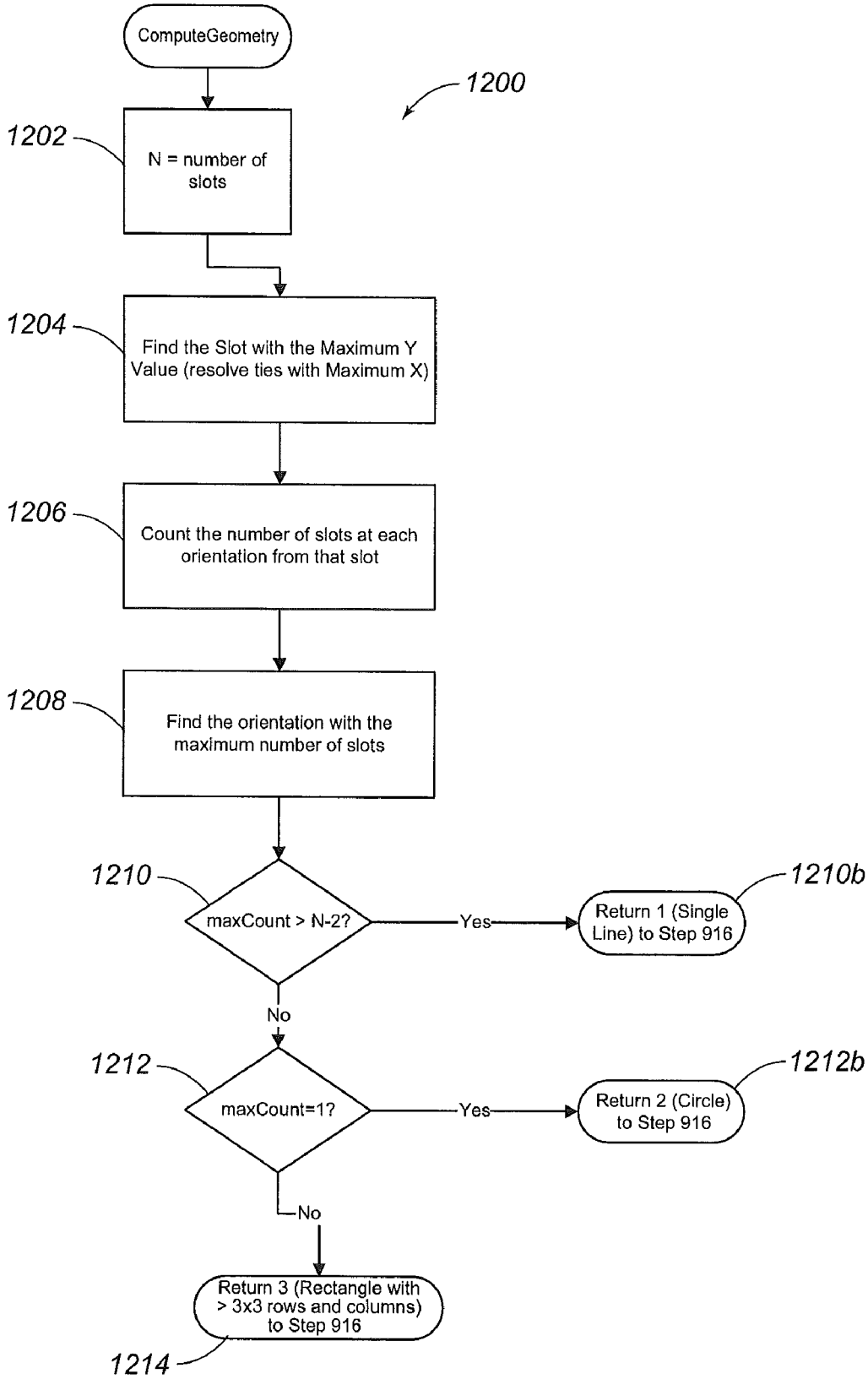
FIG. 12 is a flowchart illustrating one embodiment of the algorithm for step 916 in FIG. 9A.

In FIG. 12, the method 1200 generally illustrates one embodiment of the "ComputeGeometry" algorithm as required for step 916 in FIG. 9A. The "ComputeGeometry" algorithm is executed by finding the slot that is the most Northeastern (max x within max y) and measuring the azimuth of each other slot from that slot. These azimuths are rounded to integers (0-360), then used as indices in a 360 element array to build a histogram of azimuths. If all of the slots are at the same azimuth from the chosen slot, there is a straight line geometry. If they are all at different azimuths, there is probably a circular geometry. If the maximum count is greater than the number of slots over 3 (i.e. roughly half) then there is probably a double line geometry. Otherwise, a rectangular geometry (more than 2 rows and columns) should be considered.

In step 1202, N is set equal to the number of slots.

In step 1204, the slot with the maximum Y value is found, resolving ties with Maximum X, effectively finding the most Northeastern slot.

In step 1206, the number of slots at each orientation from that slot are counted.

In step 1208, the orientation with the maximum number of slots is found.

In step 1210, the method 1200 determines if maxCount is greater than N minus 2, where maxCount is the number of slots found at the orientation with the maximum number of slots in step 1208. If maxCount is greater than N minus 2, then go to step **1210*b*. If maxCount is less than N minus 2, then go to step 1212**.

In step **1210*b*, a 1 is returned to step 916**, representing single line geometry.

In step 1212, the method 1200 determines if maxCount is equal to 1. If maxCount is equal to 1, then go to step 1212*b*. If maxCount is not equal to 1, then go to step 1214.

In step 1212*b*, a 2 is returned to step 916, representing a circle geometry.

In step 1214, a 3 is returned to step 916, representing a rectangle with greater than three rows and three columns.

In order to understand the initial positioning of the nudges, it is necessary to think of the pad as having two templates. One at the surface, containing the original surface locations of the plans and one at the (expected) final kick-off depth that contains the locations where the plans will be after they have been nudged. The goal here is to have each plan in a location, which is more than the minimum separation at that depth from any other plan, be on an azimuth that is compatible with the plan's intended trajectory and not have crossed another plan to get there. Unfortunately, there is not a one-size-fits-all algorithm that will accomplish this for every possible geometry and the slot assignments play into it as well. It will be necessary to determine which algorithm works best, execute the algorithm and then fix any separation or azimuth issues.

Figure 13:
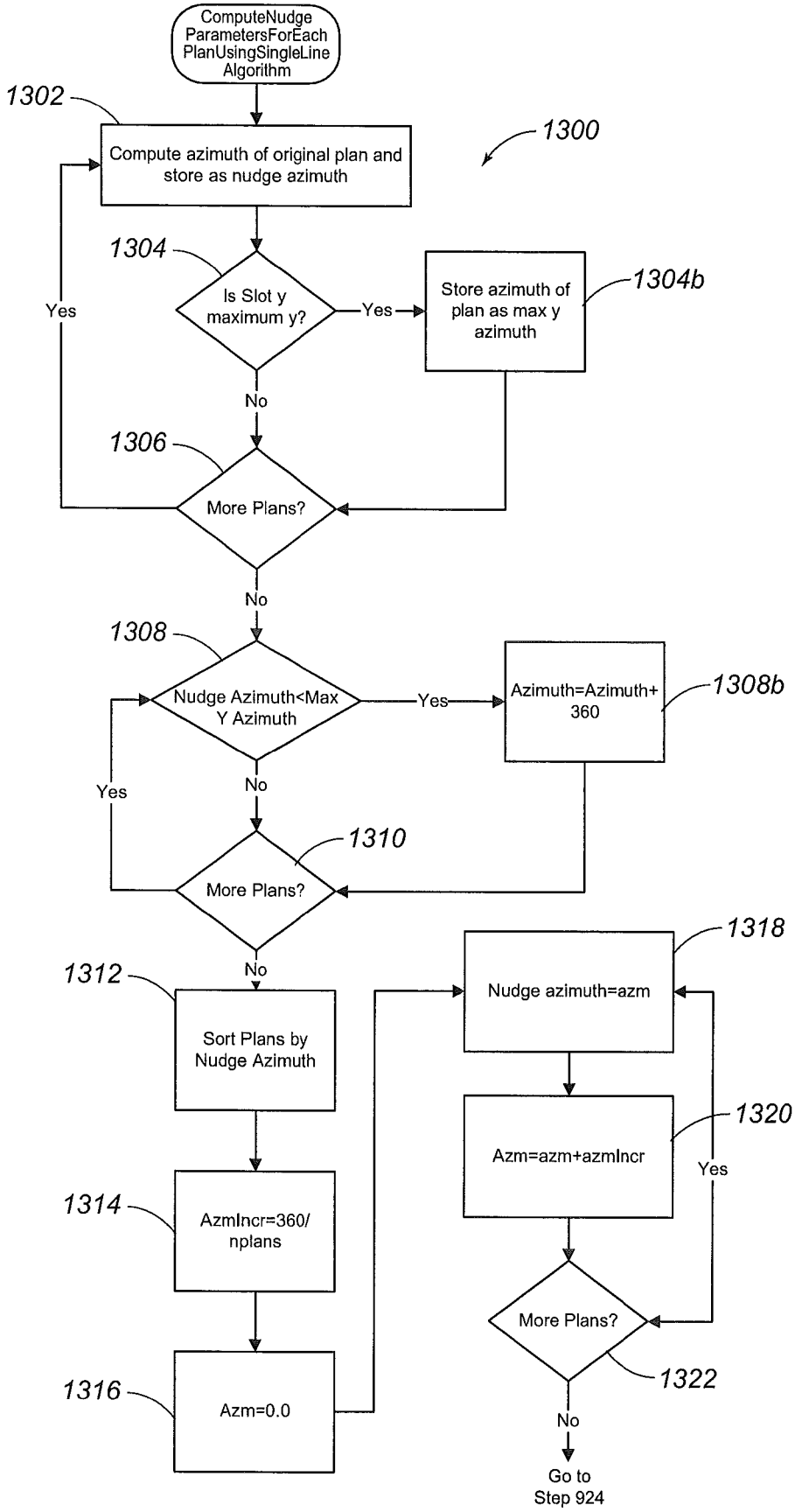
FIG. 13 is a flowchart illustrating one embodiment of the algorithm for step 918*b* in FIG. 9A.

In FIG. 13, the method 1300 generally illustrates one embodiment of the single line computation algorithm as required for step 918*b* in FIG. 9A.

In step 1302, the azimuth of the original plan is computed using techniques well known in the art and stored as the nudge azimuth. This step determines the original planned trajectory for each plan.

In step 1304, the method 1300 determines if the current slot y is the maximum y. If the current slot y is the maximum y, then go to step 1304*b*. If the current slot y is not the maximum y, then go to step 1306.

In step 1304*b*, the azimuth of the plan is stored as the maximum y azimuth. This step completes the process of finding the plan whose slot has the maximum y value (most Northern.)

In step 1306, the method 1300 determines if there are more plans. If there are more plans, then return to step 1302. If there are no more plans, then go to step 1308.

In step 1308, the method 1300 determines if the nudge azimuth is less than the maximum y azimuth. If the nudge azimuth is less than the maximum y azimuth, then go to step 1308*b*. If the nudge azimuth is not less than the maximum y azimuth, then go to step 1310.

In step 1308*b*, Azimuth is set equal to azimuth plus 360. This results in all smaller slots having 360 added to them.

In step 1310, the method 1300 determines if there are more plans. If there are more plans, then return to step 1308. If there are no more plans, then go to step 1312. When this step is done, the most Northern slot will have the minimum azimuth.

In step 1312, plans are sorted by ascending azimuth.

In step 1314, an azimuth of 360/nplans is assigned to each of the plans.

In step 1316, a nudge azimuth of 0.0 (due north) is assigned to the plan with the most Northern slot.

In step 1318, the nudge azimuth is set equal to Azm.

In step 1320, Azm is set equal to Azm plus AzmIncr. In this manner, a pattern of nudge locations will be created that is somewhat circular, albeit stretched by the length of the original template. Assuming a series of 8 slots in a straight line, for example, with plans having trajectories of 35, 0, 340, 110, 300, 250, 165, and 175 degrees (listed from Northeast to Southwest), the ordering would be azimuths 35, 110, 165, 175, 250, 300, 340, 0 (i.e., plans in slots 1, 4, 7, 8, 6, 5, 3, 2). Slot 1 would be nudged due north (0 degrees). The next plan, slot number 4, would be nudged 45 degrees (360/8) before heading in its 110 degree azimuth. The plan in slot 7 would get nudged 90 degrees and so on all the way around to the plan in slot 2, which would be nudged 315 degrees. This should maximize the distance between the plans at the final kick-off depths and minimize crossing issues.

In step 1322, the method 1300 determines if there are more plans. If there are more plans, then return to step 1318. If there are no more plans, then go to step 924.

In FIG. 14, the method 1400 generally illustrates one embodiment of the double line and circular template computation algorithm as required for step 920*b* in FIG. 9A. The algorithm for handling double lines and circular template geometries (FIG. 14) is similar to the single line algorithm illustrated in FIG. 13. However, the azimuths used are the azimuths from the center of the template to each plan's slot, rather than the azimuth from the slot to the first target. This keeps the algorithm from computing nudges that pass under other slots.

In step 1402, the "FindCenter" algorithm is executed.

In step 1404, the azimuth from the center of the plan to the original slot is computed using techniques well known in the art.

In step 1406, the method 1400 determines if the current slot y is the maximum y. If the current slot y is the maximum y, then go to step 1406*b*. If the current slot y is not the maximum y, then go to step 1408.

In step 1406*b*, the azimuth of the plan is stored as the maximum y azimuth. This step completes the process of finding the plan whose slot has the maximum y value (most Northern).

In step 1408, the method 1400 determines if there are more plans. If there are more plans, then return to step 1404. If there are no more plans, then go to step 1410.

In step 1410, the method 1400 determines if the nudge azimuth is less than the maximum y azimuth. If the nudge azimuth is less than the maximum y azimuth, then go to step 1410*b*. If the nudge azimuth is not less than the maximum y azimuth, then go to step 1412.

In step 1410*b*, Azimuth is set equal to azimuth plus 360. This results in all smaller slots having 360 added to them.

In step 1412, the method 1400 determines if there are more plans. If there are more plans, then go to step 1410. If there are no more plans, then go to step 1414. When this step is done, the most Northern slot will have the minimum azimuth.

In step 1414, plans are sorted by ascending azimuth.

In step 1416, an azimuth of 360/nplans is assigned to each of the plans.

In step 1418, a nudge azimuth of 0.0 (due north) is assigned to the plan with the most Northern slot.

In step 1420, the nudge azimuth is set equal to Azm.

In step 1422, Azm equal is set equal to Azm plus AzmIncr.

In step 1424, the method 1400 determines if there are more plans. If there are more plans, then return to step 1420. If there are no more plans, then go to step 924.

Figure 15:
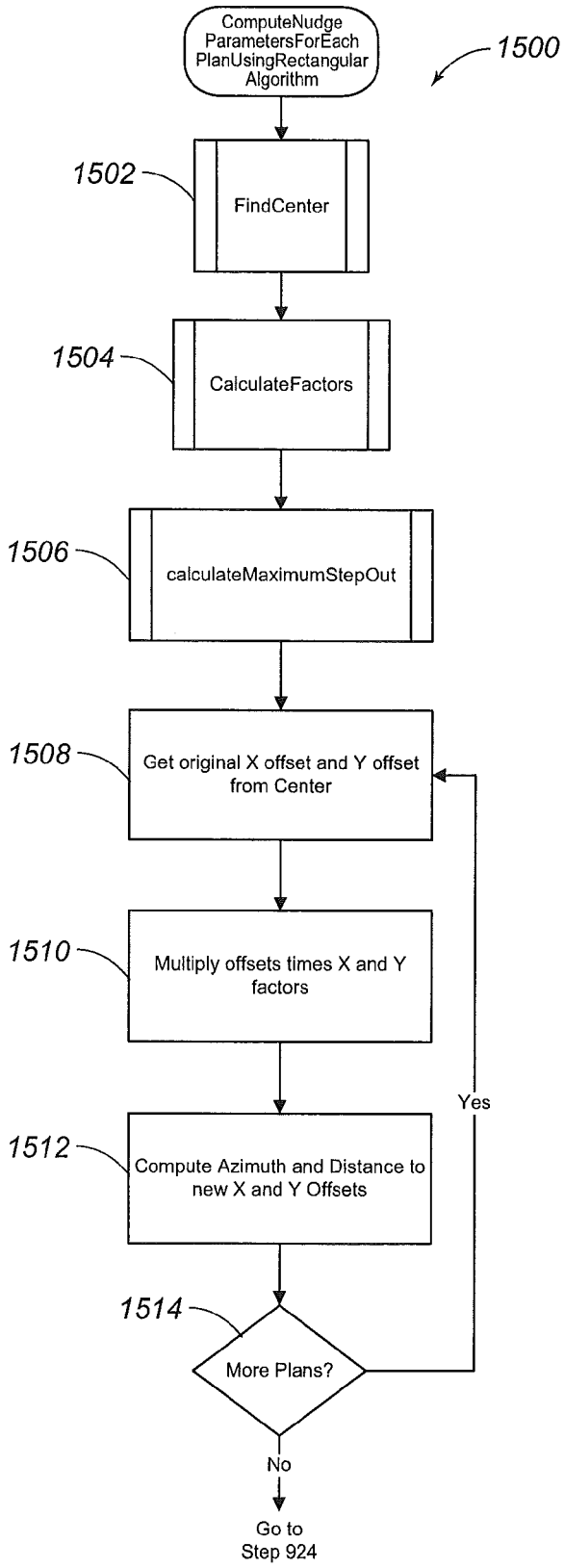
FIG. 15 is a flowchart illustrating one embodiment of the algorithm for step 922*b* in FIG. 9A.

In FIG. 15, the method 1500 generally illustrates one embodiment of the rectangular template computation algorithm as required for step 922*b* in FIG. 9A. The algorithm for handling rectangular templates with more then 2 rows and columns (FIG. 15) is different than the algorithms illustrated in FIG. 13 and FIG. 14. Rather than creating a circular pattern, the algorithm attempts to create a pattern that is similar to the surface pattern, but enlarged by the maximum amount that a plan can be nudged in each direction. Unlike the other two algorithms illustrated in FIG. 13 and FIG. 14, which assume that all of the plans will be nudging at about the same depth and building at the same rate, this algorithm assumes that wells planned from the interior slots will wait a bit later to kick-off and build at a slower rate so as not to interfere with the plans from the outer slots.

In step 1502, the "FindCenter" algorithm is executed. This algorithm will be further discussed in reference to FIG. 27.

In step 1504, the "CalculateFactors" algorithm is executed. This algorithm will be further discussed in reference to FIG. 16.

In step 1506, the "calculateMaximumStepOut" algorithm is executed. This algorithm will be further discussed in reference to FIG. 17.

In step 1508, the original X offset and Y offset from the Center are obtained.

Figure 16:
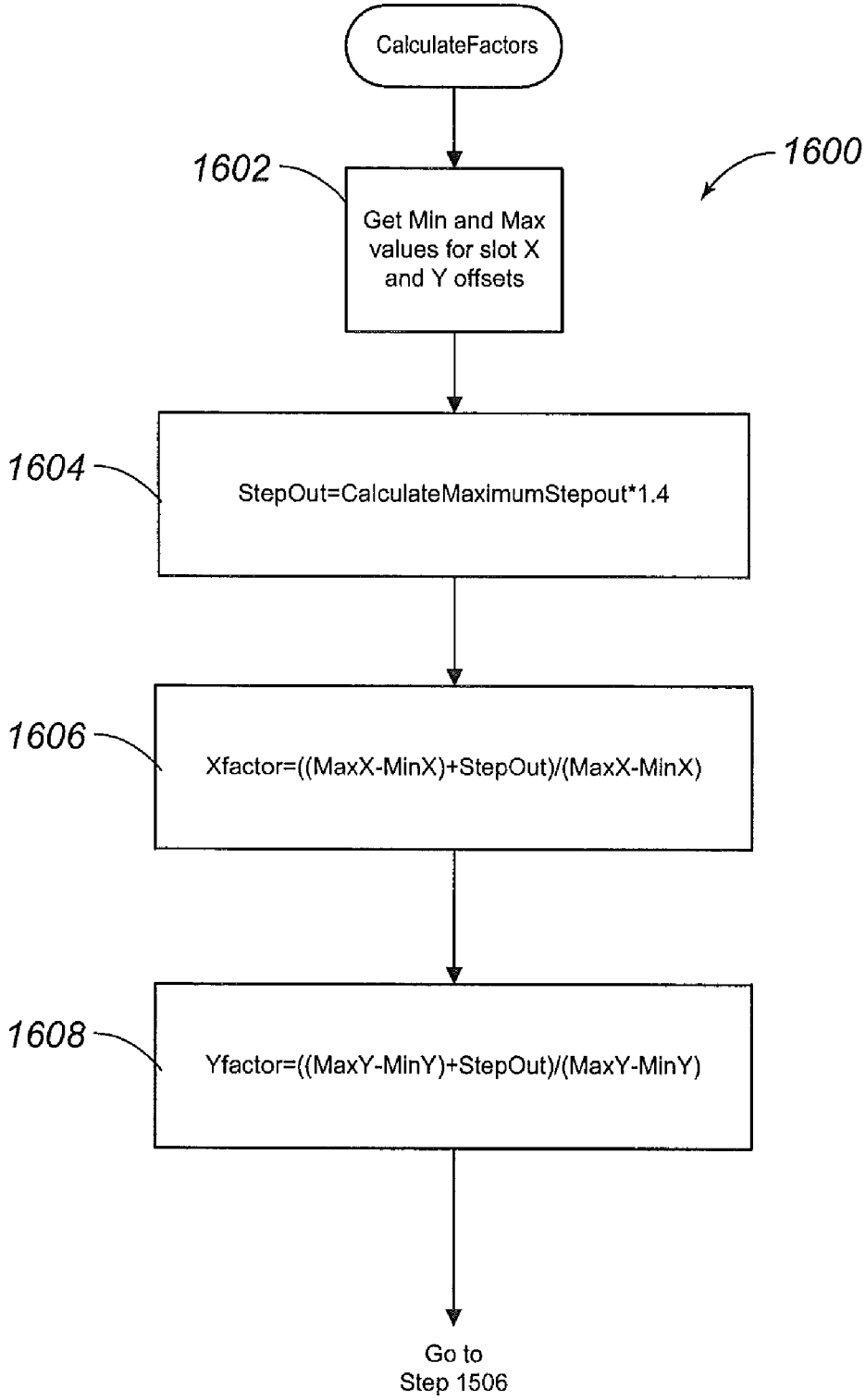
FIG. 16 is a flowchart illustrating one embodiment of the algorithm for step 1504 in FIG. 15.

In step 1510, the X and Y offsets are multiplied by the X and Y factors, which are determined in steps 1606 and 1608, respectively, in FIG. 16.

In step 1512, the azimuth and distance are computed using techniques well known in the art using the new X and Y offsets from step 1510.

In step 1514, the method 1500 determines if there are more plans. If there are more plans, then go to step 1508. If there are no more plans, then go to step 924.

In FIG. 16, the method 1600 generally illustrates one embodiment of the calculate factors algorithm as required for step 1504 in FIG. 15.

In step 1602, the minimum and maximum values for slot X and Y offsets are obtained.

Figure 17:
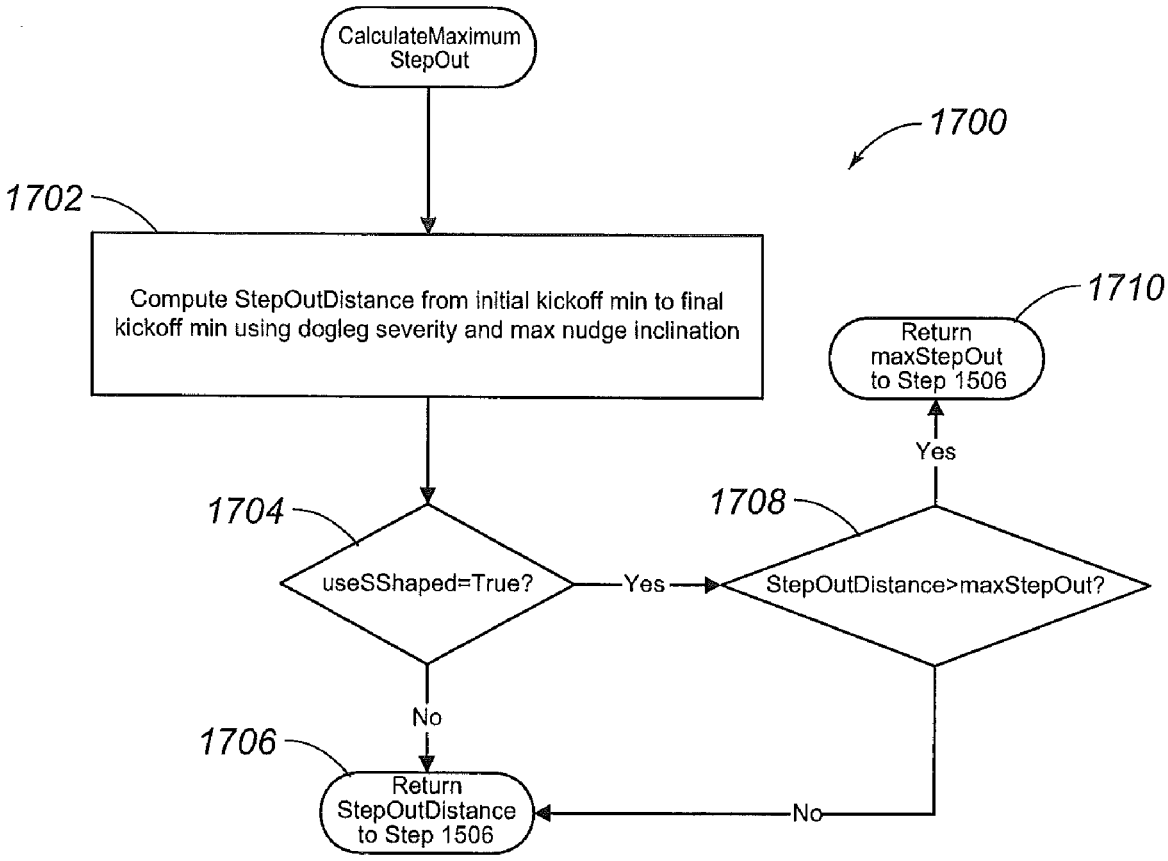
FIG. 17 is a flowchart illustrating one embodiment of the algorithm for step 1056 in FIG. 15.

In step 1604, the result of the "CalculateMaximumStepout" algorithm in FIG. 17 is multiplied by 1.4, which is approximately 2 times the sine of 45, because the plan will not necessarily be nudging in a direct North, South or East, West direction.

In step 1606, the expanded X limits are divided by the original limits to get a multiplication factor for each X, which can be used compute the offsets of where the nudge should place the plan.

In step 1608, the expanded Y limits are divided by the original limits to get a multiplication factor for each Y, which can be used compute the offsets of where the nudge should place the plan. After this is complete, the method 1600 returns to step 1506.

In FIG. 17, the method 1700 generally illustrates one embodiment of the "CalculateMaximumStepout" algorithm as required for step 1506 in FIG. 15.

In step 1702, the step out distance from the minimum initial kick-off depth to the minimum final kick-off depth is computed using dogleg severity and maximum nudge inclination. The step out distance is the lateral distance that a plan will travel during the course of a nudge. It includes both the distance that it travels as it is building to the nudge inclination and the distance it travels during the hold section. If the nudge is a build-hold-drop type, it will also include the lateral distance traveled as the plan drops back to vertical. Likewise, in a build-hold-drop, the user will specify the desired step out, so if the computed maximum step out is greater than that user-supplied value, the user-supplied max step out is used. Since the step out is dependent upon the nudge kick-off and the final kick-off depths (or the distance between them) and these values can vary, the minimum values for both of these and the maximum nudge inclination are used to obtain a representative step out for this computation.

In step 1704, the method 1700 determines if useSShaped is equal to True. If useSShaped is equal to True, then go to step 1708. If useSShaped is not equal to True, then go to step 1706.

In step 1706, the StepOutDistance is returned to step 1506.

In step 1708, the method 1700 determines if StepOutDistance is greater than maxStepOut. If StepOutDistance is greater than maxStepOut, then go to step 1710. If StepOutDistance is less than maxStepOut, then go to step 1706.

In step 1710, maxStepOut is returned to step 1506.

Figure 18:
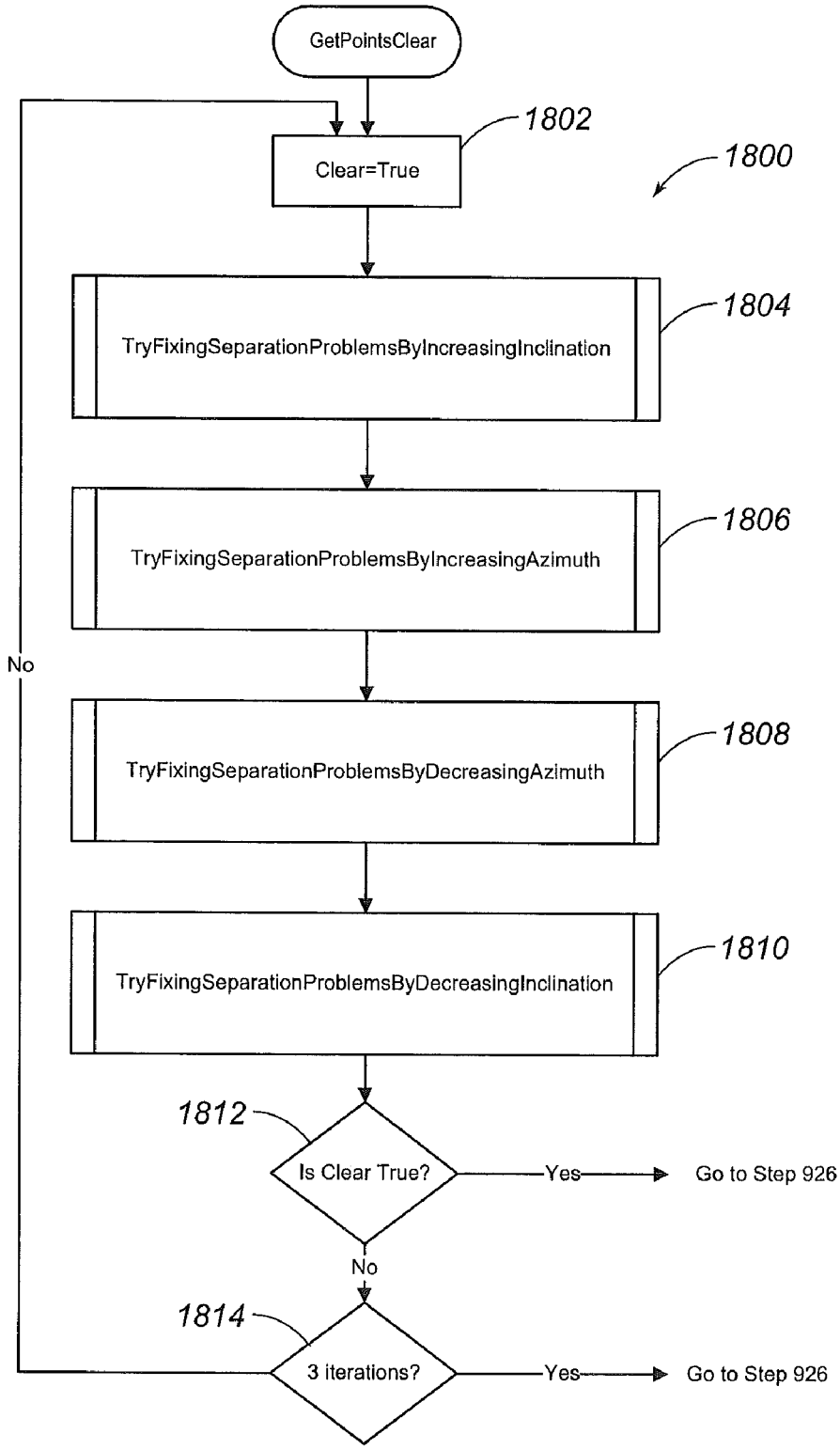
FIG. 18 is a flowchart illustrating one embodiment of the algorithm for step 924 in FIG. 9B.

In FIG. 18, the method 1800 generally illustrates one embodiment of the "GetPointsClear" algorithm as required for step 924 in FIG. 9. Once the initial locations for the nudge positions on the lower template have been found, the "GetPointsClear" algorithm will evaluate the locations to make sure that they maintain an adequate separation distance and that they do not cause the plan to go too far off its planned trajectory. The separation distance may be specified by the user as: (separation factor)/1000. If the user, for example, specifies a separation factor of 6.0, it means that any two plans must be at least 6 feet apart after 1000 feet of drilling (500 feet per well) or 12 feet apart after 2000 feet of drilling (1000 feet per well). For purposes of executing the "GetPointsClear" algorithm in step 924 of FIG. 9B, the separation distance is computed as 2 times the final kick-off depth of the plan times the separation factor divided by 1000. The user also enters a maximum azimuth change, which is the maximum allowable difference between the nudge azimuth and the azimuth from the nudge point to the first target. The "GetPointsClear" algorithm is designed to (if at all possible) insure that each nudge gets its plan into a position that is at least the required separation away from all other plans at the final kick-off depth. In recognition of the fact that it may take several small moves by various plans rather than a single large move by one plan, the algorithm does this in 3 iterations, each making relatively small moves. The moves are accomplished by changing the inclination or azimuth of the plan. When the inclination is changed, the nudge point either gets closer or farther away from the original slot, depending upon whether the inclination decreases or increases. The "GetPointsClear" algorithm first tries increasing the inclination of each plan that has insufficient separation, then increasing the azimuths, then decreasing the azimuths, then decreasing the inclinations. With each try, it only keeps the result if the minimum separation has decreased. While this algorithm is very helpful to overall nudge optimization, it is not absolutely necessary that it achieve total success. Even if two plans do not have sufficient lateral separation at their nudged-to points, it may still be possible to properly separate them by varying their depths (i.e. achieving the separation vertically).

In step 1802, Clear is set equal to True.

In step 1804, the "TryFixingSeparationProblemsByIncreasingInclination" algorithm is executed. This algorithm is further discussed in reference to FIG. 19.

In step 1806, the "TryFixingSeparationProblemsByIncreasingAzimuth" algorithm is executed. This algorithm is further discussed in reference to FIG. 20.

In step 1808, the "TryFixingSeparationProblemsByDecreasingAzimuth" algorithm is executed. This algorithm is further discussed in reference to FIG. 21.

In step 1810, the "TryFixingSeparationProblemsByDecreasingInclination" algorithm is executed. This algorithm is further discussed in reference to FIG. 22.

In step 1812, the method 1800 determines if Clear is equal to True. If Clear is equal to True, then go to step 926. If Clear is not equal to True, then go to step 1814.

In step 1814, the method 1800 determines if it has made 3 iterations. If there have been 3 iterations, then go to step 926. If there have not been 3 iterations, then go to step 1802.

In FIG. 19, the method 1900 generally illustrates one embodiment of the "TryFixingSeparationProblemsByIncreasingInclination" algorithm as required for step 1804 in FIG. 18.

In step 1902, the method 1900 determines if NudgePointClear is not True. If NudgePointClear is not True, then go to step 1904. If NudgePointClear is True, then go to step 1924. The NudgePointClear result is determined according to the method 2300 in FIG. 23.

In step 1904, origInclination is set equal to plan inclination.

In step 1906, prevDistance is set equal to getMinSeparation.

In step 1908, maxInclination is set equal to max userInclination, origInclination plus 2.

In step 1910, plan inclination is set equal to inclination.

In step 1912, the location is computed using techniques well known in the art.

In step 1914, the method 1900 determines if NudgePointClear is true. If NudgePointClear is true, then go to step 1924. If NudgePointClear is not true, then go to step 1916.

In step 1916, distance is set equal to getMinSeparation.

In step 1918, the method 1900 determines if distance is greater than prevDistance. If distance is greater than prevDistance, then go to step 1918*b*. If distance is not greater than prevDistance, then go to step 1920.

In step 1918*b*, prevDistance is set equal to distance.

In step 1920, plan inclination is set equal to plan inclination minus 0.25.

In step 1922, the location is computed using techniques well known in the art.

In step 1924, variable incl is initialized to origInclination plus 0.25. If incl is less than maxInclination, increase inclination by 0.25 and return to step 1910. If incl is greater than maxInclination, then go to step 1926.

In step 1926, the method 1900 determines if NudgePointClear is false. If NudgePointClear is false, then go to step 1926*b*. If NudgePointClear is not false, then go to step 1928.

In step 1926*b*, Clear is set equal to false.

In step 1928, the method 1900 determines if there are more plans. If there are more plans, then return to step 1902. If there are no more plans, go to step 1806.

In FIG. 20, the method 2000 generally illustrates one embodiment of the "TryFixingSeparationProblemsByIncreasingAzimuth" algorithm as required for step 1806 in FIG. 18.

In step 2002, the method 2000 determines if NudgePointClear is not True. If NudgePointClear is not True, then go to step 2004. If NudgePointClear is True, then go to step 2024.

In step 2004, origAzimuth is set equal to plan nudge Azimuth.

In step 2006, prevDistance is set equal to getMinSeparation.

In step 2008, maxAzimuth is set equal to Azimuth plus 10.

In step 2010, plan nudge Azimuth is set equal to Azm.

In step 2012, the location of the nudge point is computed using techniques well known in the art.

In step 2014, the method 2000 determines if NudgePointClear is true. If NudgePointClear is true, then go to step 2024. If NudgePointClear is not true, then go to step 2016.

In step 2016, distance is set equal to getMinSeparation.

In step 2018, the method 2000 determines if distance is greater than prevDistance. If distance is greater than prevDistance, then go to step 2018*b*. If distance is not greater than prevDistance, then go to step 2020.

In step 2018*b*, prevDistance is set equal to distance.

In step 2020, plan nudge Azimuth is set equal to plan nudge Azimuth minus 1.

In step 2022, the location of the nudge point is computed using techniques well known in the art.

In step 2024, variable azm is initialized to equal origAzimuth. If azm is less than maxAzimuth, then increase azm by 1 and return to step 2010. If azm is greater than maxAzimuth, then go to step 2026.

In step 2026, the method 2000 determines if NudgePointClear is false. If NudgePointClear is false, then go to step 2026*b*. If NudgePointClear is not false, then go to step 2028.

In step 2026*b*, Clear is set equal to false.

In step 2028, the method 2000 determines if there are more plans. If there are more plans, then return to step 2002. If there are no more plans, go to step 1808.

In FIG. 21, the method 2100 generally illustrates one embodiment of the "TryFixingSeparationProblemsByDecreasingAzimuth" algorithm as required for step 1808 in FIG. 18.

In step 2102, the method 2100 determines if NudgePointClear is not True. If NudgePointClear is not True, then go to step 2104. If NudgePointClear is True, then go to step 2124.

In step 2104, origAzimuth is set equal to plan nudge Azimuth.

In step 2106, prevDistance is set equal to getMinSeparation.

In step 2108, maxAzimuth is set equal to Azimuth minus 10.

In step 2110, plan nudge Azimuth is set equal to azm.

In step 2112, the location of the nudge point is computed using techniques well known in the art.

In step 2114, the method 2100 determines if NudgePointClear is true. If NudgePointClear is true, then go to step 2124. If NudgePointClear is not true, then go to step 2116.

In step 2116, distance is set equal to getMinSeparation.

In step 2118, the method 2100 determines if distance is greater than prevDistance. If distance is greater than prevDistance, then go to step 2118*b*. If distance is not greater than prevDistance, then go to step 2120.

In step 2118*b*, prevDistance is set equal to distance.

In step 2120, plan nudge Azimuth is set equal to plan nudge Azimuth plus 1.

In step 2122, the location of the nudge point is computed using techniques well known in the art.

In step 2124, variable azm is initialized to equal origAzimuth. If azm is greater than minAzimuth, decrease azm by 1 and return to step 2110. If azm is less than mixAzimuth, then go to step 2126.

In step 2126, the method 2100 determines if NudgePointClear is false. If NudgePointClear is false, then go to step 2126*b*. If NudgePointClear is not false, then go to step 2128.

In step 2126*b*, Clear is set equal to false.

In step 2128, the method 2100 determines if there are more plans. If there are more plans, then return to step 2102. If there are no more plans, then go to step 1808.

In FIG. 22, the method 2200 generally illustrates one embodiment of the "TryFixingSeparationProblemsByDecreasingInclination" algorithm as required for step 1810 in FIG. 18.

In step 2202, the method 2200 determines if NudgePointClear is not True. If NudgePointClear is not True, then go to step 2204. If NudgePointClear is True, then go to step 2224.

In step 2204, origInclination is set equal to plan inclination.

In step 2206, prevDistance is set equal to getMinSeparation.

In step 2208, minInclination is set equal to min 1.0, origInclination minus 2.

In step 2210, plan inclination is set equal to inclination.

In step 2212, the location of the nudge point is computed using techniques well known in the art.

In step 2214, the method 2200 determines if NudgePointClear is true. If NudgePointClear is true, then go to step 2224. If NudgePointClear is not true, then go to step 2216.

In step 2216, distance is set equal to getMinSeparation.

In step 2218, the method 2200 determines if distance is greater than prevDistance. If distance is greater than prevDistance, then go to step 2218*b*. If distance is less than prevDistance, then go to step 2220.

In step 2218*b*, prevDistance is set equal to distance.

In step 2220, plan inclination is set equal to plan inclination plus 0.25.

In step 2222, the location of the nudge point is computed using techniques well known in the art.

In step 2224, variable incl is initialized to origInclination minus 0.25. If incl is greater than or equal to mixInclination, then decrease inclination by 0.25 and return to step 2210. If incl is less than minInclination, then go to step 2226.

In step 2226, the method 2200 determines if NudgePointClear is false. If NudgePointClear is false, then go to step 2226*b*. If NudgePointClear is not false, then go to step 2228.

In step 2226*b*, Clear is set equal to false.

In step 2228, the method 2200 determines if there are more plans. If there are more plans, then return to step 2202. If there are no more plans, then go to step 1812.

Figure 23:
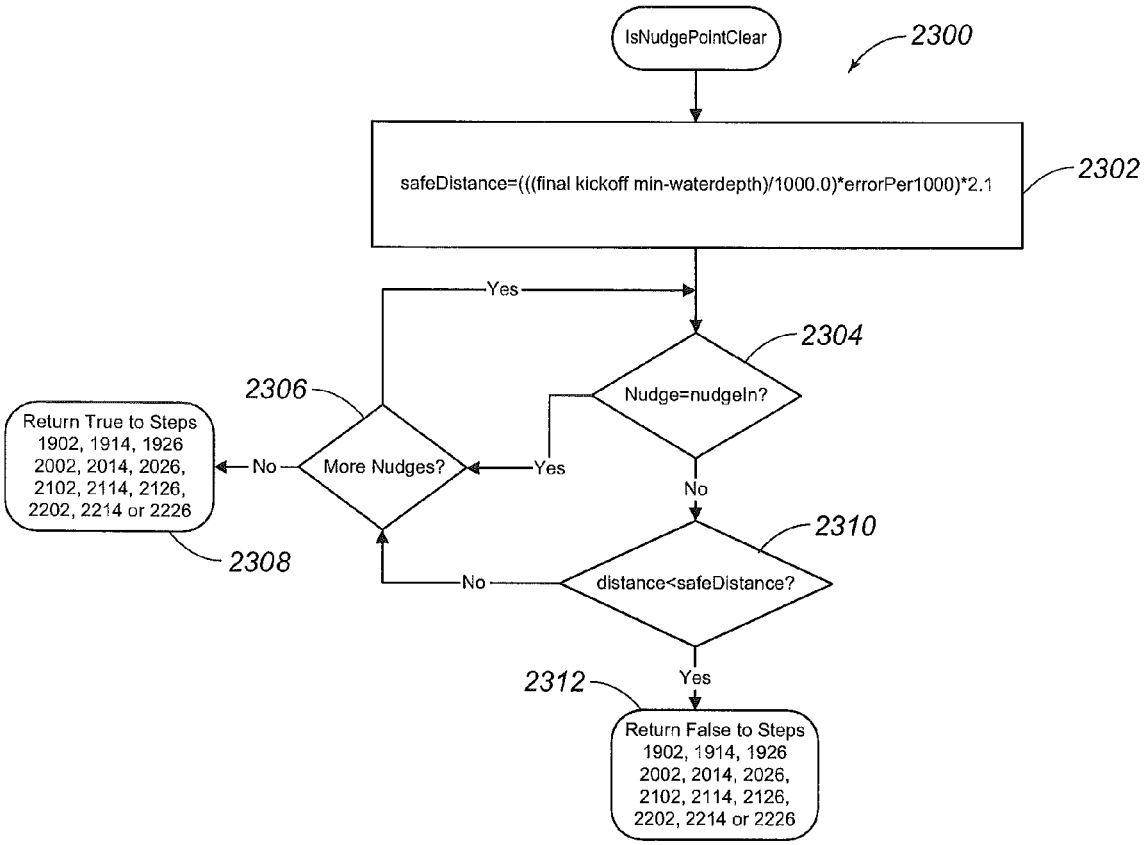
FIG. 23 is a flowchart illustrating one embodiment of the algorithm for steps 1902, 1914, 1926 in FIG. 19, steps 2002, 2014, 2026 in FIG. 20, steps 2102, 2114, 2126 in FIG. 21 and steps 2202, 2214, 2226 in FIG. 22.

In FIG. 23, the method 2300 generally illustrates one embodiment of the is nudge point clear algorithm as required for steps 1902, 1914, 1926, 2002, 2014, 2026, 2102, 2114, 2126, 2202, 2214, and 2226 in FIGS. 19-22.

In step 2302, safeDistance is set equal to final minimum kick-off minus waterdepth divided by 1000 times error percentage times 2.1.

In step 2304, the method 2300 determines if nudge equals nudgeIn, which is the nudge point used as input to the method 2300 illustrated in FIG. 23. If nudge equals nudgeIn, then go to step 2306. If nudge does not equal nudgeIn, then go to step 2310.

In step 2306, the method 2300 determines if there are more nudges. If there are more nudges, then return to step 2304. If there are no more nudges, then go to step 2308.

In step 2308, true is returned to steps 1902, 1914, 1926, 2002, 2014, 2026, 2102, 2114, 2126, 2202, 2214, and 2226.

In step 2310, the method 2300 determines if distance is less than safeDistance. If distance is less than safeDistance, then go to step 2312. If distance is not less than safeDistance, then go to step 2306.

In step 2312, false is returned to steps 1902, 1914, 1926, 2002, 2014, 2026, 2102, 2114, 2126, 2202, 2214, and 2226.

In FIG. 24, the method 2400 generally illustrates one embodiment of fix azimuths algorithm as required for step 926 in FIG. 9B. This algorithm is designed to correct problems where the planned nudge takes the plan too far outside its original intended trajectory. In one application, for example, it may be permissible to nudge a plan in the exact opposite direction before the final kick-off (e.g. nudging due south before turning 180 degrees to hit a target that is north of the pad). In another application, however, the user may determine that the nudges can not stray more than a few degrees from the plan's original intended trajectory. In the former example, the "FixAzimuths" algorithm would not really do anything because the azimuths would not need to be fixed. In the latter example, however, the algorithm would be used.

In step 2402, is OK is set equal to true.

In step 2404, deltaAzm is set equal to the slot to nudge Azimuth minus nudge to target Azimuth.

In step 2406, the method 2400 determines if deltaAzm is greater than allowableDeltaAzm. If deltaAzm is greater than allowableDeltaAzm, then go to step 2408. If deltaAzm is not greater than allowableDeltaAzm, then go to step 2404.

In step 2408, Angle 1 is equal to nudge azimuth.

In step 2410, Angle 2 is set equal to original plan azimuth.

In step 2412, the method 2400 determines if Angle 2 is greater than Angle 1 plus 180. If Angle 2 is greater than Angle 1 plus 180, then go to step 2412*b*. If Angle 2 is not greater than Angle 1 plus 180, then go to step 2414.

In step 2412*b*, Angel 2 is set equal to Angle 2 minus 360.

In step 2414, the method 2400 determines if Angle 2 is less than Angle 1 minus 180. If Angle 2 is less than Angle 1 minus 180, then go to step 2414*b*. If Angle 2 is not less than Angle 1 minus 180, then go to step 2416.

In step 2414*b*, Angel 2 is set equal to Angle 2 plus 360.

In step 2416, the method 2400 determines if Angle 2 is greater than Angle 1. If Angle 2 is greater than Angle 1, then go to step 2418. If Angle 2 is not greater than Angle 1, then go to step 2428.

In step 2418, the nudge azimuth is set equal to angle.

In step 2420, the location of the plan after the nudge is applied is computed using techniques well known in the art.

In step 2422, deltaAzm is computed using techniques well known in the art.

In step 2424, the method 2400 determines if deltaAzm is less than or equal to allowableDeltaAzm. If deltaAzm is less than or equal to allowableDeltaAzm, then go to step 2438. If deltaAzm is not less than or equal to allowableDeltaAzm, then go to step 2426.

In step 2426, Azm is initialized to Angle 1 plus 1. If angle is less than Angle 2, then increase angle by 1 and go to step 2418. If angle is not less than Angle 2, then go to step 2438.

In step 2428, nudge azimuth is set equal to angle.

In step 2430, the location is computed using techniques well known in the art.

In step 2432, deltaAzm is computed using techniques well known in the art.

In step 2434, the method 2400 determines if deltaAzm is less than or equal to allowableDeltaAzm. If deltaAzm is less than or equal to allowableDeltaAzm, then go to step 2438. If deltaAzm is not less than or equal to allowableDeltaAzm, then go to step 2436.

In step 2436, Azm is initialized to Angle 1 minus 1. If angle is less than Angle 2, then decrease angle by 1 and go to step 2428. If angle is not less than Angle 2, then go to step 2438.

In step 2438, the method 2400 determines if is NudgePointClear is equal to false. If is NudgePointClear is equal to false, then go to step 2440. If is NudgePointClear is not equal to false, then go to step 2442.

In step 2440, is Ok is set equal to false.

In step 2442, the method 2400 determines if there are more plans. If there are more plans, then go to step 2404. If there are no more plans, then go to step 2444.

In step 2444, OK is returned (which has been set to True of False) to step 926.

Figure 25A:
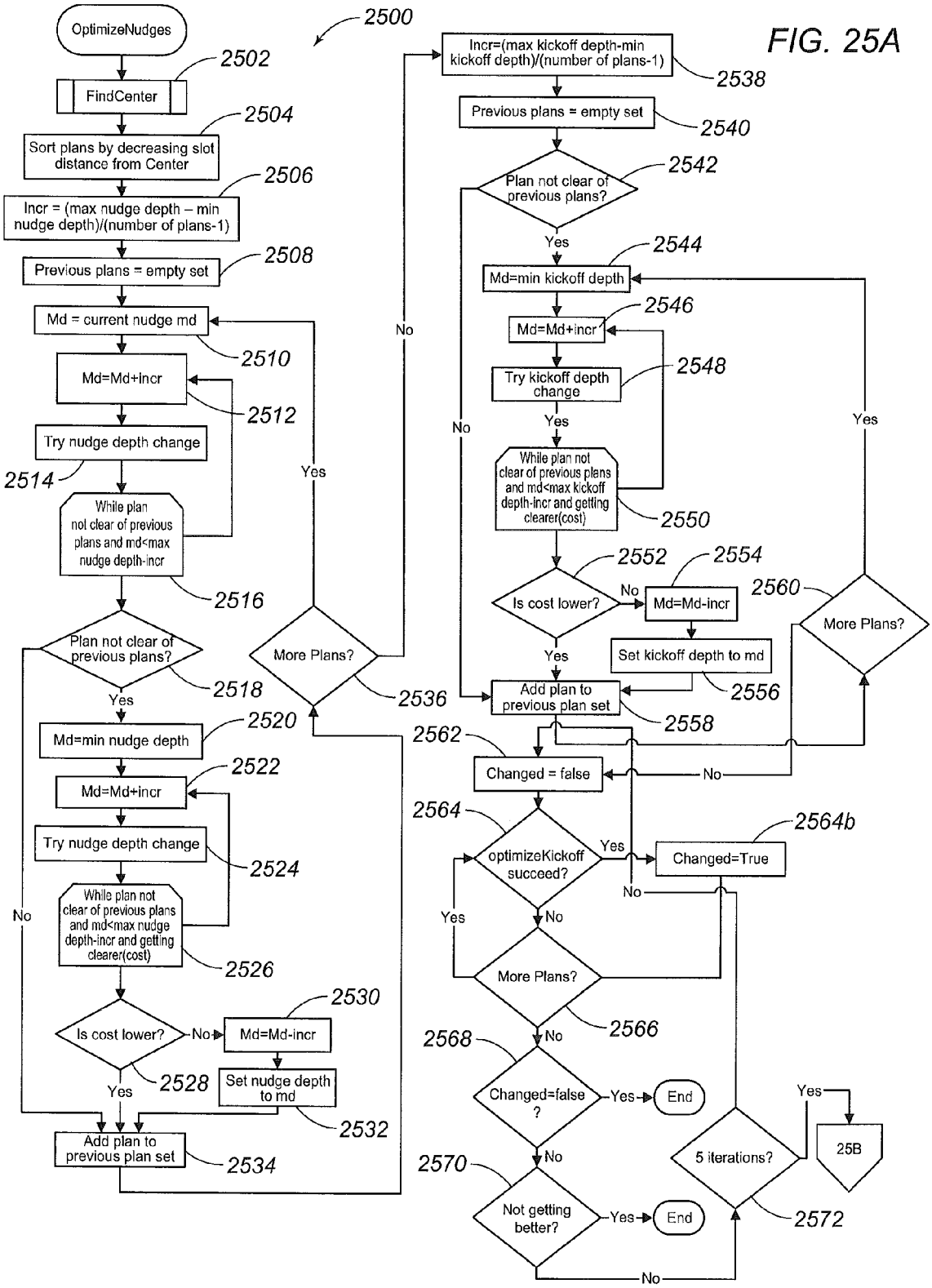
FIG. 25A is a flowchart illustrating one embodiment of the algorithm for step 936 in FIG. 9B.

In FIG. 25A, the method 2500 generally illustrates one embodiment of the "OptimizeNudges" algorithm as required for step 936 in FIG. 9B. The optimization of the nudges will primarily consist of modifying either the depth at which the nudge takes place (nudge depth) or the depth at which the plan kicks off from the nudge to begin its intended trajectory (kick-off depth).

In step 2502, the "FindCenter" algorithm is executed. This algorithm is further discussed in reference to FIG. 27.

In step 2504, the plans are sorted by decreasing slot distance from the center. By starting off at the current nudge depths farthest from the pad center and not having to do much to those, and working inward, the early passes should be getting as close as possible to the required separation.

In step 2506, Incr is set equal to maximum nudge depth minus minimum nudge depth divided by number of plans minus 1.

In step 2508, the previous plans are cleared by setting the ordered set equal to an empty set. In each pass through this ordered set of plans, the algorithm will maintain a list of plans that it has previously worked on and use that list to do separation comparisons. In this manner, plan A is not adjusted for issues with plan B that will be fixed as soon as plan B is addressed. The plans are only compared with others that are already somewhat "fixed."

In step 2510, md is set equal to the current nudge md.

In step 2512, md is set equal to md plus incr.

In step 2514, the set of plans are addressed, in order, by trying the nudge md that was set to the current (original) md in step 2510 and seeing if there is a depth at which the current plan is completely clear of previous plans.

In step 2516, while plan is not clear of previous plans and md is less than maximum nudge depth minus incr, go to step 2512.

In step 2518, the method 2500 determines if plan is not clear of previous plans. If plan is not clear of previous plans, then go to step 2520. When the plan is not clear of previous plans, method 2500 returns to the minimum nudge depth and works its way down to find a point where it is as clear of previous plans as possible. In this case, because the goal is to optimize the nudge depths, only the problems with plans approaching one another prior to final kick-off are addressed. If plan is clear of previous plans, then go to step 2534.

In step 2520, md is set equal to minimum nudge depth.

In step 2522, md is set equal to md plus incr.

In step 2524, the plans are addressed, in order, by trying the nudge md that was set to the current (original) md and seeing if there is a depth at which the current plan is completely clear of previous plans.

In step 2526, while plan is not clear of previous plans and md is less than maximum nudge depth minus incr and getting clearer (cost), go to step 2522.

In step 2528, the method 2500 determines if cost is lower. If cost is lower, then go to step 2534. If cost is not lower, then go to step 2530.

In step 2530, md is set equal to md minus incr.

In step 2532, the nudge depth is set equal to md.

In step 2534, the current plan is added to previous plan set.

In step 2536, the method 2500 determines asks if there are more plans. If there are more plans, then go to step 2510. If there are no more plans, then go to step 2538.

In step 2538, Incr is set equal to the maximum kick-off depth minus minimum kick-off depth divided by the number of plans minus 1.

In step 2540, the previous plans are cleared by being set equal to the empty set.

In step 2542, the method 2500 determines if the plan is not clear of previous plans. If plan is not clear of previous plans, then go to step 2544. If plan is clear of previous plans, then go to step 2558.

In step 2544, md is set equal to the minimum kick-off depth. A second pass is performed through the set of plans, this time working on the kick-off depths rather than the nudge depths. One pass through is needed, starting with the minimum kick-off, to look at all depths and see if one can be found that makes the plan completely clear of all other plans.

In step 2546, md is set equal to md plus incr.

In step 2548, the kick-off depth change is tried, meaning to re-compute the plan on a trial basis with it kicking off at the current md value.

In step 2550, while plan is not clear of previous plans and md is less than maximum kick-off depth minus incr and getting clearer (cost), go to step 2546.

In step 2552, the method 2500 determines if cost is lower. If cost is lower, then go to step 2558. If cost is not lower, then go to step 2554. If a plan completely clear of other plans cannot be found, the algorithm returns to the minimum and tries again—this time only looking as long as the cost is improving. In this manner, since the cost cannot be brought down to 0.0 (no separation problems), the algorithm will at least get the cost as low as possible.

In step 2554, md is set equal to md minus incr.

In step 2556, kick-off depth is set equal to md.

In step 2558, the plan is added to the previous plan set.

In step 2560, the method 2500 determines if there are more plans. If there are more plans, then go to step 2544. If there are no more plans, then go to step 2562.

In step 2562, Changed is set equal to False.

In step 2564, the method 2500 determines if optimize kick-off was successful. If optimize kick-off was successful, then go to step 2564*b*. If optimize kick-off was not successful, then go to step 2566. At this point, the kick-off for engineering constraints and length may be optimized without introducing any new separation issues.

In step 2564*b*, Changed is set equal to true.

In step 2566, the method 2500 determines if there are more plans. If there are more plans, then go to step 2564. If there are no more plans, then go to step 2568.

In step 2568, the method 2500 determines if Changed is equal to false. If Changed is equal to false, then the method 2500 ends. If Changed is not equal to false, then go to step 2570.

In step 2570, the method 2500 determines if the kick-off is not getting better. If the kick-off is not getting better, then the method 2500 ends. If the kick-off is getting better, then go to step 2572.

In step 2572, the method 2500 determines if there have been 5 iterations. If there have been 5 iterations, then go to FIG. 25B. If there have not been 5 iterations, then go to step 2562.

Figure 25B:
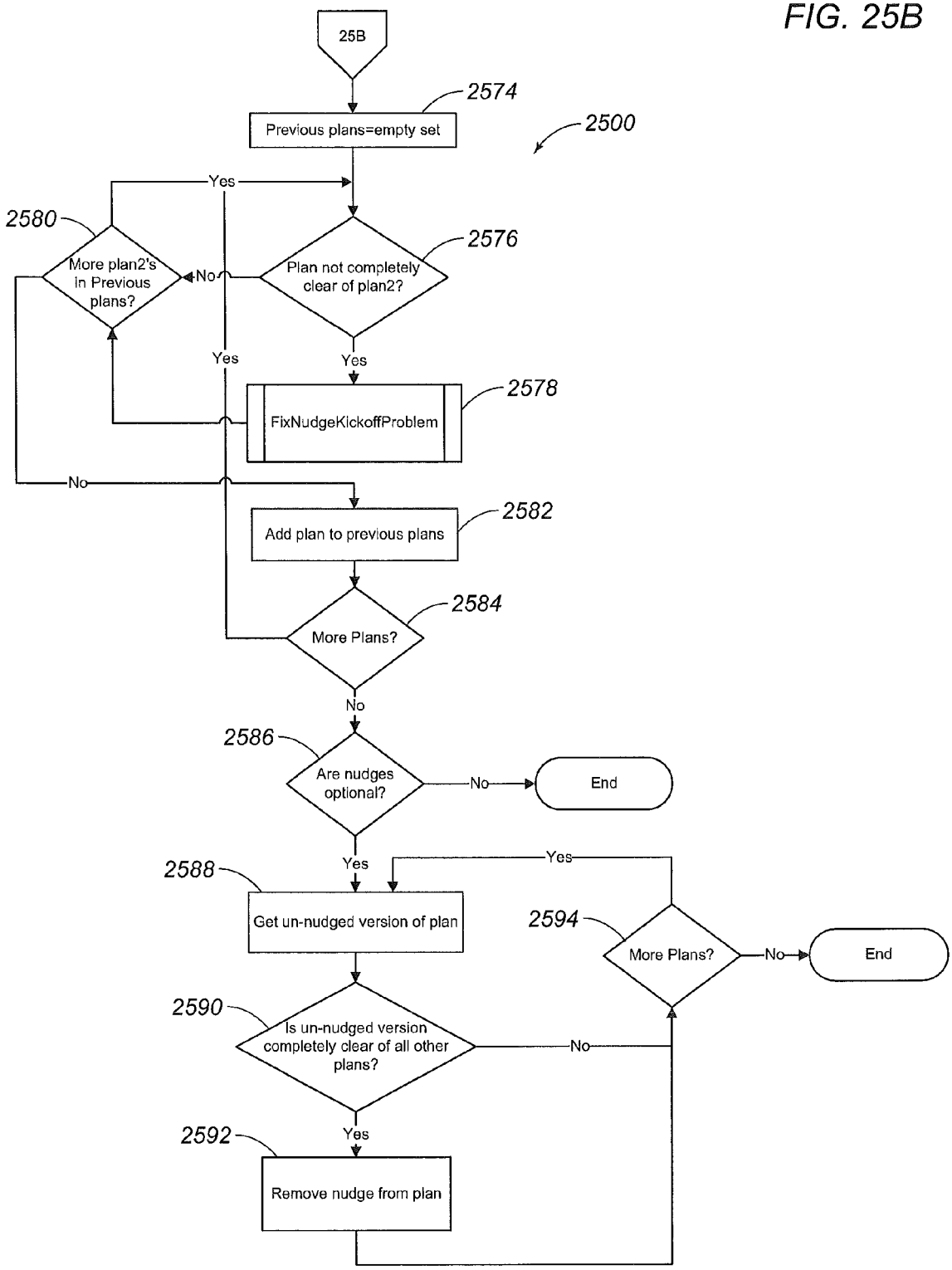
FIG. 25B is a continuation of the flowchart illustrated in FIG. 25A.

In FIG. 25B, the method 2500 continues to illustrate one embodiment of the optimize nudges algorithm as required for step 936 in FIG. 9B.

In step 2574, the previous plans are set equal to the empty set.

In step 2576, the method 2500 determines if the plan is completely clear of plan 2. If the plan is completely clear of plan 2, then go to step 2578. If the plan is not completely clear of plan 2, then go to step 2580.

In step 2578, the "FixNudgeKickoffProblem" algorithm is executed. This algorithm is further discussed in reference to FIG. 26.

In step 2580, the method 2500 determines if more plan 2's are in previous plans. If more plan 2's are in previous plans, then go to step 2576. If there are no more plan 2's in previous plans, then go to step 2582.

In step 2582, the plan is added to the list of previous plans.

In step 2584, the method 2500 determines if there are more plans. If there are more plans, then go to step 2580. If there are no more plans, then go to step 2586.

In step 2586, the method 2500 determines if nudges are optional. If nudges are optional, then go to step 2588. If nudges are not optional, then the method 2500 ends.

In step 2588, the un-nudged version of the plan is obtained.

In step 2590, the method 2500 determines if the un-nudged version is completely clear of all other plans. If the un-nudged version is completely clear of all other plans, then go to step 2592. If the un-nudged version is not completely clear of all other plans, then go to step 2594.

In step 2592, the nudge is removed from the plan.

In step 2594, the method 2500 determines if there are more plans. If there are more plans, then go to step 2588. If there are no more plans, then the method 2500 ends.

In FIG. 26, the method 2600 generally illustrates one embodiment of the "FixNudgeKickoffProblem" algorithm as required for step 2578 in FIG. 25B. After optimizing the kick-offs in method 2500, one final pass is made through the plans checking each plan for any separation issues where plans are either approaching too close to one another or not diverging fast enough. If there are such problems, the method 2600 is executed for performing step 2578 in FIG. 25B.

In step 2602, the depth at which the plans first get too close is found.

In step 2604, the locations of both plans at that depth is found.

In step 2606, the method 2600 determines if plan 1 moved farthest laterally from the slot location. If plan 1 moved farthest laterally from the slot location, then go to step 2608. If plan 1 has not moved farthest laterally from the slot location, then go to step 2612.

In step 2608, plan 1 is set to be the deeper plan (Plan A).

In step 2610, plan 2 is set to be the shallower plan (Plan B).

In step 2612, plan 2 is set to be the deeper plan (Plan A).

In step 2614, plan 1 is set to be the shallower plan (Plan B).

In step 2616, the method 2600 determines if there is more room to move nudge on either plan. If there is more room to move nudge on either plan, then go to step 2618. If there is no more room to move nudge on either plan, then go to step 2616*b*. The algorithm iteratively attempts to (if possible) move plan A halfway from its current nudge depth to the maximum nudge depth and plan B halfway from its current nudge depth to the minimum.

In step 2616*b*, Failed is returned to step 2578.

In step 2618, plan A's nudge depth is moved half way to maximum nudge depth.

In step 2620, plan B's nudge depth is moved half way to minimum nudge depth.

In step 2622, the method 2600 determines if the plans are too close based on a predetermined criteria. If the plans are too close, then go to step 2624. If the plans are not too close, then go to step 2622*b*.

In step 2622*b*, Succeeded is returned to step 2578.

In step 2624, the azimuth difference between nudges is computed using techniques well known in the art.

In step 2626, plan B nudge azimuth is moved 1 degree away from plan A.

In step 2628, the method 2600 determines if the plans are not too close based on a predetermined criteria. If the plans are not too close, then go to step 2628*b*. If the plans are too close, then go to step 2630. If moving move plan A halfway from its current nudge depth to the maximum nudge depth and plan B halfway from its current nudge depth to the minimum does not work, step 2628 computes the difference in azimuth between plan A and plan B and moves plan B up to 3 degrees away from plan A. This process is repeated until either the plans are no longer too close or there is no more room to move the nudges up or down. This is a last resort approach to fixing the nudges when nothing else works.

In step 2628*b*, Succeeded is returned to step 2578.

In step 2630, variable i is initialized to equal 0. If i is less than 3, then increase i by 1 and go to step 2632. If i is greater than 3, then the method 2600 ends.

In step 2632, the method 2600 determines if the plans are too close based on a predetermined criteria. If the plans are too close, then go to step 2616. If the plans are not too close, then go to step 2622*b*. If the user has selected to have the algorithm nudge some plans rather than nudging all plans, another pass through may be performed, testing each plan for what would happen if that nudge was taken out. If the plan would still be completely clear of all other plans without the nudge, that nudge is removed. Because the optimization will almost always require some combination of nudged plans, and trying the various combinations could cause an astronomical number of iterations, it is much more efficient to nudge them all, then try removing them one by one.

Figure 27:
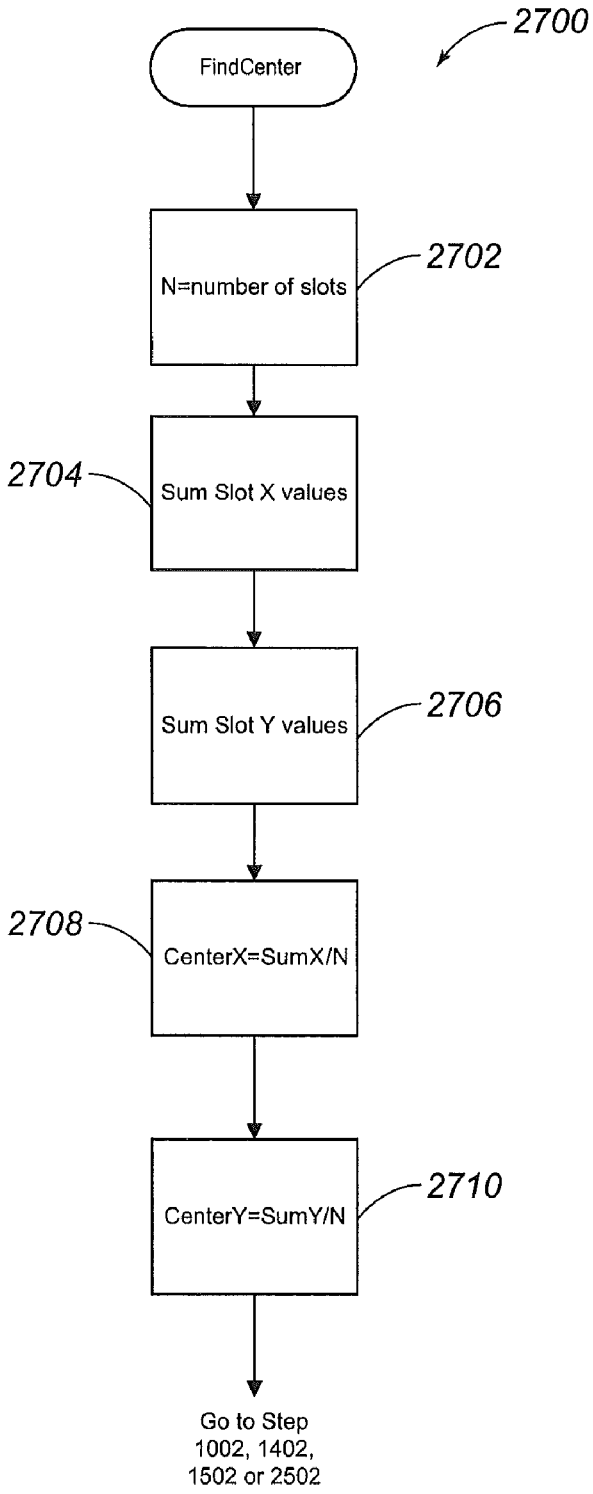
FIG. 27 is a flowchart illustrating one embodiment of the algorithm for step 1002 in FIG. 10, step 1402 in FIG. 14, step 1502 in FIG. 15 and step 2502 in FIG. 25A.

In FIG. 27, the method 2700 generally illustrates one embodiment of the "FindCenter" algorithm as required for steps 1002, 1402, 1502, and 2502 in FIGS. 10, 14, 15, and 25A. This algorithm computes a center location based upon averaging the x and y slot locations.

In step 2702, N is set equal to the number of slots.

In step 2704, the total sum of Slot X values is found.

In step 2706, the total sum of slot Y values is found.

In step 2708, CenterX is set equal to SumX divided by N.

In step 2710, CenterY is set equal to SumY divided by N.

Examples of Nudge and Kick-Off Optimization

Figure 28:
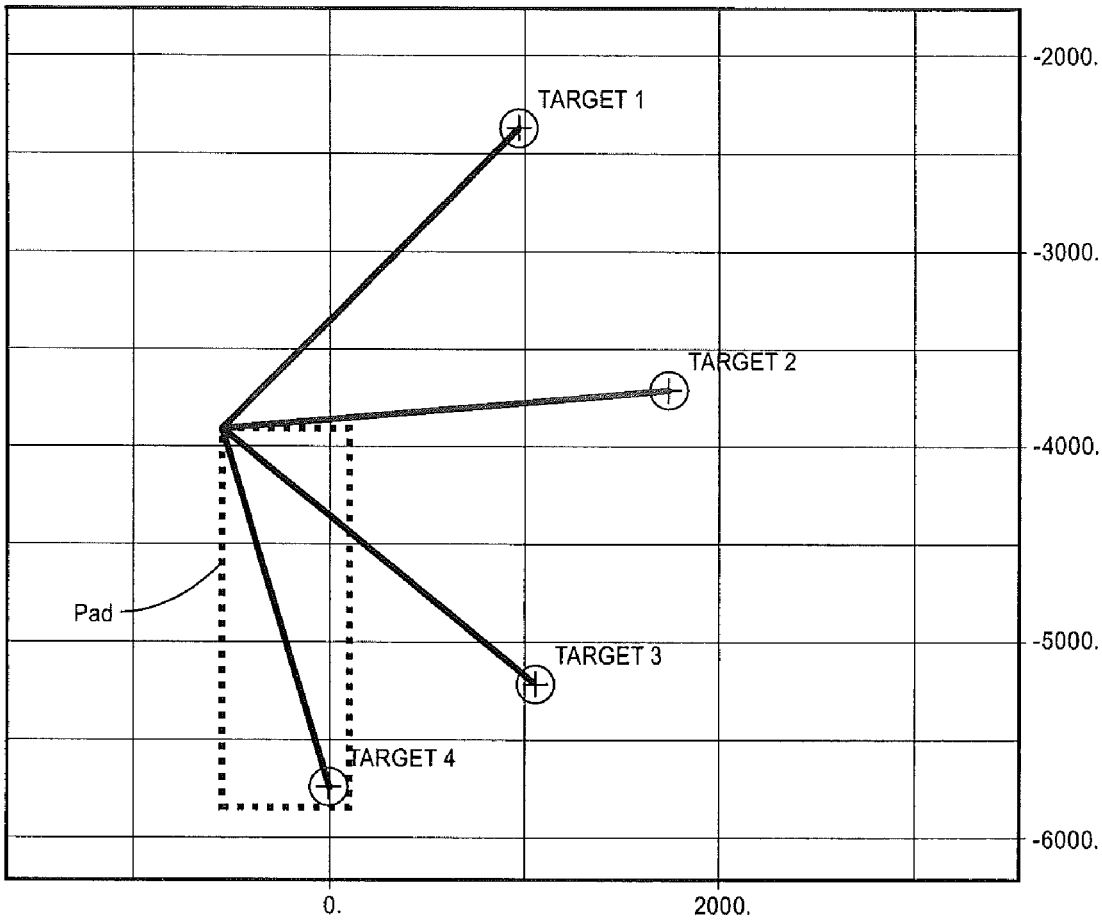
FIG. 28 is a plan view of four well path plans and a four slot pad.
Figure 29:
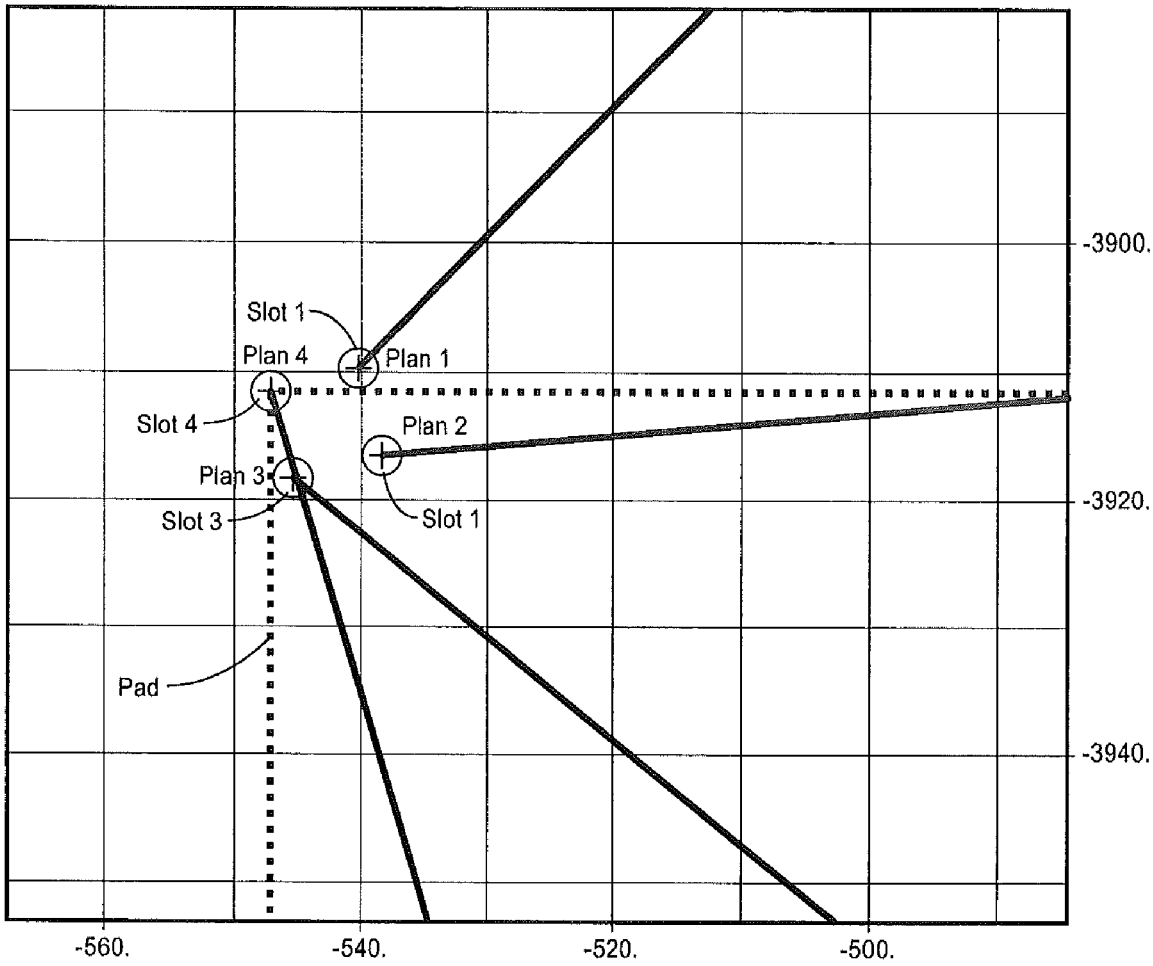
FIG. 29 is a close up of the four well path plans and the four slots in FIG. 28.

The following examples illustrate the objective of step 122 in FIG. 1. In FIG. 28, a plan view illustrates a set of 4 wells (targets) planned from a 4 slot pad. The pad is neither optimally positioned nor optimally oriented. This was deliberately done in order to illustrate the working of this particular algorithm (step 122), while at the same time keeping the example simple and understandable. Initially, the wells are all planned to kick-off at a depth of 1600 feet, which has been defined as the minimum depth for purposes of this example. If all of the plans kick-off at the same depth, then an initial scan highlights the obvious problem of Plan 4 approaching Plan 3 too closely in FIG. 29, which is a close up of FIG. 28, as it is heading directly for slot 3. Plan 3 is moving away from its slot, but at a tangent angle.

In order to optimize kick-off without using nudges, but varying the kick-off from a minimum of 1600 feet to a maximum of 2500 feet and maintaining a separation of 6 feet per 1000 feet, the algorithm will move the kick-off point of Plan 4 down to 1880 feet, which will resolve the issue of Plan 4 moving too close to Plan 3. However, with a minimum kick-off of 1600 feet, a separation of 6 feet per 1000 feet and slots that are spaced 7-10 feet from one another, nudging is required because all of the plans are closer than the minimum separation at kick-off.

Figure 30:
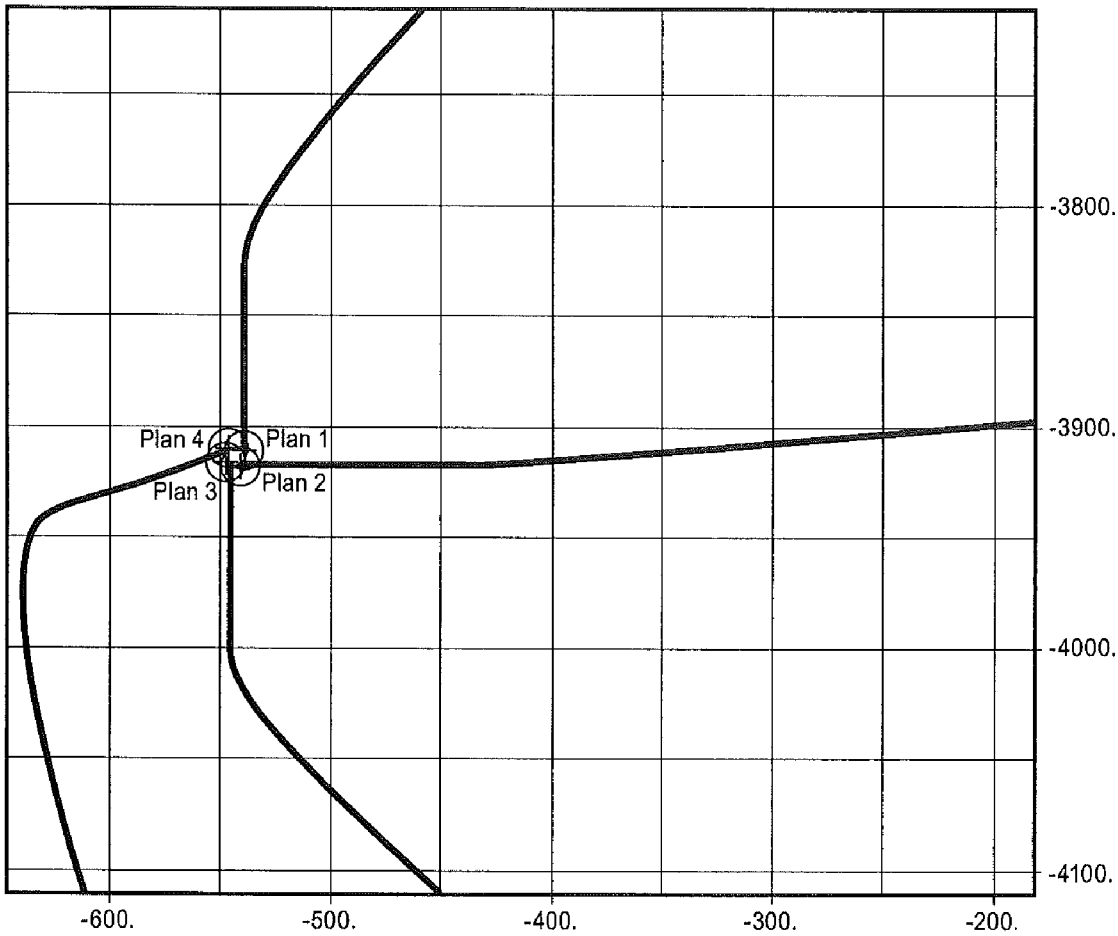
FIG. 30 is a plan view of the four well path plans in FIG. 28 after nudges are applied for all of the plans with a 90 degree maximum azimuth change.

In order to use nudges for all of the plans, giving it a build rate of 1 degree per 100 feet and a maximum nudge inclination of 5 degrees, a maximum azimuth change of 90 degrees and a nudge depth range of 400-800 feet, the algorithm will nudge them in the manner illustrated in FIG. 30. All of the nudges will occur at a minimum depth of 400 feet because there is no need to vary them. By default, the nudge pattern aims for maximizing the separation. As shown in FIG. 30, the 4 plans are initially heading due North, East, South and just a bit South of due West. The reason why Plan 4 is not nudged due West is that its intended trajectory is a bit East of due South and a 90 degree maximum azimuth change is imposed. The FixAzimuths algorithm (FIG. 24) has therefore, been executed to walk it over to a location that fits the criteria.

Figure 31:
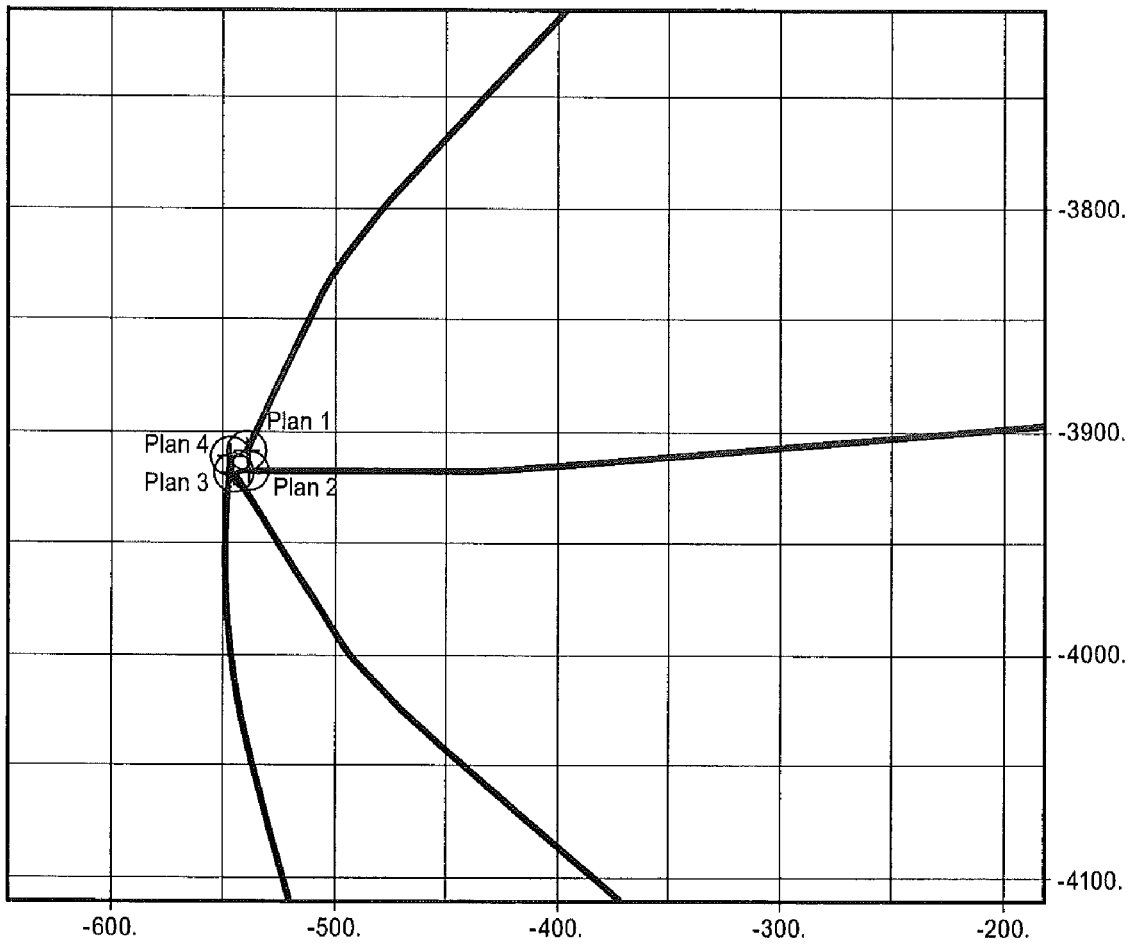
FIG. 31 is a plan view of the four well path plans in FIG. 28 after nudges are applied for all of the plans with a 20 degree maximum azimuth change.
Figure 32:
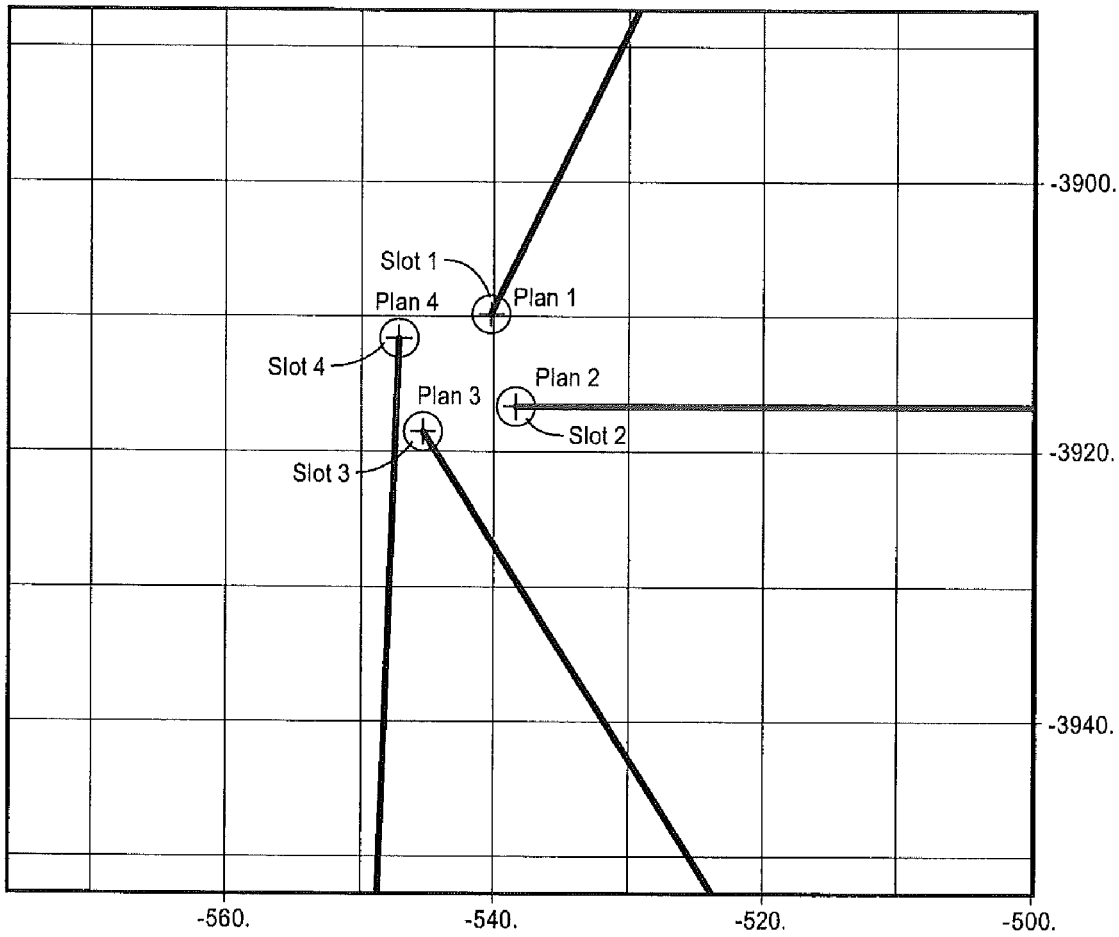
FIG. 32 is a close up of the four well path plans and the four slots in FIG. 31.

If, on the other hand, the azimuth change were restricted to about 20 degrees, the resulting nudges would be much more in line with the original trajectories as illustrated in FIG. 31. By restricting the azimuthal change, the nudge trajectory of Plan 4 gets quite close to Plan 3 as illustrated in FIG. 32, which is a close up of FIG. 31. This time the algorithm has nudged all of the plans at 400 feet, except for Plan 2, which has been nudged at 600 feet to keep it from interfering with Plan 3.

Alternatively, by specifying that the algorithm should only use nudges where they are needed, it will remove the nudge from Plan 4. Due to the spacing of the slots and the 1600 feet minimum kick-off, a maximum of one plan could not be nudged. Any two plans would be too close at the 1600 feet kick-off. It may be random that it happened to be Plan 4. For example, it could have been any plan, except for Plan 3, which had to nudge at a shallower depth than Plan 4. Due to the spacing of the 4 slots, they are all the same distance from the center in FIG. 32, so sorting would produce a random ordering.

Computer System

The present invention may be implemented through a computer-executable program of instructions, such as program modules, generally referred to as software applications or application programs executed by a computer. The software may include, for example, routines, programs, objects, components, and data structures that perform particular tasks or implement particular abstract data types. The software forms an interface to allow a computer to react according to a source of input. AssetPlanner™, and/or TracPlanner™, which are commercial software applications marketed by Landmark Graphics Corporation, may be used as interface applications to implement the present invention. The software may also cooperate with other code segments to initiate a variety of tasks in response to data received in conjunction with the source of the received data. The software may be stored and/or carried on any variety of memory media such as CD-ROM, magnetic disk, bubble memory and semiconductor memory (e.g., various types of RAM or ROM). Furthermore, the software and its results may be transmitted over a variety of carrier media such as optical fiber, metallic wire, free space and/or through any of a variety of networks such as the Internet.

Moreover, those skilled in the art will appreciate that the invention may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media including memory storage devices. The present invention may therefore, be implemented in connection with various hardware, software or a combination thereof, in a computer system or other processing system.

Figure 33:
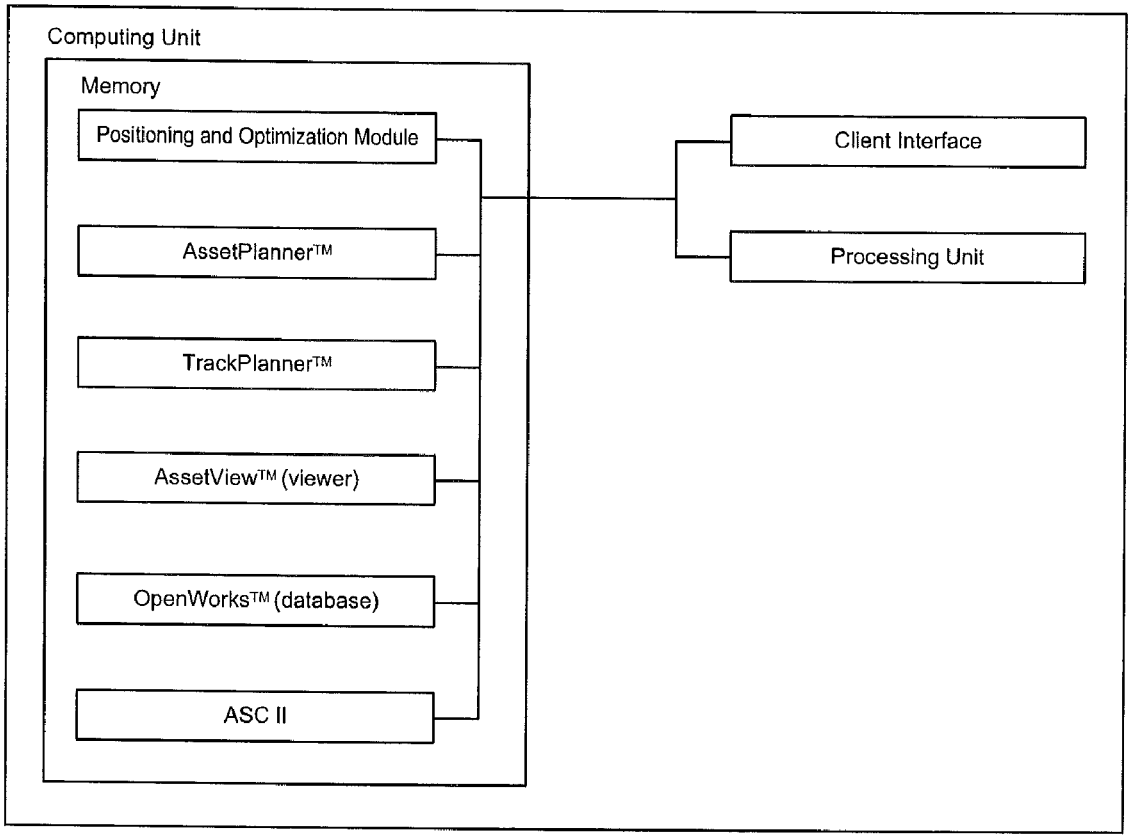
FIG. 33 is a block diagram illustrating one embodiment of a computer system for implementing the present invention.

Referring now to FIG. 33, a block diagram of a system for implementing the present invention on a computer is illustrated. The system includes a computing unit, sometimes referred to as a computing system, which contains memory, application programs, a database, a viewer, ASCII files, a client interface, and a processing unit. The computing unit is only one example of a suitable computing environment and is not intended to suggest any limitation as to the scope of use or functionality of the invention.

The memory primarily stores the application programs, which may also be described as program modules containing computer-executable instructions, executed by the computing unit for implementing the present invention described herein and illustrated in FIGS. 1-32. The memory therefore, includes a Positioning and Optimization Module, which may be used to interface with AssetPlanner™ and TracPlanner™ for determining the position of each pad, the optimal direction of each slot template and the adjustments between each well path plan from a pad to a selected well target that are necessary. The memory also includes OpenWorks™, which is another commercial software application marketed by Landmark Graphics Corporation and may be used as a database to supply data and/or store data results. ASCII files may also be used to supply data and/or store the data results. The memory also includes AssetView™, which is yet another commercial software application marketed by Landmark Graphics Corporation and may be used as a viewer to display the data and data results.

Although the computing unit is shown as having a generalized memory, the computing unit typically includes a variety of computer readable media. By way of example, and not limitation, computer readable media may comprise computer storage media and communication media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to, and/or presently being operated on, the processing unit. By way of example, and not limitation, the computing unit includes an operating system, application programs, other program modules, and program data.

The components shown in the memory may also be included in other removable/nonremovable, volatile/nonvolatile computer storage media. For example only, a hard disk drive may read from or write to nonremovable, nonvolatile magnetic media, a magnetic disk drive may read from or write to a removable, non-volatile magnetic disk, and an optical disk drive may read from or write to a removable, nonvolatile optical disk such as a CD ROM or other optical media. Other removable/non-removable, volatile/non-volatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above provide storage of computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like.

These and other input devices are often connected to the processing unit through the client interface that is coupled to a system bus, but may be connected by other interface and bus structures, such as a parallel port or a universal serial bus (USB). A monitor or other type of display device may be connected to the system bus via an interface, such as a video interface. In addition to the monitor, computers may also include other peripheral output devices such as speakers and printer, which may be connected through an output peripheral interface.

Although many other internal components of the computing unit are not shown, those of ordinary skill in the art will appreciate that such components and the interconnection are well known.

Because the systems and methods described herein may be used to selectively and automatically position various platform types, they may be particularly useful for positioning pads for cell phone towers, electrical lines, homes, oil and gas rigs and the like.

While the present invention has been described in connection with presently preferred embodiments, it will be understood by those skilled in the art that it is not intended to limit the invention to those embodiments. Although the illustrated embodiments of the present invention relate to the positioning of pads and slot templates for the oil and gas industry, for example, the present invention may be applied to any drilling application in other fields and disciplines. It is therefore, contemplated that various alternative embodiments and modifications may be made to the disclosed embodiments without departing from the spirit and scope of the invention defined by the appended claims and equivalents thereof.

The invention claimed is:

1. A computer implemented method for orientating a slot template, comprising:

computing an optimum slot assignment value for the slot template based on a predetermined number of slots, a predetermined number of plans, a trajectory for each plan and an initial angle using a computer processor;

rotating the slot template by a predetermined angle to a new angle;

computing another optimum slot assignment value for the slot template based on the predetermined number of slots, the predetermined number of plans, the trajectory for each plan and the new angle using the computer processor;

repeating the steps of i) rotating the slot template by a predetermined angle to a new angle; and ii) computing another optimum slot assignment value until the slot template is rotated to another predetermined angle;

identifying each new angle when the another optimum slot assignment value is less than the optimum slot assignment value; and orienting the slot template at the last identified new angle.

2. The method of claim 1, wherein computing the optimum slot assignment value and the another optimum slot assignment value further comprise determining whether the predetermined number of slots is equal to the predetermined number of plans.

3. The method of claim 2, wherein each plan includes a kick-off and computing the optimum slot assignment value and the another optimum slot assignment value further comprise determining whether each kick-off is about the same.

4. The method of claim 3, wherein computing the optimum slot assignment value and the another optimum slot assignment value further comprise determining whether the slot template is rectangular.

5. The method of claim 4, wherein computing the optimum slot assignment value and the another optimum slot assignment value further comprise making an initial assignment of each plan to a respective slot based on an optimal slot for each plan.

6. The method of claim 4, wherein computing the optimum slot assignment value and the another optimum slot assignment value further comprise making an initial assignment of each plan to a respective slot based on the kick-off for each plan.

7. The method of claim 5, wherein at least one plan is reassigned to another respective at least one slot for determining whether there are any problems that can be eliminated.

8. The method of claim 7, wherein the at least one plan is assigned to the respective slot if reassigning the at least one plan to the another respective at least one slot does not eliminate any problems.

9. The method of claim 1, wherein the predetermined angle is about 5 degrees.

10. The method of claim 1, wherein the another predetermined angle is 360 degrees.

11. A non-transitory program carrier device tangibly carrying computer executable instructions for orientating a slot template, the instructions being executable to implement:

computing an optimum slot assignment value for the slot template based on a predetermined number of slots, a predetermined number of plans, a trajectory for each plan and an initial angle;

rotating the slot template by a predetermined angle to a new angle;

computing another optimum slot assignment value for the slot template based on the predetermined number of slots, the predetermined number of plans, the trajectory for each plan and the new angle;

repeating the steps of i) rotating the slot template by a predetermined angle to a new angle; and ii) computing another optimum slot assignment value until the slot template is rotated to another predetermined angle;

identifying each new angle when the another optimum slot assignment value is less than the optimum slot assignment value; and orienting the slot template at the last identified new angle.

12. The program carrier device of claim 11, wherein computing the optimum slot assignment value and the another optimum slot assignment value further comprise determining whether the predetermined number of slots is equal to the predetermined number of plans.

13. The program carrier device of claim 12, wherein each plan includes a kick-off and computing the optimum slot assignment value and the another optimum slot assignment value further comprise determining whether each kick-off is about the same.

14. The program carrier device of claim 13, wherein computing the optimum slot assignment value and the another optimum slot assignment value further comprise determining whether the slot template is rectangular.

15. The program carrier device of claim 14, wherein computing the optimum slot assignment value and the another optimum slot assignment value further comprise making an initial assignment of each plan to a respective slot based on an optimal slot for each plan.

16. The program carrier device of claim 14, wherein computing the optimum slot assignment value and the another optimum slot assignment value further comprise making an initial assignment of each plan to a respective slot based on the kick-off for each plan.

17. The program carrier device of claim 15, wherein at least one plan is reassigned to another respective at least one slot for determining whether there are any problems that can be eliminated.

18. The program carrier device of claim 17, wherein the at least one plan is assigned to the respective slot if reassigning the at least one plan to the another respective at least one slot does not eliminate any problems.

19. The program carrier device of claim 11, wherein the predetermined angle is about 5 degrees.

20. The program carrier device of claim 11, wherein the another predetermined angle is 360 degrees.

* * * * *